US008465891B2

(12) United States Patent
Ozawa et al.

(10) Patent No.: US 8,465,891 B2
(45) Date of Patent: Jun. 18, 2013

(54) ELECTROPHOTOGRAPHIC PHOTOSENSITIVE MEMBER AND ELECTROPHOTOGRAPHIC APPARATUS

(75) Inventors: Tomohito Ozawa, Mishima (JP); Kazuyoshi Akiyama, Mishima (JP); Yuu Nishimura, Suntou-gun (JP); Daisuke Tazawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 266 days.

(21) Appl. No.: 12/943,977

(22) Filed: Nov. 11, 2010

(65) Prior Publication Data

US 2011/0117484 A1 May 19, 2011

(30) Foreign Application Priority Data

Nov. 17, 2009 (JP) ..... 2009-262397
Nov. 5, 2010 (JP) ..... 2010-248722

(51) Int. Cl.
*G03G 5/00* (2006.01)

(52) U.S. Cl.
USPC ..... 430/66; 430/57.4; 399/159

(58) Field of Classification Search
USPC ..... 430/66, 57.4; 399/159
See application file for complete search history.

(56) References Cited

U.S. PATENT DOCUMENTS 4,569,855 A 2/1986 Matsuda et al.
4,683,144 A 7/1987 Nishimura et al.
4,683,145 A 7/1987 Nishimura et al.
4,683,146 A 7/1987 Hirai et al.
4,683,147 A 7/1987 Eguchi et al.
5,112,709 A 5/1992 Yamazaki et al.
5,392,098 A 2/1995 Ehara et al.
5,455,138 A 10/1995 Okamura et al.
5,480,750 A 1/1996 Kawada et al.
5,582,944 A 12/1996 Yamamura et al.
5,817,181 A 10/1998 Okamura et al.
5,849,446 A 12/1998 Hashizume et al.
5,976,745 A 11/1999 Aoki et al.
6,183,930 B1 2/2001 Ueda et al.
6,238,832 B1 5/2001 Hashizume et al.
6,322,943 B1 11/2001 Aoki et al.
7,157,197 B2 1/2007 Aoki et al.
7,255,969 B2 8/2007 Kojima et al.
7,498,110 B2 3/2009 Taniguchi et al.

(Continued)

FOREIGN PATENT DOCUMENTS

EP 1229394 A2 8/2002
EP 2148245 A1 1/2010

(Continued)

OTHER PUBLICATIONS

European Search Report dated Sep. 25, 2012, in corresponding European Patent Application No. 10191359.8.

*Primary Examiner* — Mark A Chapman
(74) *Attorney, Agent, or Firm* — Fitzpatrick, Cella, Harper & Scinto

(57) ABSTRACT

An electrophotographic photosensitive member includes a photoconductive layer, an intermediate layer, and a surface layer. When Si+C atom density in the surface layer is represented by $D_S \times 10^{22}$ atoms/cm$^3$, the $D_S$ is 6.60 or more, and when the maximal value of H/(Si+H) in a distribution of hydrogen quantity in the photoconductive layer in a layer thickness direction is represented by $H_{Pmax}$, the average value of the H/(Si+H) in the second photoconductive region is represented by $H_{P2}$, the $D_S$ and the $H_{P2}$ satisfy the following expression (1) and the $D_S$ and the $H_{Pmax}$ satisfy the following expression (2).

$$H_{P2} \geqq 0.07 \times D_S - 0.38 \quad \text{Expression (1)}$$

$$H_{Pmax} \leqq 0.04 \times D_S + 0.60 \quad \text{Expression (2)}$$

8 Claims, 5 Drawing Sheets

U.S. PATENT DOCUMENTS

| | | | |
|---|---|---|---|
| 2010/0021835 | A1 | 1/2010 | Akiyama et al. |
| 2010/0021836 | A1 | 1/2010 | Ozawa et al. |
| 2010/0021837 | A1 | 1/2010 | Ozawa et al. |

FOREIGN PATENT DOCUMENTS

| | | | |
|---|---|---|---|
| EP | 2328031 | A1 | 6/2011 |
| JP | 58-080656 | A | 5/1983 |
| JP | 04-093864 | A | 3/1992 |
| JP | 05-018471 | A | 1/1993 |
| JP | 06-102686 | A | 4/1994 |
| JP | 06-250425 | A | 9/1994 |
| JP | 07-043921 | A | 2/1995 |
| JP | 07-175244 | A | 7/1995 |
| JP | 08-022229 | A | 1/1996 |
| JP | 11-161120 | A | 6/1999 |
| JP | 2000-003055 | A | 1/2000 |
| JP | 03-124841 | A | 1/2001 |
| JP | 2002-123020 | A | 4/2002 |
| JP | 2002-148907 | A | 5/2002 |
| JP | 2002-229303 | A | 8/2002 |
| JP | 2002-296987 | A | 10/2002 |
| JP | 2003-107766 | A | 4/2003 |
| JP | 2003-107767 | A | 4/2003 |
| JP | 2003-337437 | A | 11/2003 |
| JP | 2004-077650 | A | 3/2004 |
| JP | 2004-126347 | A | 4/2004 |
| JP | 2004-133397 | A | 4/2004 |

ELECTROPHOTOGRAPHIC PHOTOSENSITIVE MEMBER AND ELECTROPHOTOGRAPHIC APPARATUS

BACKGROUND OF THE INVENTION

1. Field of the Invention

The present invention relates to an electrophotographic photosensitive member and an electrophotographic apparatus. The present invention specifically relates to an electrophotographic photosensitive member which has a photoconductive layer formed from hydrogenated amorphous silicon, and has an intermediate layer and a surface layer both of which are formed from hydrogenated amorphous silicon carbide, on the photoconductive layer. Hereinafter, the hydrogenated amorphous silicon is referred to as "a-Si" as well, and the hydrogenated amorphous silicon carbide is referred to as "a-SiC" as well. In addition, the surface layer formed from "a-SiC" is referred to as "an a-SiC surface layer" as well.

2. Description of the Related Art

An electrophotographic photosensitive member is known, which has a photoconductive layer (photosensitive layer) formed from an amorphous material on a substrate. An amorphous-silicon electrophotographic photosensitive member (hereinafter is referred to as "an a-Si photosensitive member" as well) has already been commercialized, which has a photoconductive layer formed on the substrate with a layer-forming technology such as a chemical vapor deposition method (CVD method) and a physical vapor deposition method (PVD method), in particular. The layer structure of the a-Si photosensitive member is a layer structure as is illustrated in FIG. 5, for instance. In FIG. 5, an electrophotographic photosensitive member 5000 has a photoconductive layer 5002 formed from a-Si (hereinafter referred to as "an a-Si photoconductive layer" as well) formed on an electroconductive substrate 5001, and an a-SiC surface layer 5005 formed on the photoconductive layer 5002. The a-SiC surface layer 5005 is an important layer relating to electrophotographic properties. The properties required to the surface layer of the electrophotographic photosensitive member include abrasion resistance, moisture resistance, charge retentivity and optical transparency. The a-SiC surface layer has been mainly used for an electrophotographic apparatus having a quick process speed, because of being particularly superior in abrasion resistance and also superior in the balance among the above described other properties.

However, a conventional a-SiC surface layer has occasionally caused an image deletion (hereinafter referred to as "high-humidity deletion" as well) when having been used in a high-humidity environment. The high-humidity deletion means such an image failure that letters are blurred or form a white patch without being printed, occurring when an image has been repeatedly formed in the high-humidity environment according to an electrophotographic process and an image is output again after a while. One cause of this phenomenon is moisture which has adsorbed onto the surface of the electrophotographic photosensitive member. Conventionally, in order to reduce the occurrence of the high-humidity deletion, it has been conducted to always heat the electrophotographic photosensitive member with a heater for the photosensitive member, and reduce or remove the moisture which has adsorbed onto the surface of the electrophotographic photosensitive member. Such an electrophotographic photosensitive member is also proposed as to reduce the high-humidity deletion by other methods than the method using the heater for the photosensitive member.

Japanese Patent No. 3124841 discloses a technology of setting the atom density of a silicon atom, a carbon atom, a hydrogen atom or a fluorine atom in an a-SiC surface layer at a smaller value than a predetermined value, in an a-Si photosensitive member which has a photoconductive layer and the a-SiC surface layer sequentially formed on a substrate. The technology in Japanese Patent No. 3124841 forms the a-SiC surface layer so as to have a comparative rough layer structure by setting the atom density of each atom constituting the a-SiC surface layer at a smaller value than the predetermined value, and facilitates the a-SiC surface layer to be abraded in a cleaning step of the electrophotographic process. Japanese Patent No. 3124841 describes that the technology thereby acquires a new surface which always contains a little amount of the adsorbing moisture and thereby can reduce the high-humidity deletion. A technology is also proposed which relates to the enhancement of characteristics of the electrophotographic photosensitive member by improving the a-Si photoconductive layer and the a-SiC surface layer in the a-Si photosensitive member.

Japanese Patent No. 3236692 describes a technology of setting an atom density of atoms in an amorphous state in each layer at a smaller value than a predetermined value, and setting an atom density of the atom which compensates a dangling bond at a larger value than a predetermined value, in an electrophotographic photosensitive member which has a carrier injection inhibition layer, a photosensitive layer and a surface layer sequentially stacked on a substrate. Japanese Patent No. 3236692 describes that such layers can be stacked as to have layer thicknesses necessary for securing the abrasion resistance while improving charge transportability and preventing the increase of the residual potential by increasing defect density in the top surface side. The Patent also describes that charge retentivity can be secured at the same time by decreasing the defect density of the surface layer in the photoconductive layer side.

Japanese Patent Publication No. H05-018471 proposes an electrophotographic photosensitive member in which an a-SiC surface layer has been two-layered, in the a-SiC photosensitive member which has an a-Si photoconductive layer and an a-SiC surface layer sequentially formed on a substrate. Japanese Patent Publication No. H05-018471 discloses a technology of forming the a-SiC surface layer in which the defect density of the surface layer in the top surface side out of the two-layered surface layers is higher than that of the surface layer in the photoconductive layer side. Japanese Patent Publication No. H05-018471 describes that such surface layers can be formed as to have layer thicknesses necessary for securing the durability because the increase of the residual potential can be reduced by increasing the defect density in the top surface side. Japanese Patent Publication No. H05-018471 also describes that as a result, an electrophotographic photosensitive member having superior electrical properties can be produced by consequently making the a-SiC surface layer as a layer structure which has a high defect density and is comparatively rough.

Japanese Patent No. 3152808 describes a technology of setting an atom density of atoms in an amorphous state for skeleton constituting the photoconductive layer at a larger value than a predetermined value, and setting the atom density of the atom for compensating a dangling bond at a small value, when using an image exposing source having a wavelength of a predetermined wavelength or less. By thus setting the atom density of the atoms in an amorphous state for the skeleton constituting the photoconductive layer at the predetermined value or larger, a distance between each bonded atom is shortened, and accordingly a band gap as required can be obtained. In addition, by setting the atom density of the atom for compensating the dangling bond at the small value, a photocarrier exceeding the band gap can be generated with respect to a light amount of high-energy light having a predetermined wavelength for image exposure or shorter, and the carrier can be conducted through the band conduction of the generated carrier at high mobility. Japanese Patent No. 3152808 describes that as a result, the chargeability increases, an exposure potential is lowered, and an electrophotographic photosensitive member which can reduce the occurrence of an afterimage can be produced.

In recent years, it is required for an electrophotographic process to satisfy power-saving properties as well from the viewpoint of environmental consideration, while satisfying requests for a higher speed, a higher image quality and the longer life. In other words, further improvement is desired to the electrophotographic photosensitive member. For instance, as for the moisture resistance, if the high-humidity deletion occurs, the image quality decreases. Accordingly, an electrophotographic photosensitive member is required which does not cause the high-humidity deletion even in the high-humidity environment and can keep a high image quality. Here, when the above described heater for the photosensitive member is installed so as to keep the high image quality in the high-humidity environment, an electric power corresponding to a standby power is needed even when the electrophotographic apparatus is not operated, which makes it difficult to improve the power-saving properties.

In addition, even when the technology disclosed in Japanese Patent No. 3124841 is employed, the surface of the electrophotographic photosensitive member needs to be scraped off at some abrasion rate, and accordingly, an electrophotographic apparatus having a quick process speed, in particular, does not sufficiently secure the durability of the electrophotographic photosensitive member, occasionally. The factor because of which the durability of the electrophotographic photosensitive member cannot be sufficiently secured includes layer exfoliation in addition to the above described abrasion of the surface. When the layer thickness of the a-SiC surface layer is increased to a degree of being capable of coping with the request for the longer life, the internal stress of the surface layer increases. When the internal stress of the surface layer increases, there has been the case of causing the layer exfoliation in the vicinity of the interface between the photoconductive layer and the a-SiC surface layer, when a sudden environmental change (sudden change in temperature, humidity and the like) has occurred. One example of the cases in which such a sudden environmental change occurs includes the transportation of the electrophotographic photosensitive member by an aircraft.

The reason of causing the layer exfoliation in the vicinity of the interface between the photoconductive layer and the a-SiC surface layer is considered to be because when the internal stress of the a-SiC surface layer increases, a difference of the internal stress between the photoconductive layer and the a-SiC surface layer is expanded, and the stress is concentrated in the vicinity of the interface between the two layers. It is possible to alleviate the stress concentration in the vicinity of the interface between the photoconductive layer and the a-SiC surface layer by providing an intermediate layer between the photoconductive layer and the a-SiC surface layer, so as to reduce the layer exfoliation in the vicinity of the interface between the photoconductive layer and the a-SiC surface layer. However, when the surface layer having a large internal stress has been used, even though the above described intermediate layer was provided, there has been the case in which the interface between the photoconductive layer and the intermediate layer cannot withstand the high stress received from the surface layer, and the layer exfoliation occurs in the vicinity of the interface.

In addition even if the layer exfoliation in the vicinity of the interface between the photoconductive layer and the a-SiC surface layer is reduced by providing the intermediate layer, there has been the case of causing the layer exfoliation due to the fracture of the photoconductive layer when a sudden environmental change has occurred. The reason why the layer exfoliation is caused by the fracture of the photoconductive layer is considered to be because the occurrence of the layer exfoliation in the vicinity of the interface between the photoconductive layer and the a-SiC surface layer is reduced by providing the intermediate layer and thereby the stress coming from the surface layer concentrates in the photoconductive layer itself.

SUMMARY OF THE INVENTION

An object of the present invention is to provide an electrophotographic photosensitive member having superior resistance to high-humidity deletion, abrasion resistance and resistance to layer exfoliation, and an electrophotographic apparatus having the electrophotographic photosensitive member.

The present invention provides an electrophotographic photosensitive member including: a substrate; a photoconductive layer formed from hydrogenated amorphous silicon on the substrate; an intermediate layer formed from hydrogenated amorphous silicon carbide on the photoconductive layer; and a surface layer formed from hydrogenated amorphous silicon carbide on the intermediate layer, wherein when the ratio (C/(Si+C)) of the number (C) of carbon atoms in the surface layer with respect to the sum of the number (Si) of silicon atoms and the number (C) of carbon atoms in the surface layer is represented by $C_S$, the $C_S$ is 0.61 or more and 0.75 or less, when the ratio (H/(Si+C+H)) of the number (H) of hydrogen atoms in the surface layer with respect to the sum of the number (Si) of silicon atoms, the number (C) of carbon atoms and the number (H) of hydrogen atoms in the surface layer is represented by $H_S$, the $H_S$ is 0.20 or more and 0.45 or less, and the layer thickness of the surface layer is 0.2 μm or more and 3.0 μm or less; when the ratio (C/(Si+C)) of the number (C) of carbon atoms in the intermediate layer with respect to the sum of the number (Si) of silicon atoms and the number (C) of carbon atoms in the intermediate layer is represented by $C_M$, the $C_M$ is 0.25 or more and $0.9\times C_S$ or less, when the ratio (H/(Si+C+H)) of the number (H) of hydrogen atoms in the intermediate layer with respect to the sum of the number (Si) of silicon atoms, the number (C) of carbon atoms and the number (H) of hydrogen atoms in the intermediate layer is represented by $H_M$, the $H_M$ is 0.20 or more and 0.45 or less, and the layer thickness of the intermediate layer is 0.1 μm or more and 1.0 μm or less; when the sum of the atom density of silicon atoms and the atom density of carbon atoms in the surface layer is represented by $D_S\times10^{22}$ atoms/cm$^3$, the $D_S$ is 6.60 or more, when the sum of the atom density of silicon atoms and the atom density of carbon atoms in the intermediate layer is represented by $D_M\times10^{22}$ atoms/cm$^3$, the $D_M$ is less than 6.60, and when the atom density of silicon atoms in the photoconductive layer is represented by $D_P\times10^{22}$ atoms/cm$^3$, the $D_P$ is 4.20 or more and 4.80 or less; and when the maximal value of the ratio (H/(Si+H)) of the number (H) of hydrogen atoms in a distribution of hydrogen quantity in the photoconductive layer in a layer thickness direction with respect to the sum of the number (Si) of silicon atoms and the number (H) of hydrogen atoms in the distribution is represented by $H_{Pmax}$, the $D_S$ and the $H_{Pmax}$ satisfy the following Expression (2), and when the ratio (H/(Si+H)) of the number (H) of hydrogen atoms in the intermediate layer side from the middle position of the photoconductive layer in the layer thickness direction with respect to the sum of the number (Si) of silicon atoms and the number (H) of hydrogen atoms in the intermediate layer side is represented by $H_{P2}$, the $D_S$ and the $H_{P2}$ satisfy the following Expression (1).

$$H_{P2} \geqq 0.07 \times D_S - 0.38 \quad \text{Expression (1)}$$

$$H_{Pmax} \leqq -0.04 \times D_S + 0.60 \quad \text{Expression (2)}$$

The present invention can provide an electrophotographic photosensitive member having superior resistance to high-humidity deletion, abrasion resistance and resistance to layer exfoliation, and an electrophotographic apparatus having the electrophotographic photosensitive member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

An electrophotographic photosensitive member according to the present invention includes a substrate, a photoconductive layer formed from hydrogenated amorphous silicon on the substrate, an intermediate layer formed from hydrogenated amorphous silicon carbide on the photoconductive layer, and a surface layer formed from hydrogenated amorphous silicon carbide on the intermediate layer.

Figure 1A:
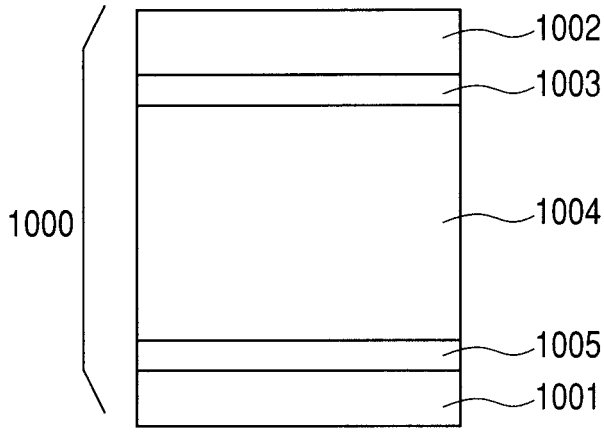
FIG. 1A is a view illustrating an example of a layer structure of an electrophotographic photosensitive member according to the present invention.
Figure 1B:
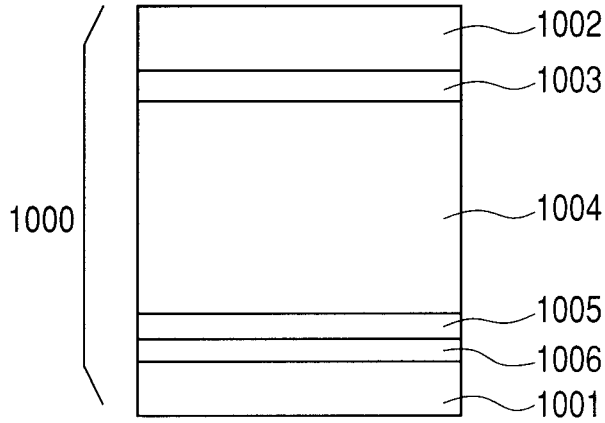
FIG. 1B is a view illustrating an example of a layer structure of an electrophotographic photosensitive member according to the present invention.

FIGS. 1A and 1B are views illustrating examples of layer structures of electrophotographic photosensitive members according to the present invention. An electrophotographic photosensitive member 1000 having a layer structure illustrated in FIG. 1A has a cylindrical electroconductive substrate 1001 made from aluminum or the like, and a charge injection inhibition layer 1005, a photoconductive layer 1004, an intermediate layer 1003 and a surface layer 1002, which are sequentially stacked on the substrate 1001. An electrophotographic photosensitive member 1000 having a layer structure illustrated in FIG. 1B has the substrate 1001, and an adhesive layer 1006, the charge injection inhibition layer 1005, the photoconductive layer 1004, the intermediate layer 1003 and the surface layer 1002, which are sequentially stacked on the substrate 1001. Hereafter, the ratio (C/(Si+C)) of the number (C) of carbon atoms with respect to the sum of the number (Si) of silicon atoms and the number (C) of the carbon atoms is simply referred to as "C/(Si+C)" as well. The ratio (H/(Si+C+H)) of the number (H) of hydrogen atoms with respect to the sum of the number (Si) of silicon atoms, the number (C) of carbon atoms and the number (H) of the hydrogen atoms is also simply referred to as "H/(Si+C+H)" as well, hereafter. The ratio (H/(Si+H)) of the number (H) of hydrogen atoms with respect to the sum of the number (Si) of silicon atoms and the number (H) of the hydrogen atoms is also simply referred to as "H/(Si+H)" as well, hereafter. In addition, the C/(Si+C) in the surface layer is referred to as "$C_S$" as well, and the C/(Si+C) in the intermediate layer is referred to as "$C_M$" as well, hereafter. In addition, the sum of the atom density of the silicon atoms and the atom density of the carbon atoms is referred to as "Si+C atom density" as well, the atom density of the silicon atoms is referred to as "Si atom density" as well, and the atom density of the carbon atoms is referred to as "C atom density" as well, hereafter. In addition, H/(Si+C+H) in the surface layer is referred to as "$H_S$" as well, and H/(Si+C+H) in the intermediate layer is referred to as "$H_M$" as well, hereafter. In addition, the photoconductive layer locating in the substrate side from the middle position of the photoconductive layer in the layer thickness direction is referred to as "a first photoconductive region" as well, and the photoconductive layer locating in the intermediate layer side from the middle position of the photoconductive layer in the layer thickness direction is referred to as "a second photoconductive region" as well, hereafter. Furthermore, the intermediate layer formed from "a-SiC" is referred to as "an a-SiC intermediate layer" as well, and the photoconductive layer formed from "a-Si" is referred to as "an a-Si photoconductive layer" as well, hereafter.

The surface layer of the electrophotographic photosensitive member according to the present invention is a layer formed from a-SiC (hydrogenated amorphous silicon carbide). When the Si+C atom density in the a-SiC surface layer is represented by $D_S \times 10^{22}$ atoms/cm$^3$, the $D_S$ in the surface layer of the electrophotographic photosensitive member according to the present invention is 6.60 or more. Thereby, the abrasion resistance of the electrophotographic photosensitive member is enhanced, and furthermore, the moisture resistance is enhanced, which thereby enhances the resistance to the high-humidity deletion as well. The effect of setting the $D_S$ at 6.60 or more will be described in detail below. One reason of the high-humidity deletion is the adsorption of the moisture onto the surface of the electrophotographic photosensitive member as was described above, but the adsorption amount of the moisture is small in an early stage of the use of the electrophotographic photosensitive member, and an image deletion hardly occurs. While the electrophotographic photosensitive member is used for some period, the surface layer is oxidized due to the influence of ozone mainly in a charging step in the electrophotographic apparatus, and the oxidized layer is formed on the surface of the electrophotographic photosensitive member and is accumulated. It is considered that this oxidized layer forms a polar group on the surface of the electrophotographic photosensitive member and thereby the adsorption amount of the moisture increases. It is considered that if the electrophotographic photosensitive member is further continuously used, the oxidized layer is continuously accumulated on the surface of the electrophotographic photosensitive member and thereby the adsorption amount of the moisture also increases and consequently reaches such an adsorption amount of the moisture as to cause the high-humidity deletion. Accordingly, in order to reduce the high-humidity deletion, this oxidized layer needs to be removed or the formation of the oxidized layer needs to be suppressed.

In the present invention, this formation of the oxidized layer is suppressed, which decreases the adsorption amount of the moisture and reduces the high-humidity deletion. The reason why the structure of the a-SiC surface layer of the electrophotographic photosensitive member according to the present invention can suppress the formation of the oxidized layer is assumed to be as follows. Specifically, it is assumed that the oxidation of the a-SiC surface layer occurs due to a break in a bond between a silicon atom (Si) and a carbon atom (C), consequent free of the carbon atom (C) and the new bonding between an oxygen atom (O) and the silicon atom (Si), which are caused by the action of a material having an oxidation action like ozone to a-SiC. It is considered that the electrophotographic photosensitive member according to the present invention increases the atom densities of the silicon atoms and the carbon atoms which are skeleton-constituting atoms of the a-SiC thereby to shorten the average distance between the atoms and also to decrease porosity, and thereby suppresses the above described oxidization of the a-SiC surface layer caused by the free of the carbon atoms (C). It is also assumed that such a-SiC having the enhanced atom density also enhances a bonding force between the skeleton-constituting atoms, which leads to high hardening for the a-SiC surface layer and enhances also the abrasion resistance of the electrophotographic photosensitive member.

In the present invention, the formation of the oxidized layer on the surface of the electrophotographic photosensitive member is suppressed as was described above, and accordingly, it is not necessary to facilitate the surface of the electrophotographic photosensitive member to be easily scraped off in order to remove the oxidized layer. Accordingly, the electrophotographic photosensitive member can enhance the resistance to the high-humidity deletion as well, while enhancing its abrasion resistance. For the above described reason, the Si+C atom density in the a-SiC surface layer can be higher, and the $D_S$ can be 6.81 or more.

Furthermore, the electrophotographic photosensitive member of the present invention includes that when the maximal value of H/(Si+H) in a distribution of hydrogen quantity in the a-Si photoconductive layer of the electrophotographic photosensitive member in the layer thickness direction is represented by $H_{Pmax}$, the $D_S$ and the $H_{Pmax}$ satisfy the following Expression (2). The electrophotographic photosensitive member also includes that when H/(Si+H) in the second photoconductive region is represented by $H_{P2}$, the $D_S$ and the $H_{P2}$ satisfy the following expression (1).

$$H_{P2} \geqq 0.07 \times D_S - 0.38 \quad \text{Expression (1)}$$

$$H_{Pmax} \leqq -0.04 \times D_S + 0.60 \quad \text{Expression (2)}$$

When the $D_S$ and the $H_{P2}$ satisfy the above described Expression (1), the layer exfoliation in the vicinity of the interface between the a-Si photoconductive layer and the a-SiC intermediate layer due to a sudden environmental change can be reduced even when the a-SiC surface layer in which the Si+C atom density is high is employed. Furthermore, when the $D_S$ and the $H_{Pmax}$ satisfy the above described expression (2), the layer exfoliation caused by the fracture of the a-Si photoconductive layer due to a sudden environmental change can be also reduced.

However, it is only in the case in which the a-Si photoconductive layer, the a-SiC intermediate layer and the a-SiC surface layer satisfy the following conditions that the present inventors confirm that the above described layer exfoliation can be reduced when the $D_S$ and the $H_{P2}$ satisfy the above described Expression (1) and when the $D_S$ and the $H_{Pmax}$ satisfy the above described expression (2). Firstly, in the a-SiC surface layer, the $C_S$ is 0.61 or more and 0.75 or less, the $H_S$ is 0.20 or more and 0.45 or less, and the layer thickness is 0.2 μm or more and 3.0 μm or less. Hereafter, these ranges are referred to as "satisfaction condition of the a-SiC surface layer" as well. Secondly, in the a-SiC intermediate layer, when the Si+C atom density in the a-SiC intermediate layer is represented by $D_M \times 10^{22}$ atoms/cm$^3$, the $D_M$ is less than 6.60, the $C_M$ is 0.25 or more and $0.9 \times C_S$ or less, the $H_M$ is 0.20 or more and 0.45 or less, and the layer thickness is 0.1 μm or more and 1.0 μm or less. Hereafter, these ranges are referred to as "satisfaction condition of the a-SiC intermediate layer" as well. Thirdly, in the a-Si photoconductive layer, when the Si atom density is represented by $D_P \times 10^{22}$ atoms/cm$^3$, the $D_P$ is 4.20 or more and 4.80 or less. Hereafter, these ranges are referred to as "satisfaction condition of the a-Si photoconductive layer" as well.

The effect of the $D_S$ and the $H_{P2}$ which satisfy the above described expression (1) will be described in detail below. Firstly, the tendency of the internal stress of the a-SiC surface layer will be described below. It is assumed that as the Si+C atom density in the a-SiC surface layer increases, the internal stress increases, on the above described satisfaction condition of the a-SiC surface layer. Then, it has been found that when the layer thickness of the a-SiC surface layer was kept constant and the $D_S$ was changed, the internal stress of the a-SiC surface layer increases as the $D_S$ increases.

A high stress generated in the a-SiC surface layer in which the Si+C atom density is high concentrates on a region in which the difference of the internal stress is largest out of each layer existing in the substrate side from the a-SiC surface layer or the interface between the each layer. When a layer structure as in the electrophotographic photosensitive member according to the present invention is adopted, the stress easily concentrates on the vicinity of the interface between the a-SiC surface layer and the a-SiC intermediate layer, on the vicinity of the interface between the a-SiC intermediate layer and the a-Si photoconductive layer, and on the vicinity of the interface between the a-Si photoconductive layer and a layer in the substrate side of the a-Si photoconductive layer or the substrate. Among the above described interfaces, the difference of the internal stress in the interface between the a-Si photoconductive layer and the a-SiC intermediate layer which are respectively formed from a-Si and a-SiC is larger than in the interface between the a-SiC surface layer and the a-SiC intermediate layer both of which are formed from a-SiC, because of the difference between the layer structures. Accordingly, it is considered that in the layer structure as in the electrophotographic photosensitive member according to the present invention, a high stress originating from the a-SiC surface layer concentrates on the vicinity of the interface between the a-Si photoconductive layer and the a-SiC intermediate layer, in the ranges of the above described satisfaction condition of the a-SiC intermediate layer.

It is considered that the a-Si photoconductive layer can more alleviate a high stress receiving from the a-SiC surface layer as H/(Si+H) in the a-Si photoconductive layer is larger, in the ranges of the above described satisfaction condition of the a-Si photoconductive layer. The reason is assumed to be because when the a-Si contains many hydrogen atoms, the flexibility of the bond between the silicon atoms increases. Accordingly, because the flexibility of the bond between the silicon atoms increases by increasing the $H_{P2}$ which is H/(Si+H) in the second photoconductive region that comes in contact with the a-SiC intermediate layer, the second photoconductive region can alleviate the high stress receiving from the a-SiC surface layer, even when a sudden environmental change has occurred. From the above description, the electrophotographic photosensitive member can reduce the layer exfoliation in the vicinity of the interface between the a-Si photoconductive layer and the a-SiC intermediate layer, by controlling the $D_S$ which determines the stress of the a-SiC surface layer, and the $H_{P2}$ which determines the capability of alleviating the high stress receiving from the a-SiC surface layer, even when a sudden environmental change has occurred.

The present inventors made an investigation, and as a result, found that as the Si+C atom density in the a-SiC surface layer increased, the internal stress in the a-SiC surface layer increased, and that it was effective to increase the $H_{P2}$ along with the increase of the internal stress in order to alleviate the stress. Furthermore, it was found that there was a positive correlation between each value of the $D_S$ and the $H_{P2}$ in the boundary, which specified a range of being capable of reducing the layer exfoliation in the vicinity of the interface between the a-Si photoconductive layer and the a-SiC intermediate layer.

It could be also confirmed through an experiment that the electrophotographic photosensitive member could reduce the layer exfoliation in the vicinity of the interface between the a-Si photoconductive layer and the a-SiC intermediate layer due to the sudden environmental change, by setting the $D_S$ and the $H_{P2}$ so that the values satisfy the above described expression (1). It could be also confirmed that the electrophotographic photosensitive member could reduce the layer exfoliation in the vicinity of the interface between the a-Si photoconductive layer and the a-SiC intermediate layer due to a further sudden environmental change, by setting the $D_S$ and the $H_{P2}$ so that the values satisfy the above described expression (3):

$$H_{P2} \geqq 0.08 \times D_S - 0.41 \quad \text{Expression (3)}$$

Next, the effect of an operation of setting the $D_S$ and the $H_{Pmax}$ so that the values satisfy the above described expression (2) will be described in detail below. The tendency of the internal stress in the a-SiC surface layer is as described above. As was described above, by increasing the $H_{P2}$, the a-Si photoconductive layer can alleviate the high stress receiving from the a-SiC surface layer and accordingly can reduce the layer exfoliation in the vicinity of the interface between the a-Si photoconductive layer and the a-SiC intermediate layer. However, when H/(Si+H) in the a-Si photoconductive layer is excessively increased, the a-Si itself occasionally becomes a nondense layer. Therefore, a region in which the H/(Si+H) is large in the a-Si photoconductive layer occasionally cannot endure the high stress receiving from the a-SiC surface layer by the sudden environmental change to be fractured, and the layer exfoliation occasionally occurs in the middle of the a-Si photoconductive layer.

From the above description, the electrophotographic photosensitive member can reduce the layer exfoliation caused by the fracture of the a-Si photoconductive layer due to the sudden environmental change, by controlling further the $D_S$ which determines the stress of the a-SiC surface layer and the $H_{Pmax}$ which determines the denseness of the a-Si photoconductive layer, when reducing the layer exfoliation in the vicinity of the interface between the a-Si photoconductive layer and the a-SiC intermediate layer. The present inventors made an extensive investigation, and as a result, found that as the density of the a-SiC surface layer was enhanced, the internal stress of the a-SiC surface layer increased, and that it was effective to decrease the $H_{Pmax}$ along with the increase of the internal stress, in order to make the a-Si photoconductive layer to endure the stress and not to cause the above described layer exfoliation. Furthermore, it was found that there was a negative correlation between each value of the $D_S$ and the $H_{Pmax}$ in the boundary, which specifies a range of being capable of reducing the layer exfoliation.

It could be also confirmed through the experiment that the electrophotographic photosensitive member could reduce the layer exfoliation due to the fracture of the a-Si photoconductive layer by setting the $D_S$ and the $H_{Pmax}$ so that the values satisfied the above described expression (2). It could be also confirmed that by setting the $H_{Pmax}$ at 0.31 or less, a large effect of reducing the layer exfoliation caused by the fracture of the a-Si photoconductive layer due to the further sudden environmental change was obtained. As was described above, in the present invention, it is important to set the $D_S$ so as to be 6.60 or more and the $D_S$, $H_{P2}$, and $H_{Pmax}$ so as to satisfy the above described expression (1) and above described expression (2). Thereby, the present invention can provide an electrophotographic photosensitive member which can reduce the layer exfoliation even when the a-SiC surface layer having high density is used, and has superior moisture resistance and durability. The structures of each layer and substrate will be described in detail below.

(a-Si Photoconductive Layer)

Figure 7:
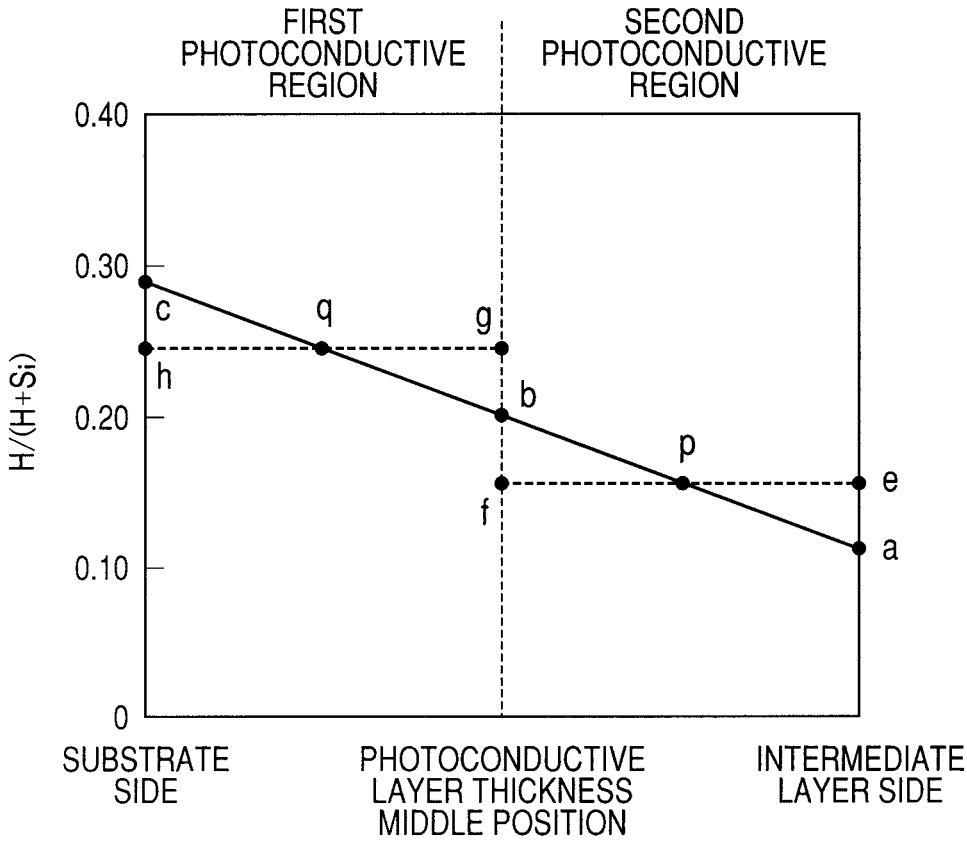
FIG. 7 is a view for describing a method for calculating $H_{P1}$ and $H_{P2}$.

In the present invention, $D_P$ satisfies a range of 4.20 or more and 4.80 or less, $D_S$ and $H_{P2}$ satisfy the above described expression (1), and $D_S$ and $H_{Pmax}$ satisfy the above described expression (2). The $H_{P1}$ and the $H_{P2}$ will be described below with reference to FIG. 2. In the description, the $H_{P1}$ is H/(Si+H) in a first photoconductive region, the $H_{P2}$ is H/(Si+H) in a second photoconductive region, and the $H_{Pmax}$ is the maximal value in a distribution of H/(Si+H) in the a-Si photoconductive layer in the layer thickness direction. More specifically, the $H_{P1}$ is the average value of the H/(Si+H) in the first photoconductive region, and the $H_{P2}$ is the average value of the H/(Si+H) in the second photoconductive region. The method for calculating the $H_{P1}$ and the $H_{P2}$ will be described below with reference to FIG. 7. FIG. 7 illustrates the distribution of the H/(Si+H) in the layer thickness direction in the a-Si photoconductive layer. The point a shown in FIG. 7 is the H/(Si+H) in the a-Si photoconductive layer on the closest side to the a-SiC intermediate layer, the point b is H/(Si+H) in the midpoint in the layer thickness of the a-Si photoconductive layer, and the point c is the H/(Si+H) in the a-Si photoconductive layer on the closest side to the substrate.

Firstly, a method for calculating $H_{P1}$ will be described below. An arbitrary point of the H/(Si+H) in the first photoconductive region in the layer thickness direction is defined as q. A straight line is drawn so as to pass the q and be parallel to the abscissa axis, an intersection of the straight line and the middle position of the photoconductive layer thickness is defined as g, and an intersection of the straight line and the position of the a-Si photoconductive layer on the closest side to the substrate is defined as h (where values of H/(Si+H) at g, h and q are the same). Such q is determined as an area in a region surrounded by a line segment ch, a line segment hq and a line segment qc which have been obtained by the above operation becomes equal to an area in a region surrounded by a line segment bg, a line segment gq and a line segment qb, and H/(Si+H) of q at this time is defined as the $H_{P1}$.

The similar calculation is conducted on the $H_{P2}$ as well. In other words, an arbitrary point of the H/(Si+H) in the second photoconductive region in the layer thickness direction is defined as p, a straight line is drawn so as to pass the p and be parallel to the abscissa axis, and intersections of the straight line and the middle position of the photoconductive layer thickness, and of the straight line and a position of the a-Si photoconductive layer on the closest side to the a-SiC intermediate layer are respectively defined as f and e (where values of H/(Si+H) at e, f and p are the same). Such p is determined as an area in a region surrounded by a line segment ae, a line segment ep and a line segment pa which have been obtained by the above operation becomes equal to an area in a region surrounded by a line segment bf, a line segment fp and a line segment pb, and H/(Si+H) of p at this time is defined as the $H_{P2}$.

Figure 2A:
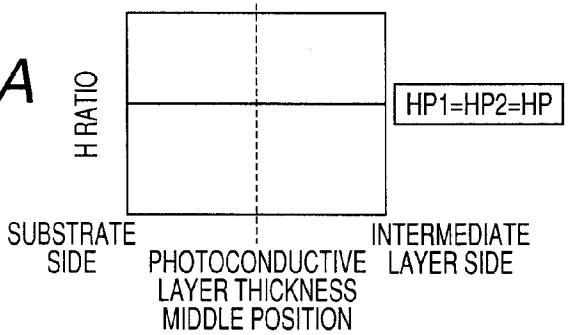
FIG. 2A is a view for describing the ratio of the number of hydrogen atoms in a photoconductive layer in the layer thickness direction with respect to the sum of the number of silicon atoms and the number of the hydrogen atoms in the photoconductive layer.
Figure 2B:
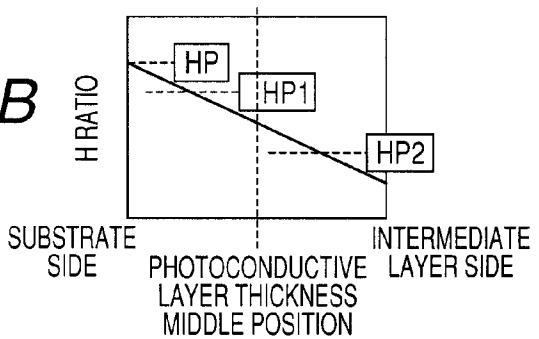
FIG. 2B is a view for describing the ratio of the number of hydrogen atoms in a photoconductive layer in the layer thickness direction with respect to the sum of the number of silicon atoms and the number of the hydrogen atoms in the photoconductive layer.
Figure 2C:
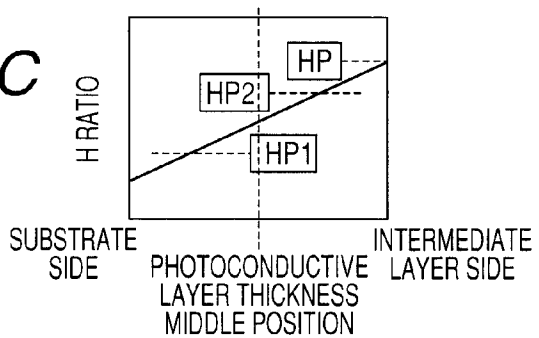
FIG. 2C is a view for describing the ratio of the number of hydrogen atoms in a photoconductive layer in the layer thickness direction with respect to the sum of the number of silicon atoms and the number of the hydrogen atoms in the photoconductive layer.
Figure 2D:
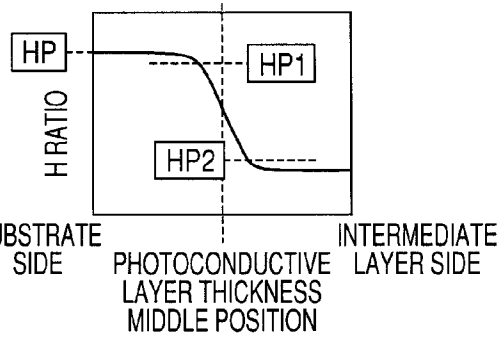
FIG. 2D is a view for describing the ratio of the number of hydrogen atoms in a photoconductive layer in the layer thickness direction with respect to the sum of the number of silicon atoms and the number of the hydrogen atoms in the photoconductive layer.
Figure 2E:
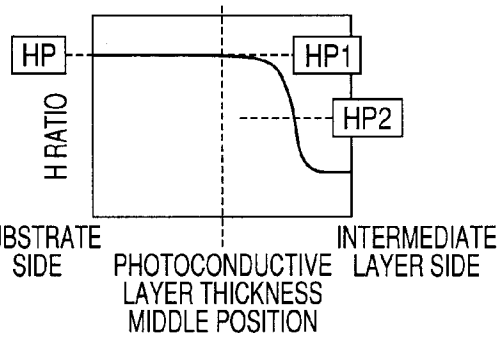
FIG. 2E is a view for describing the ratio of the number of hydrogen atoms in a photoconductive layer in the layer thickness direction with respect to the sum of the number of silicon atoms and the number of the hydrogen atoms in the photoconductive layer.
Figure 2F:
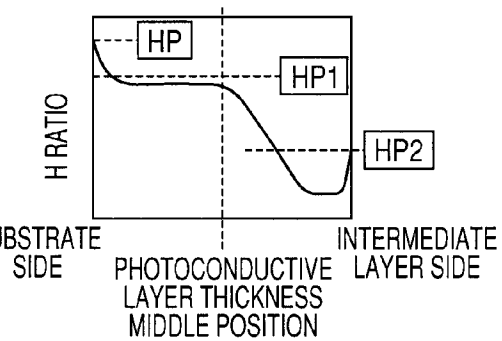
FIG. 2F is a view for describing the ratio of the number of hydrogen atoms in a photoconductive layer in the layer thickness direction with respect to the sum of the number of silicon atoms and the number of the hydrogen atoms in the photoconductive layer.

FIGS. 2A, 2B, 2C, 2D, 2E and 2F also illustrate the distribution of the H/(Si+H) in the a-Si photoconductive layer in the layer thickness direction in a similar way to FIG. 7. As is illustrated in FIG. 2A, when the distribution of the H/(Si+H) in the a-Si photoconductive layer in the layer thickness direction is uniform, the $H_{P1}$, $H_{P2}$ and $H_{Pmax}$ result in being the same value. As is illustrated in FIG. 2B, when the H/(Si+H) in the distribution in the layer thickness direction linearly decreases toward the a-SiC intermediate layer side from the substrate side, the $H_{P1}$ and the $H_{P2}$ become the average values of the H/(Si+H) respectively in the first photoconductive region and the second photoconductive region, and the $H_{Pmax}$ becomes the value of the H/(Si+H) in the a-Si photoconductive layer on the closest side to the substrate. As is illustrated in FIG. 2C, when the distribution of the H/(Si+H) in the a-Si photoconductive layer in the layer thickness direction is opposite to that in FIG. 2B, the method for calculating the $H_{P1}$ and $H_{P2}$ is similar to that in FIG. 2B, and the $H_{Pmax}$ becomes the value of the H/(Si+H) in the a-Si photoconductive layer on the closest side to the a-SiC intermediate layer. Methods for calculating the $H_{P1}$ and $H_{P2}$ in FIGS. 2D, 2E and 2F are also similar to that in FIG. 2B. However, the $H_{Pmax}$ becomes the value of H/(Si+H) in a region existing in the a-Si photoconductive layer on the substrate side, in which H/(Si+H) is uniform in FIG. 2D, becomes the same value as $H_{P1}$ in FIG. 2E, and becomes the value of the H/(Si+H) in the a-Si photoconductive layer on the closest side to the substrate in FIG. 2F.

In the above description, the $H_{P2}$ is the average value of the H/(Si+H) in the second photoconductive region. The reason why an important parameter for reducing the layer exfoliation in the vicinity of the interface between the a-Si photoconductive layer and the a-SiC intermediate layer is not the maximal value or not the minimal value of H/(Si+H) but the average value is assumed to be because of the following reason. Firstly, the layer exfoliation in the vicinity of the interface between the a-Si photoconductive layer and the a-SiC intermediate layer occurs due to a phenomenon that a high stress coming from the a-SiC surface layer concentrates on the vicinity of the interface. The reason why this layer exfoliation occurs is considered to be because even though the a-SiC intermediate layer is provided between the a-Si photoconductive layer and the a-SiC surface layer, the whole a-SiC intermediate layer does not sufficiently absorb the high stress receiving from the a-SiC surface layer. Accordingly, in order to reduce the above described layer exfoliation, it becomes necessary for a region of the a-Si photoconductive layer on the a-SiC intermediate layer side, which comes in contact with the a-SiC intermediate layer, to absorb the stress receiving from the a-SiC surface layer, which has not been absorbed in the a-SiC intermediate layer, and thereby to alleviate the stress receiving from the a-SiC surface layer. From the above description, in order to reduce the above described layer exfoliation, it becomes necessary to control the H/(Si+H) in the a-Si photoconductive layer on the a-SiC intermediate layer side, which contributes to alleviate the stress receiving from the a-SiC surface layer, in other words, to control the average value of the H/(Si+H) in the second photoconductive region.

Accordingly, the layer exfoliation in the vicinity of the interface between the a-Si intermediate layer and the a-SiC photoconductive layer can be reduced even when a sudden environmental change has occurred, by controlling the $Hp_2$ which contributes to the alleviation of the stress receiving from the a-SiC surface layer, and the $D_S$ which determines the internal stress of the a-SiC surface layer, on the above described satisfaction condition of the a-Si photoconductive layer, the satisfaction condition of the a-SiC intermediate layer and the satisfaction condition of the a-SiC surface layer. As was described above, the electrophotographic photosensitive member makes the a-Si photoconductive layer on the a-SiC intermediate layer side absorb the stress receiving from the a-SiC surface layer, and accordingly can reduce the layer exfoliation in the vicinity of the interface between the a-Si photoconductive layer and the a-SiC intermediate layer, even when H/(Si+H) in one region of the second photoconductive region deviates from the above described expression (1) and the above described expression (2), as long as the average value $H_{P2}$ of the H/(Si+H) in the second photoconductive region satisfies the above described expression (1) and the above described expression (2). Accordingly, even when one part in the second photoconductive region is smaller than a predetermined H/(Si+H) as is illustrated in FIG. 2F, the electrophotographic photosensitive member alleviates the high stress receiving from the a-SiC surface layer, and can reduce the layer exfoliation in the vicinity of the interface between the a-Si photoconductive layer and the a-SiC intermediate layer, as long as the average value of the H/(Si+H) in the whole second photoconductive region satisfies the predetermined value.

In addition, the $H_{Pmax}$ is the maximal value of the H/(Si+H) in the whole a-Si photoconductive layer. The reason why the important parameter for reducing the layer exfoliation due to the fracture of the a-Si photoconductive layer is the maximal value of the H/(Si+H) is assumed to be because of the following reason. As was described above, by enhancing the flexibility of the bond between the silicon atoms by increasing the $H_{P2}$, the second photoconductive region and the a-SiC intermediate layer alleviate the high stress receiving from the a-SiC surface layer, thereby reducing the layer exfoliation in the vicinity of the interface between the a-Si photoconductive layer and the a-SiC intermediate layer.

However, if the H/(Si+H) in the a-Si photoconductive layer is excessively increased, the denseness of a-Si occasionally results in being lowered. If the stress coming from the a-SiC surface layer is applied to such a-Si having the low denseness, a-Si itself is occasionally fractured without being capable of enduring the stress. Accordingly, it is considered that if a region having the low denseness exists in the a-Si photoconductive layer of an electrophotographic photosensitive member in which the layer exfoliation in the vicinity of the interface between the a-Si photoconductive layer and the a-SiC intermediate layer does not occur, a-Si in the region is fractured when having received the stress from the a-SiC surface layer and the layer exfoliation occurs. From the above description, in order to reduce the layer exfoliation caused by the fracture of the a-Si photoconductive layer, it is necessary that the a-Si has a predetermined denseness in the whole a-Si photoconductive layer. Accordingly, it is necessary to control the maximal value $H_{Pmax}$ of the H/(Si+H) in the a-Si photoconductive layer in the layer thickness direction, in H/(Si+H) which determines the denseness of the a-Si photoconductive layer. From the above description, the $H_{P2}$ is the average value of the H/(Si+H) in the second photoconductive region, the $H_{Pmax}$ is the maximal value in the distribution of the H/(Si+H) in the a-Si photoconductive layer in the layer thickness direction, and each of the $H_{P2}$ and the $H_{Pmax}$ becomes physical properties which largely affects the layer exfoliation.

In the present invention, as is illustrated in FIGS. 2B, 2D, 2E and 2F, the $H_{P2}$ can be smaller than the $H_{P1}$, for obtaining adequate characteristics of the electrophotographic photosensitive member. In a-Si, if H/(Si+H) is decreased, defects in a-Si can be reduced, and photocarriers generated by image exposure become difficult to be captured at the defects in the a-Si photoconductive layer. Accordingly, the carriers generated by the image exposure become difficult to be captured at the defects by decreasing H/(Si+H), in other words, by decreasing $H_{P2}$ in the second photoconductive region in which the photocarriers are generated by the image exposure, and an image exposure ghost can be reduced. On the contrary, when H/(Si+H) is increased, an optical band gap is widened, and thereby charging characteristics are enhanced. Accordingly, the charging characteristics are enhanced by controlling the H/(Si+H) in the first photoconductive region which does not contribute to the generation of the photocarrier by the image exposure, in other words, the $H_{P1}$ so as to be larger than the $H_{P2}$, and adequate charging characteristics can be maintained in a high-speed electrophotographic process as well.

In the present invention, the $H_{P1}$ is the average value of the H/(Si+H) in the first photoconductive region, and this $H_{P1}$ is a physical property value which largely affects the charging characteristics. This reason will be described below. As was described above, the change in the charging characteristics of the a-Si photoconductive layer is determined by the change in the optical band gap due to the change in H/(Si+H). Accordingly, because the charging characteristics in the first photoconductive region are determined by the average value of the $H_p$ of the whole first photoconductive region, it becomes necessary to control the average value $H_{P1}$ of the H/(Si+H) in the first photoconductive region. In the present invention, the a-Si photoconductive layer may contain atoms for controlling conductivity, as needed. At this time, the atoms for controlling the conductivity may be contained in the a-Si photoconductive layer in a state of being uniformly distributed, and also there may be a part in which the atoms are contained in a nonuniformly distributed state in the layer thickness direction.

It could be confirmed through the experiment that as long as the content of the atom for controlling the conductivity was 0 atom ppm (which is the case where the a-Si photoconductive layer was formed without substantially using the atom for controlling the conductivity) or more and $1\times10^4$ atom ppm or less with respect to the content of a silicon atom, the atom did not affect relationships of the above described Expression (1) and the above described Expression (2) in the present invention. The atom for controlling the conductivity includes so-called impurities in a semiconductor field. Specifically, the usable atoms include atoms which give p-type conductivity and belong to Group 13 of the Periodic Table (hereinafter referred to as simply "Group 13 atom" as well), or atoms which give n-type conductivity and belong to Group 15 of the Periodic Table (hereinafter referred to as simply "Group 15 atom" as well). The Group 13 atoms specifically include boron (B), aluminum (Al), gallium (Ga), indium (In) and thallium (Tl). Among them, B, Al and Ga can be used. The Group 15 atoms specifically include phosphorus (P), arsenic (As), antimony (Sb) and bismuth (Bi). Among them, P and As can be used.

In the present invention, the layer thickness of the a-Si photoconductive layer can be controlled to 10 μm or more, from the viewpoint of characteristics of the electrophotographic photosensitive member. Furthermore, the layer thickness can be controlled to 40 μm or more. Thereby, the electrophotographic photosensitive member can be produced which has reduced electrostatic capacitance and has adequate charging characteristics even in a high speed electrophotographic process. In the present invention, silanes such as silane ($SiH_4$) and disilane ($Si_2H_6$) can be used as a source gas for supplying silicon atoms. Hydrogen ($H_2$) may also be used together with the above described gas.

The a-Si photoconductive layer can be formed by a method, for instance, such as a plasma CVD method, a vacuum vapor-deposition method, a sputtering method and an ion plating method. Among them, the plasma CVD method can be used because the raw material can be easily obtained. In order to increase the $D_P$ of the a-Si photoconductive layer, the forming conditions of the a-Si photoconductive layer may be set in a direction of reducing an Si-supply source gas to be supplied to a reaction vessel, in a direction of increasing a high-frequency electric power, in a direction of decreasing the pressure in the reaction vessel, and in a direction of increasing a substrate temperature. In addition, in order to increase the H/(Si+H) in the a-Si photoconductive layer, the forming conditions of the a-Si photoconductive layer may be set in a direction of increasing the Si-supply source gas to be supplied to the reaction vessel, in a direction of decreasing the pressure in the reaction vessel, in a direction of decreasing the high-frequency electric power, and in a direction of decreasing the substrate temperature. When the a-Si photoconductive layer is formed, these conditions may be set while being appropriately combined.

(a-SiC Intermediate Layer)

The a-SiC intermediate layer according to the present invention is defined as a region which is determined by boundaries that will be described below. Firstly, a boundary between the a-Si photoconductive layer and the a-SiC intermediate layer is defined as a position at which a carbon atom has been substantially detected in a region of the a-SiC surface layer side from the a-Si photoconductive layer, in the layer thickness direction of the distribution of C/(Si+C). In addition, the boundary between the a-SiC surface layer and the a-SiC intermediate layer is defined as follows. The boundary is a position located in the outermost surface side of the electrophotographic photosensitive member, in positions in which the Si+C atom density is less than $6.60\times10^{22}$ atoms/$cm^3$, in the layer thickness direction from the outermost surface side of an electrophotographic photosensitive member toward the substrate direction of the distribution of the Si+C atom density. The a-SiC intermediate layer according to the present invention includes all layers formed between the a-Si photoconductive layer and the a-SiC surface layer. Accordingly, the a-SiC intermediate layer may include a plurality of layers.

In the present invention, the a-SiC intermediate layer satisfies the above described Expression (1) and the above described Expression (2). The $C_M$ is 0.25 or more and $0.9\times C_S$ or less, the $H_M$ is 0.20 or more and 0.45 or less, and the $D_M$ is less than 6.60. In the above description, the $H_M$ is the H/(Si+H) in the a-SiC intermediate layer, and the $C_M$ is the C/(Si+C) in the a-SiC intermediate layer. More specifically, the $H_M$ is the average value of the distribution of the H/(Si+H) in the layer thickness direction of the a-SiC intermediate layer, and the $C_M$ is the average value of the distribution of the C/(Si+C) in the layer thickness direction of the a-SiC intermediate layer. The reason why the important parameter for obtaining the effect of the present invention is not the maximal value or not the minimal value of H/(Si+H), but the average value of H/(Si+H) is because it is important that the whole a-SiC intermediate layer adsorbs the stress receiving from the a-SiC surface layer, similarly to the case of the above described $H_{P1}$ and $H_{P2}$. The reason why the important parameter for obtaining the effect of the present invention is not the maximal value or not the minimal value of C/(Si+C) but the average value of C/(Si+C) is also because the alleviation capability of the whole a-SiC intermediate layer for the stress receiving from the a-SiC surface layer is important, similarly to the case of the above described $H_M$.

In addition, a pressure scar can be reduced by controlling the Si+C atom density in the a-SiC intermediate layer to 5.50 or more. The a-SiC intermediate layer has a function of enhancing the adhesiveness of the a-SiC surface layer, reducing layer exfoliation, and also protecting the a-Si photoconductive layer from a mechanical stress to prevent the pressure scar, when being combined with the a-SiC surface layer having high density. It is considered that the pressure scar is caused by a mechanical stress which the surface of the electrophotographic photosensitive member receives. However, the scar does not necessarily occur on the surface of the electrophotographic photosensitive member. In addition, the case is also observed in which the pressure scar occasionally disappears when the electrophotographic photosensitive member in which the pressure scar occurred once has been heated, for instance, at 200° C. for 1 hour. For this reason, it is considered that the pressure scar does not occur in the surface itself of the electrophotographic photosensitive member but occurs in the a-Si photoconductive layer when an excessive stress has been applied thereto through the a-SiC surface layer. In the present invention, it is assumed that the a-SiC intermediate layer can more effectively alleviate the mechanical stress applied to the a-SiC surface layer, by making the Si+C atom density in the a-SiC intermediate layer smaller than that in the a-SiC surface layer. In order to obtain the above effect, the $D_M$ of the a-SiC intermediate layer of the electrophotographic photosensitive member according to the present invention needs to be made smaller than the $D_S$ of the a-SiC surface layer, but if the $D_M$ becomes excessively small, an effect of preventing pressure scar decreases. Accordingly, in the present invention, the range of the $D_M$ of the a-SiC intermediate layer can be controlled to 5.50 or more with respect to the above described range of the $D_S$ of the a-SiC surface layer, in which the effect has been confirmed.

In addition, according to the investigation of the present inventors, as for an influence of the a-SiC intermediate layer on the light transmittance, the $C_M$ and $D_M$ are dominant, and the dependency on the $H_M$ was not almost seen. This is considered to be because the Si+C atom density is smaller in the a-SiC intermediate layer than in the a-SiC surface layer, and accordingly, the dependency of the light transmittance on H/(Si+C+H) is small. In the present invention, the a-SiC intermediate layer can be formed by adopting the same method as that adopted when forming the above described a-SiC surface layer, and the layer-forming condition (layer-forming condition) may be set through appropriate adjustment.

(a-SiC Surface Layer)

In the present invention, an a-SiC surface layer satisfies the above described Expression (1) and the above described Expression (2). The $C_S$ is 0.61 or more and 0.75 or less, the $H_S$ is 0.20 or more and 0.45 or less, and the layer thickness is 0.2 μm or more and 3.0 μm or less. In the above described range of the $C_S$ and the $H_S$ of the a-SiC surface layer, it is assumed that as the layer thickness of the a-SiC surface layer increases, the internal stress of the a-SiC surface layer increases. However, it could be confirmed that when the layer thickness of the a-SiC surface layer was in the range of 0.2 μm or more and 3.0 μm or less, the above described two layer exfoliations did not occur as long as the a-SiC surface layer satisfied the above described Expression (1) and the above described Expression (2). When the layer thickness of the a-SiC surface layer becomes excessively thin, it is occasionally difficult to sufficiently secure the abrasion amount of the a-SiC surface layer in the electrophotographic process, so the layer thickness shall be controlled to 0.2 μm or more.

In the above description, the $H_S$ is the H/(Si+C+H) in the a-SiC surface layer, and the $C_S$ is the C/(Si+C) in the a-SiC surface layer. More specifically, the $H_S$ is the average value of the distribution of the H/(Si+C+H) in the layer thickness direction of the a-SiC surface layer, and the $C_S$ is the average value of the distribution of the C/(Si+C) in the layer thickness direction of the a-SiC surface layer. The reason why the values are not the maximal value or not the minimal value but the average value is because the stress occurring in the a-SiC surface layer is determined by the influence of the whole a-SiC surface layer. The electrophotographic photosensitive member according to the present invention can further enhance its light sensitivity while maintaining the high-humidity deletion and the abrasion resistance, by setting the $H_S$ at 0.30 or more. This reason is because the optical band gap is widened by setting the $H_S$ at 0.30 or more in the a-SiC surface layer. Thereby, the light sensitivity can be enhanced. Accordingly, in the present invention, the $H_S$ can be further controlled to 0.30 or more, in the above described range of the $H_S$.

The a-SiC surface layer of the present invention can be formed with a method such as a plasma CVD method, a vacuum vapor-deposition method, a sputtering method, and an ion plating method, for instance. Among them, the plasma CVD method can be used because the raw material can be easily obtained. When the plasma CVD method is selected as the method for forming the a-SiC surface layer, the method for forming the a-SiC surface layer is as follows. A source gas for supplying silicon atom and a source gas for supplying carbon atom are introduced into a reaction vessel which can decompress the inner part, in a desired gas state, and glow discharge is generated in the reaction vessel. A layer formed from a-SiC may be formed by decomposing thus introduced source gas.

In the present invention, silanes such as silane ($SiH_4$) and disilane ($Si_2H_6$) can be used as a source gas for supplying the silicon atom. In addition, hydrocarbon gases such as methane ($CH_4$) and acetylene ($C_2H_2$) can be used as a source gas for supplying the carbon atom. In addition, hydrogen ($H_2$) may be used together with the above described gases for the purpose of adjusting H/(Si+C+H). In order to increase the $D_S$ of the a-SiC surface layer, the forming conditions of the a-SiC surface layer may be set in a direction of decreasing the flow rate of all the source gases to be supplied to the reaction vessel, in a direction of increasing a high-frequency electric power, in a direction of increasing the pressure in the reaction vessel, and in a direction of increasing a substrate temperature. In addition, in order to increase the $C_S$ of the a-SiC surface layer, the forming conditions of the a-SiC surface layer may be set in a direction of decreasing the flow rate of all the source gases to be supplied to the reaction vessel, in a direction of decreasing the source gas for supplying the silicon atom, in a direction of increasing the source gas for supplying the carbon atom, and in a direction of increasing the high-frequency electric power. Furthermore, in order to decrease the $H_S$ of the a-SiC surface layer, the forming conditions of the a-SiC surface layer may be set in a direction of decreasing the flow rate of all the source gases to be supplied to the reaction vessel, in a direction of decreasing the source gas for supplying the silicon atom, in a direction of decreasing the source gas for supplying the carbon atom, and in a direction of increasing the high-frequency electric power. When the a-SiC surface layer is formed, these conditions may be set while being appropriately combined.

(Charge Injection Inhibition Layer and Adhesive Layer)

According to the present invention, as is illustrated in FIG. 1A, a charge injection inhibition layer 1005 which is formed from a-Si and contains at least one kind of atom among carbon atom (C), nitrogen atom (N) and oxygen atom (O) can be provided between the substrate 1001 and the a-Si photoconductive layer 1004. Thereby, the layer exfoliation originating from a member in a manufacturing apparatus during the manufacture of the electrophotographic photosensitive member 1000 can be reduced, and image defects can be reduced. At least one atom among C, N and O contained in the charge injection inhibition layer 1005 may be contained therein in a state of being uniformly distributed, or alternatively there may be a portion in which the atoms are contained in a state of being nonuniformly distributed in the layer thickness direction.

The layer thickness of the charge injection inhibition layer 1005 can be 0.1 μm to 10 μm, particularly can be 0.3 μm to 5 μm, and further particularly can be 0.5 μm to 3 μm, from the viewpoints of electrophotographic characteristics, an economical effect and the like. A so-called changing layer which continuously bridges its composition from one layer to the other layer may be provided between the charge injection inhibition layer 1005 and the a-Si photoconductive layer 1004, as needed. In the present invention, in order to further reduce the layer exfoliation originating from the member in the manufacturing apparatus of the electrophotographic photosensitive member 1000 and further reduce the image defects, an adhesive layer 1006 formed from hydrogenated amorphous silicon nitride (hereinafter referred to as "a-SiN" as well) can be formed between the substrate 1001 and the charge injection inhibition layer 1005, as is illustrated FIG. 1B. In addition, in the case of a layer structure in which the charge injection inhibition layer 1005 is not provided, the adhesive layer 1006 formed from the a-SiN may be formed between the substrate 1001 and the photoconductive layer 1004.

(Substrate)

A usable material for the substrate can include, for instance, copper, aluminum, nickel, cobalt, iron, chromium, molybdenum, titanium, and alloys of these elements. Among them, aluminum can be used from the viewpoints of workability and a manufacturing cost. When aluminum is employed, Al—Mg-based alloy or Al—Mn-based alloy can be used. Next, a procedure of manufacturing the electrophotographic photosensitive member according to the present invention will be described in detail below with reference to the drawings, while the case of manufacturing the member with a plasma CVD method will be taken as an example.

Figure 3:
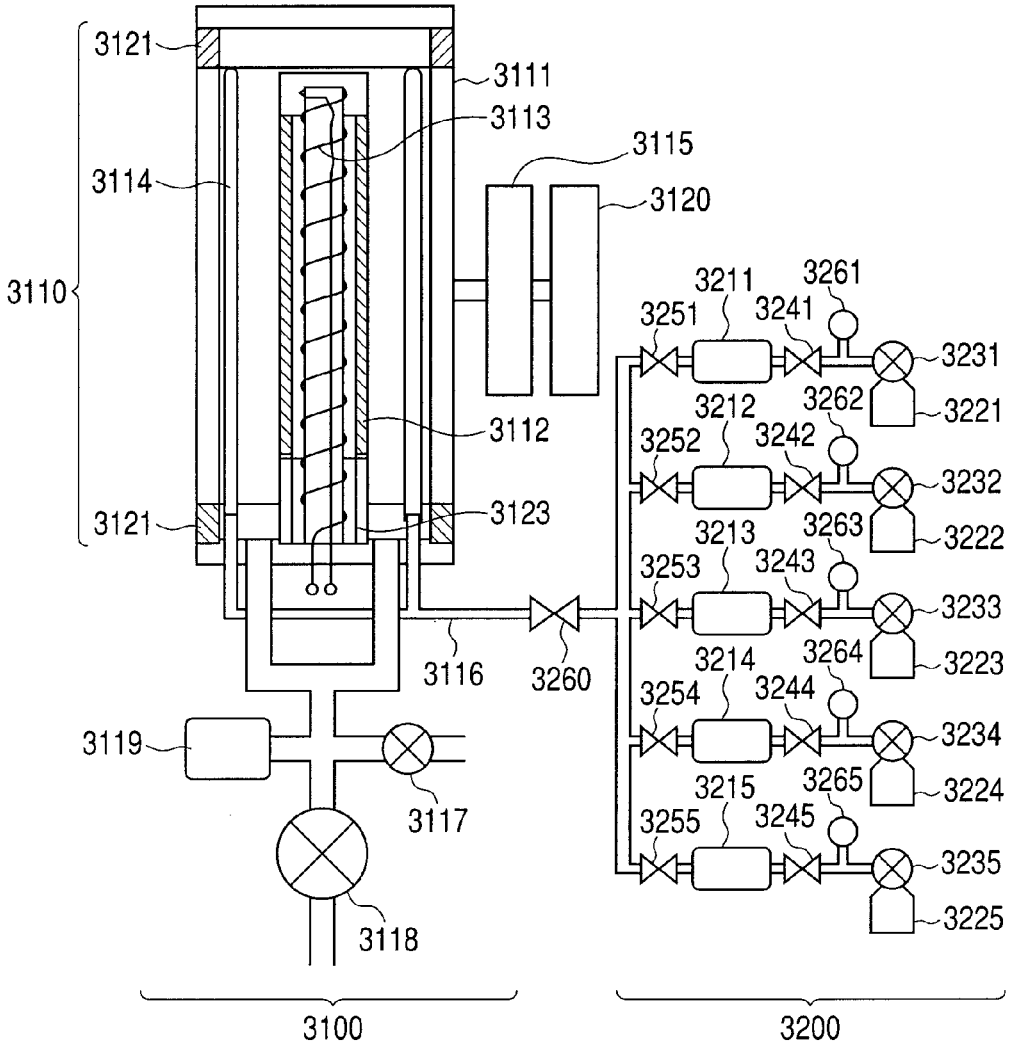
FIG. 3 is a view illustrating an example of a plasma CVD apparatus to be used in the production of an electrophotographic photosensitive member according to the present invention.

FIG. 3 is a block diagram schematically illustrating one example of an apparatus for manufacturing the electrophotographic photosensitive member with a high-frequency plasma CVD method which uses an RF band as a frequency of a power source. This manufacturing apparatus is constituted, roughly being classified, by an apparatus 3100 for forming a deposited layer, a source gas supply device 3200, and an exhaust device (not shown) for decompressing the inner part of the reaction vessel 3110. The apparatus 3100 for forming the deposited layer includes an insulator 3121 and a cathode 3111, and a high-frequency power source 3120 is connected to the cathode 3111 through a high-frequency matching box 3115. In addition, the reaction vessel 3110 has a mounting table 3123 which mounts a cylindrical substrate 3112 thereon, a heater 3113 for heating a substrate and a source gas introduction pipe 3114 all installed therein. The reaction vessel 3110 is connected to the exhaust device (not shown) through an exhaust valve 3118, and can be evacuated. The source gas supply device 3200 includes bombs 3221, 3222, 3223, 3224 and 3225 of source gases, valves 3231, 3232, 3233, 3234 and 3235, valves 3241, 3242, 3243, 3244 and 3245, valves 3251, 3252, 3253, 3254 and 3255, pressure adjuster 3261, 3262, 3263, 3264 and 3265, and massflow controllers 3211, 3212, 3213, 3214 and 3215. The bombs of each source gas are connected to the gas introduction pipe 3114 in the reaction vessel 3110 through a valve 3260 and gas pipe 3116.

The deposited layer is formed with the use of this manufacturing apparatus, for instance, in the following procedure. Firstly, the substrate 3112 is set in the reaction vessel 3110, and the inner part of the reaction vessel 3110 is exhausted, for instance, by the exhaust device (not shown) such as a vacuum pump. Subsequently, the temperature of the substrate 3112 is controlled to a predetermined temperature of 200° C. to 350° C. by the heater 3113 for heating the substrate. Next, the source gas for forming the deposited layer is introduced into the reaction vessel 3110 from the gas supply device 3200 which controls the flow rate as well. Then, the operator sets the pressure in the reaction vessel at a predetermined pressure by operating an exhaust valve 3118 while checking the display of a vacuum gage 3119. After the preparation for deposition has been completed in the above described way, each layer is formed according to the following procedure.

When the pressure has become stable, the high-frequency power source 3120 is controlled to a desired electric power, a high-frequency electric power is supplied to the cathode 3111 through the high-frequency matching box 3115, and a high-frequency glow discharge is generated. This discharge energy decomposes each of the source gases which have been introduced into the reaction vessel 3110, and makes a deposited layer formed on the substrate 3112, which contains predetermined silicon atoms as a main component. After a layer with desired thickness has been formed, the supply of the high-frequency electric power is stopped, each valve of the gas supply device 3200 is closed to stop the inflow of each source gas into the reaction vessel 3110, and the formation of the deposited layer is finished. An electrophotographic photosensitive member having a desired multilayer structure is manufactured by repeating the similar operation a plurality of times while changing conditions such as the flow rate of the source gas, the pressure and the high-frequency electric power. At this time, it is effective to rotate the substrate 3112 with a driving device (not-shown) at a predetermined speed while the layer is formed, so as to form a uniform deposited layer. After the formation of all layers has been finished, a leak valve 3117 is opened, the pressure of the inside of the reaction vessel 3110 is returned to atmospheric pressure, and the substrate 3112 is taken out.

How to form images by means of an electrophotographic apparatus making use of the a-Si electrophotographic photosensitive member is described with reference to FIG. 4.

First, an electrophotographic photosensitive member 4001 is rotated so as to make the surface of the electrophotographic photosensitive member 4001 more uniformly charged with a primary charger 4002. Thereafter, the surface of the electrophotographic photosensitive member 4001 is exposed to imagewise exposure light by an electrostatic latent image forming means (imagewise exposure means) 4006 to form an electrostatic latent image on the surface of the electrophotographic photosensitive member 4001, which latent image is thereafter developed with a toner fed by a developing assembly 4012. As the result, a toner image is formed on the surface of the electrophotographic photosensitive member 4001. Then, this toner image is transferred to a transfer material 4010 by means of a transfer charger 4004, and this transfer material 4010 is separated from the electrophotographic photosensitive member 4001 by means of a separation charger 4005, after which the toner image is fixed to the transfer material 4010 by a fixing means (not shown).

Meanwhile, the toner remaining on the surface of the electrophotographic photosensitive member 4001 from which the toner image has been transferred to the transfer material 4010 is removed with a cleaner 4009, and thereafter the surface of the electrophotographic photosensitive member 4001 is exposed to light to eliminate any residual carriers coming during the formation of the electrostatic latent image on the electrophotographic photosensitive member 4001.

A series of the above process is repeated to form images continuously. Reference numeral 4003 denotes a charge eliminator; 4007, a magnet roller; 4008, a cleaning blade; and 4011, a transport means.

EXAMPLES

The present invention will now be described further in detail below with reference to examples and comparative examples, but is not limited by those.

Experimental Example 1

A sample of the electrophotographic photosensitive member was produced by forming each layer on a cylindrical substrate (cylindrical substrate made from aluminum, which had a diameter of 80 mm, a length of 358 mm and a thickness of 3 mm, and was mirror-finished) by using a plasma treatment apparatus with the use of a high-frequency power source illustrated in FIG. 3, which uses an RF band. The forming conditions of a charge injection inhibition layer at this time are shown in the following Table 1, the forming conditions of a photoconductive layer are shown in the following Table 2, the forming conditions of an intermediate layer are shown in the following Table 3, the forming conditions of a surface layer are shown in the following Table 4, and the stacking conditions in the samples of the produced electrophotographic photosensitive member are shown in the following Table 5. As for the layer structures of the electrophotographic photosensitive members shown in the following table 5, each layer was formed by changing a high-frequency electric power, an $SiH_4$ flow rate, a $CH_4$ flow rate, and an internal pressure so that thicknesses of layers between the charge injection inhibition layer and the photoconductive layer, between the photoconductive layer and the intermediate layer and between the intermediate layer and the surface layer became substantially 0 μm. Furthermore, the layer-forming condition No. P12 of the photoconductive layer shown in Table 2 was formed by using the high-frequency power source with the frequency of 40 MHz, and the layer-forming condition No. P13 of the photoconductive layer was formed by using the high-frequency power source with the frequency of 400 kHz. In the production of the sample of the electrophotographic photosensitive member, the charge injection inhibition layer was prepared by using the high-frequency power source with the RF band, and then the photoconductive layer was formed after having switched the high-frequency power source.

TABLE 1

| | Charge injection inhibition layer |
|---|---|
| $SiH_4$ [mL/min (normal)] | 350 |
| $H_2$ [mL/min (normal)] | 750 |
| $B_2H_6$ [ppm] (with respect to $SiH_4$) | 1500 |
| NO [mL/min (normal)] | 10 |
| High-frequency electric power (W) | 400 |
| Internal pressure (Pa) | 80 |
| Substrate temperature (° C.) | 260 |
| Layer thickness | 3 |

TABLE 2

| | Layer-forming condition No. of photoconductive layer | | | | | | | |
|---|---|---|---|---|---|---|---|---|
| | P1 | P2 | P3 | P4 | P5 | P6 | P7 | P8 |
| $SiH_4$ [mL/min (normal)] | 50 | 75 | 100 | 100 | 200 | 400 | 400 | 550 |
| $H_2$ [mL/min (normal)] | 2300 | 2150 | 2300 | 2150 | 2150 | 2150 | 2150 | 2150 |
| B [ppm] (with respect to Si) | 0.5 | 0.5 | 0.5 | 0.5 | 0.5 | 0.5 | 0.5 | 0.5 |
| High-frequency electric power (W) | 1600 | 1050 | 1800 | 1050 | 1050 | 1050 | 900 | 1050 |

TABLE 2-continued

| | | | | | | | | |
|---|---|---|---|---|---|---|---|---|
| Internal pressure (Pa) | 80 | 80 | 80 | 80 | 80 | 80 | 80 | 80 |
| Substrate temperature (° C.) | 330 | 330 | 270 | 290 | 270 | 275 | 255 | 300 |

| | Layer-forming condition No. of photoconductive layer | | | | | | |
|---|---|---|---|---|---|---|---|
| | P9 | P10 | P11 | P12 | P13 | P14 | P15 |
| $SiH_4$ [mL/min (normal)] | 450 | 600 | 600 | 100 | 300 | 100 | 100 |
| $H_2$ [mL/min (normal)] | 2150 | 2150 | 2150 | 2300 | 2150 | 2300 | 2300 |
| B [ppm] (with respect to Si) | 0.5 | 0.5 | 0.5 | 0.5 | 0.5 | 0 | 1.0 |
| High-frequency electric power (W) | 1050 | 1050 | 1050 | 1700 | 1050 | 1800 | 1800 |
| Internal pressure (Pa) | 80 | 80 | 80 | 80 | 80 | 80 | 80 |
| Substrate temperature (° C.) | 220 | 260 | 245 | 320 | 295 | 270 | 270 |

TABLE 3

| | Layer-forming condition No. of intermediate layer | | | | | | | | |
|---|---|---|---|---|---|---|---|---|---|
| | M1 | M2 | M3 | M4 | M5 | M6 | M7 | M8 | M9 |
| $SiH_4$ [mL/min (normal)] | 26 | 90 | 26 | 26 | 26 | 300→26 | 26 | 26 | 26 |
| $CH_4$ [mL/min (normal)] | 190 | 370 | 600 | 260 | 190 | 0→500 | 600 | 500 | 400 |
| $H_2$ [mL/min (normal)] | — | — | — | 50 | — | — | — | — | — |
| High-frequency electric power (W) | 200 | 400 | 500 | 250 | 250 | 400→700 | 350 | 350 | 400 |
| Internal pressure (Pa) | 45 | 55 | 35 | 20 | 75 | 55 | 55 | 55 | 60 |
| Substrate temperature (° C.) | 290 | 260 | 290 | 290 | 260 | 290 | 290 | 290 | 290 |

In addition, arrows in the layer-forming condition No. M6 of the intermediate layer show that the intermediate layer was formed by linearly changing the $SiH_4$ flow rate, the $CH_4$ flow rate and the high-frequency electric power, toward the right condition from the left condition.

TABLE 4

| | Layer-forming condition No. of surface layer | | | | | | | | | | |
|---|---|---|---|---|---|---|---|---|---|---|---|
| | S1 | S2 | S3 | S4 | S5 | S6 | S7 | S8 | S9 | S10 | S11 |
| $SiH_4$ [mL/min (normal)] | 26 | 26 | 26 | 26 | 26 | 26 | 26 | 26 | 26 | 26 | 26 |
| $CH_4$ [mL/min (normal)] | 500 | 400 | 360 | 500 | 1400 | 600 | 500 | 360 | 190 | 100 | 230 |
| $H_2$ [mL/min (normal)] | — | — | — | — | — | — | — | — | — | — | — |
| High-frequency electric power (W) | 800 | 750 | 700 | 750 | 400 | 900 | 850 | 900 | 1250 | 1250 | 400 |
| Internal pressure (Pa) | 80 | 80 | 80 | 80 | 55 | 46 | 60 | 80 | 120 | 150 | 80 |
| Substrate temperature (° C.) | 290 | 290 | 290 | 290 | 290 | 290 | 290 | 290 | 290 | 290 | 290 |

| | Layer-forming condition No. of surface layer | | | | | | | | |
|---|---|---|---|---|---|---|---|---|---|
| | S12 | S13 | S14 | S15 | S16 | S17 | S18 | S19 | S20 |
| $SiH_4$ [mL/min (normal)] | 26 | 26 | 26 | 26 | 26 | 26 | 26 | 26 | 26 |
| $CH_4$ [mL/min (normal)] | 500 | 700 | 260 | 190 | 190 | 260 | 360 | 360 | 320 |
| $H_2$ [mL/min (normal)] | — | 150 | — | — | — | — | — | — | — |
| High-frequency electric power (W) | 780 | 1000 | 850 | 750 | 700 | 750 | 650 | 600 | 550 |
| Internal pressure (Pa) | 90 | 30 | 80 | 80 | 80 | 80 | 80 | 80 | 80 |
| Substrate temperature (° C.) | 290 | 310 | 290 | 290 | 290 | 290 | 290 | 290 | 290 |

TABLE 5

| Sample condition No. | Charge injection inhibition layer | Photoconductive layer | Intermediate layer | Surface layer |
|---|---|---|---|---|
| SA 1 | Table 1 | P1 | — | — |
| SA 2 | Table 1 | P2 | — | — |
| SA 3 | Table 1 | P3 | — | — |
| SA 4 | Table 1 | P4 | — | — |
| SA 5 | Table 1 | P5 | — | — |
| SA 6 | Table 1 | P6 | — | — |
| SA 7 | Table 1 | P7 | — | — |
| SA 8 | Table 1 | P8 | — | — |
| SA 9 | Table 1 | P9 | — | — |
| SA 10 | Table 1 | P10 | — | — |
| SA 11 | Table 1 | P11 | — | — |
| SA 12 | Table 1 | P12 | — | — |
| SA 13 | Table 1 | P13 | — | — |
| SA 14 | Table 1 | P14 | — | — |
| SA 15 | Table 1 | P15 | — | — |
| SA 16 | Table 1 | P5 | M1 | — |
| SA 17 | Table 1 | P5 | M2 | — |
| SA 18 | Table 1 | P5 | M3 | — |
| SA 19 | Table 1 | P5 | M4 | — |
| SA 20 | Table 1 | P5 | M5 | — |
| SA 21 | Table 1 | P5 | M6 | — |
| SA 22 | Table 1 | P5 | M7 | — |
| SA 23 | Table 1 | P5 | M8 | — |
| SA 24 | Table 1 | P5 | M9 | — |
| SA 25 | Table 1 | P5 | M1 | S1 |
| SA 26 | Table 1 | P5 | M1 | S2 |
| SA 27 | Table 1 | P5 | M1 | S3 |
| SA 28 | Table 1 | P5 | M1 | S4 |
| SA 29 | Table 1 | P5 | M1 | S5 |
| SA 30 | Table 1 | P5 | M1 | S6 |
| SA 31 | Table 1 | P5 | M1 | S7 |
| SA 32 | Table 1 | P5 | M1 | S8 |
| SA 33 | Table 1 | P5 | M1 | S9 |
| SA 34 | Table 1 | P5 | M1 | S10 |
| SA 35 | Table 1 | P5 | M1 | S11 |
| SA 36 | Table 1 | P5 | M1 | S12 |
| SA 37 | Table 1 | P5 | M1 | S13 |
| SA 38 | Table 1 | P5 | M1 | S14 |
| SA 39 | Table 1 | P5 | M1 | S15 |
| SA 40 | Table 1 | P5 | M1 | S16 |
| SA 41 | Table 1 | P5 | M1 | S17 |
| SA 42 | Table 1 | P5 | M1 | S18 |
| SA 43 | Table 1 | P5 | M1 | S19 |
| SA 44 | Table 1 | P5 | M1 | S20 |

In addition, when only the charge injection inhibition layer and the photoconductive layer were stacked, the layer thickness of the photoconductive layer was controlled to 0.3 μm, and when the intermediate layer was further stacked on the photoconductive layer, the layer thickness was controlled to 40 μm. When only the charge injection inhibition layer, the photoconductive layer and the intermediate layer were stacked, the layer thickness of the intermediate layer was controlled to 0.3 μm, and when the surface layer was further stacked thereon, the layer thickness was controlled to 0.5 μm. The layer thickness of the surface layer was controlled to 0.3 μm. The Si atom density, the H atom density and the H/(Si+H) in the photoconductive layer were measured with an analysis method which will be described later, on sample conditions No. SA 1 to SA 15 which had been produced in Experimental Example 1. In addition, the C/(Si+C), the H/(Si+C+H) and the Si+C atom density in the intermediate layer were measured with the analysis method which will be described later, on sample conditions No. SA 16 to SA 24 which had been produced in Experimental Example 1. Furthermore, the C/(Si+C), the H/(Si+C+H) and the Si+C atom density in the surface layer were measured with the analysis method which will be described later, on sample conditions No. SA 25 to SA 44 which had been produced in Experimental Example 1. These results are shown in Table 6.

(Measurement of H/(Si+H), C/(Si+C) and H/(Si+C+H))

Samples for measurement were prepared by cutting out the central portion in the longitudinal direction at an arbitrary point in a circumferential direction of the samples of the electrophotographic photosensitive member, which had been produced on the sample conditions No. SA 1 to SA 15 in Experimental Example 1, into a square with 15 mm square. The samples for measurement were subjected to the analysis by RBS (Rutherford Backscattering Spectrometry) (made by NHV Corporation: backward-scattering measurement apparatus AN-2500), and the number of silicon atoms in the photoconductive layer in the depth direction in the measurement area of RBS was measured. Simultaneously with the analysis by RBS, the above described samples for measurement were subjected to the analysis by HFS (Hydrogen Forward Spectrometry) (made by NHV Corporation: back-scattering measurement apparatus AN-2500), and the number of the hydrogen atoms in the depth direction in the measurement area of HFS was measured.

Then, the H/(Si+H) in the photoconductive layer was determined by using the number of the silicon atoms which had been determined from the measurement area of RBS, and the number of the hydrogen atoms which had been determined from the measurement area of HFS. The H/(Si+C+H) in the intermediate layers was determined from the electrophotographic photosensitive members which had been produced on the sample conditions No. SA 16 to SA 24 in Experimental Example 1, in a similar way to the method for calculating the H/(Si+H) in the photoconductive layer. In addition, in order to calculate the H/(Si+C+H) in the intermediate layer, the number of the silicon atoms and the number of the carbon atoms in the intermediate layer in the depth direction in the measurement area were measured with RBS. Then, the H/(Si+C+H) in the intermediate layer was calculated by using the number of the silicon atoms and the number of the carbon atoms which had been determined from the measurement area of RBS, and the number of the hydrogen atoms which had been determined from the measurement area of HFS. In addition, the C/(Si+C) in the intermediate layer was calculated by using the number of the silicon atoms and the number of the carbon atoms which had been determined from the measurement area of RBS, which had been obtained from the measurement with RBS for the number of the silicon atoms and the number of the carbon atoms in the intermediate layer in the depth direction in the measurement area.

Furthermore, the C/(Si+C) and the H/(Si+C+H) in the surface layer were determined from the samples of the electrophotographic photosensitive member, which had been produced on the sample conditions No. SA 25 to SA 44 in Experimental Example 1, in a similar way to the calculation for the C/(Si+C) and the H/(Si+C+H) in the intermediate layer. In addition, as for a specific measurement condition of RBS and HFS, incident ion was set at 4 He+, incident energy was set at 2.3 MeV, an incident angle was set at 75 degrees, sample current was set at 35 nA, and incident beam diameter was set at 1 mm. In the detector of RBS, a scatter angle was set at 160 degrees, and aperture diameter was set at 8 mm. In the detector of HFS, a recoil angle was set at 30 degrees, and aperture diameter was set at 8 mm+Slit, in measurement.

(Layer Thickness Measurement)

The samples for measurement, which had been used for the measurement of H/(Si+H), the measurement of C/(Si+C), and the measurement of H/(Si+C+H), were cut out into a size with a length of 3 mm, a width of 3 mm and a height of 1 mm. These cut out samples for measurement were processed with FIB (made by Hitachi High-Technologies Corporation: FB-2100) into a thin piece with a width of 20 μm to 30 μm, a thickness of 0.05 μm to 0.15 μm and a depth (layer thickness direction) of 45 μm to 50 μm. Subsequently, this samples for the measurement, which had been processed into the thin piece, were observed with a TEM (Transmission Electron Microscope) (made by Hitachi High-Technologies Corporation: H-7500 type) from a direction perpendicular to the layer thickness direction. From the obtained transmission images, the layer thicknesses of the photoconductive layers were calculated on the sample conditions No. SA 1 to SA 15 in Experimental Example 1, the layer thicknesses of the intermediate layers were calculated on the sample conditions No. SA 16 to SA 24 in Experimental Example 1, and the layer thicknesses of the surface layers were calculated on the sample conditions No. SA 25 to SA 44 in Experimental Example 1.

(Calculation of Si+C Atom Density, Si Atom Density, C Atom Density and H Atom Density)

The Si+C atom density, the Si atom density, the C atom density and the H atom density were determined by using the number of silicon atoms, the number of carbon atoms and the number of hydrogen atoms, which was determined from the above described measurement area of HFS or RBS, and the layer thickness of the photoconductive layer, the intermediate layer and the surface layer which had been determined from the above described layer thickness measurement.

The layer thickness of the surface layer was measured with spectroscopic ellipsometry. As a result, it could be confirmed that the value was the same as that of the layer thickness of the surface layer calculated by using the FIB and the TEM.

The layer thickness of the surface layer measured by spectroscopic ellipsometry is defined as follows. First, a reference electrophotographic photosensitive member was produced in which only the charge injection inhibition layer and photoconductive layer were formed. Then, this was cut out in a square shape of 15 mm square at a middle portion thereof in its lengthwise direction at its arbitrary position in peripheral direction to prepare a reference sample. Next, the electrophotographic photosensitive member in which the charge injection inhibition layer, the photoconductive layer and the surface layer were formed was likewise cut out to prepare a sample for measurement. The reference sample and the sample for measurement were measured by spectroscopic ellipsometry (using a high-speed spectroscopic ellipsometer M-2000, manufactured by J.A. Woollam Co., Inc.) to determine the layer thickness of the surface layer. Specific conditions for the measurement by spectroscopic ellipsometry are incident angles: 60°, 65° and 70°; measurement wavelength: 195 nm to 700 nm; and beam diameter: 1 mm×2 mm. First,

TABLE 6

| | Photoconductive layer | | | Intermediate layer | | | Surface layer | | |
|---|---|---|---|---|---|---|---|---|---|
| Sample condition No. | Si atom density ($10^{22}$ atoms/cm$^3$) | H atom density ($10^{22}$ atoms/cm$^3$) | H/(Si + H) | C/(Si + C) | H/(Si + C + H) | Si + C atom density ($10^{22}$ atoms/cm$^3$) | C/(Si + C) | Si + C atom density ($10^{22}$ atoms/cms) | H/(Si + C + H) |
| SA 1 | 4.69 | 0.41 | 0.08 | — | — | — | — | — | — |
| SA 2 | 4.68 | 0.50 | 0.10 | — | — | — | — | — | — |
| SA 3 | 4.67 | 0.65 | 0.12 | — | — | — | — | — | — |
| SA 4 | 4.64 | 0.72 | 0.13 | — | — | — | — | — | — |
| SA 5 | 4.58 | 0.91 | 0.17 | — | — | — | — | — | — |
| SA 6 | 4.52 | 1.23 | 0.21 | — | — | — | — | — | — |
| SA 7 | 4.45 | 1.38 | 0.24 | — | — | — | — | — | — |
| SA 8 | 4.43 | 1.52 | 0.26 | — | — | — | — | — | — |
| SA 9 | 4.22 | 1.89 | 0.31 | — | — | — | — | — | — |
| SA 10 | 4.28 | 2.08 | 0.33 | — | — | — | — | — | — |
| SA 11 | 4.22 | 2.22 | 0.34 | — | — | — | — | — | — |
| SA 12 | 4.20 | 0.57 | 0.12 | — | — | — | — | — | — |
| SA 13 | 4.80 | 0.65 | 0.12 | — | — | — | — | — | — |
| SA 14 | 4.67 | 0.65 | 0.12 | — | — | — | — | — | — |
| SA 15 | 4.67 | 0.65 | 0.12 | — | — | — | — | — | — |
| SA 16 | — | — | — | 0.49 | 0.35 | 6.55 | — | — | — |
| SA 17 | — | — | — | 0.25 | 0.31 | 5.96 | — | — | — |
| SA 18 | — | — | — | 0.68 | 0.31 | 5.96 | — | — | — |
| SA 19 | — | — | — | 0.53 | 0.20 | 6.42 | — | — | — |
| SA 20 | — | — | — | 0.53 | 0.45 | 6.42 | — | — | — |
| SA 21 | — | — | — | 0.32 | 0.21 | 5.57 | — | — | — |
| SA 22 | — | — | — | 0.65 | 0.39 | 5.31 | — | — | — |
| SA 23 | — | — | — | 0.64 | 0.39 | 5.50 | — | — | — |
| SA 24 | — | — | — | 0.64 | 0.40 | 5.95 | — | — | — |
| SA 25 | — | — | — | — | — | — | 0.75 | 6.60 | 0.43 |
| SA 26 | — | — | — | — | — | — | 0.73 | 6.81 | 0.41 |
| SA 27 | — | — | — | — | — | — | 0.72 | 6.90 | 0.41 |
| SA 28 | — | — | — | — | — | — | 0.74 | 6.48 | 0.45 |
| SA 29 | — | — | — | — | — | — | 0.70 | 6.35 | 0.39 |
| SA 30 | — | — | — | — | — | — | 0.74 | 6.60 | 0.31 |
| SA 31 | — | — | — | — | — | — | 0.74 | 6.81 | 0.31 |
| SA 32 | — | — | — | — | — | — | 0.74 | 7.25 | 0.33 |
| SA 33 | — | — | — | — | — | — | 0.75 | 8.43 | 0.32 |
| SA 34 | — | — | — | — | — | — | 0.75 | 8.91 | 0.32 |
| SA 35 | — | — | — | — | — | — | 0.61 | 6.60 | 0.45 |
| SA 36 | — | — | — | — | — | — | 0.75 | 6.60 | 0.45 |
| SA 37 | — | — | — | — | — | — | 0.75 | 6.60 | 0.20 |
| SA 38 | — | — | — | — | — | — | 0.71 | 7.56 | 0.29 |
| SA 39 | — | — | — | — | — | — | 0.67 | 7.73 | 0.30 |
| SA 40 | — | — | — | — | — | — | 0.65 | 7.67 | 0.31 |
| SA 41 | — | — | — | — | — | — | 0.70 | 7.43 | 0.33 |
| SA 42 | — | — | — | — | — | — | 0.71 | 6.77 | 0.42 |
| SA 43 | — | — | — | — | — | — | 0.70 | 6.65 | 0.44 |
| SA 44 | — | — | — | — | — | — | 0.68 | 6.68 | 0.45 |

the reference sample was measured by spectroscopic ellipsometry to find the relationship between the wavelength and the amplitude ratio ψ and phase difference Δ at each incident angle. Next, setting as a reference the results of measurement on the reference sample, the sample for measurement was measured in the same way as the reference sample by spectroscopic ellipsometry to determine the relationship between the wavelength and the amplitude ratio ψ and phase difference Δ at each incident angle. Further, a layer structure in which the charge injection inhibition layer, the photoconductive layer and the surface layer were formed in this order and which had a roughness layer where the surface layer and a pneumatic layer were present together at the outermost surface was used as a calculation model, and changing in volume ratio the surface layer and pneumatic layer of the roughness layer, the relationship between the wavelength and the ψ and Δ at each incident angle was found by calculation, using an analytical software. Then, a calculation model was picked out on which the relationship between the wavelength and the ψ and Δ at each incident angle that was found by this calculation and the relationship between the wavelength and the ψ and Δ at each incident angle that was found by measuring the sample for measurement came minimal in their mean square error. The layer thickness of the surface layer was calculated according to the calculation model thus picked out, and the value obtained was taken as the layer thickness of the surface layer. Here, WVASE 32, available from J.A. Woollam Co., Inc., was used as the analytical software. Also, in regard to the volume ratio of the surface layer and pneumatic layer of the roughness layer, surface layer: pneumatic layer, was changed at intervals of 1 from 10:0 to 1:9 to make calculation. In the positive-charging a-Si electrophotographic photosensitive members produced in the present Example under the respective film forming conditions, the relationship between the wavelength and the ψ and Δ that was found by calculation and the relationship between the wavelength and the ψ and Δ that was found by measurement came minimal in their mean square error when the surface layer and the pneumatic layer were 8:2 in their volume ratio.

After the measurement made by spectroscopic ellipsometry was finished, the above sample for measurement was analyzed by RBS (Rutherford Backscattering Spectrometry) (made by NHV Corporation: backward-scattering measurement apparatus AN-2500) to measure the number of atoms of silicon atoms and number of atoms of carbon atoms in the surface layer within the area of measurement by RBS. The C/(Si+C) was found from the number of atoms of silicon atoms and number of atoms of carbon atoms thus measured. Next, for the silicon atoms and carbon atoms determined from the area of measurement by RBS, the Si atom density, the C atom density and the Si+C atom density were determined by using the layer thickness of surface layer that was determined by spectroscopic ellipsometry. Simultaneously with the RBS, the sample for measurement was analyzed by HFS (Hydrogen Forward Spectrometry) (made by NHV Corporation: back-scattering measurement apparatus AN-2500) to measure the number of atoms of hydrogen atoms in the surface layer within the area of measurement by HFS. The H/(Si+C+H) was found according to the number of atoms of hydrogen atoms determined from the area of measurement by HFS and the number of atoms of silicon atoms and number of atoms of carbon atoms determined from the measurement by RBS. Next, for the number of atoms of hydrogen atoms determined from the area of measurement by HFS, the H atom density was determined by using the layer thickness of surface layer that was determined by spectroscopic ellipsometry. Specific conditions for the measurement by RBS and HFS were incident ions: 4 He+, incident energy: 2.3 MeV, incident angle: 75°, sample electric current: 35 nA, and incident beam diameter: 1 mm; as a detector for the RBS, scattering angle: 160°, and aperture diameter: 8 mm; and as a detector for the HFS, recoil angle: 30°, and aperture diameter: 8 mm+Slit; under which the measurement was made.

Examples 1 to 7 and Comparative Examples 1 to 2

Positively chargeable a-Si photosensitive members were produced by forming a charge injection inhibition layer shown in the above described Table 1 on cylindrical substrates, on conditions of the following Tables 7 to 15, in a similar way to those in Experimental Example 1. In addition, two electrophotographic photosensitive members were produced for each layer-forming condition (film forming condition).

TABLE 7

| | Example 1 | | | | | |
|---|---|---|---|---|---|---|
| Layer- | Charge | | Intermediate layer | | Surface layer | |
| forming condition No. | injection inhibition layer | Photoconductive layer | Sample condition No. | Layer thickness (μm) | Sample condition No. | Layer thickness (μm) |
| 1 | Table 1 | P2 | M1 | 0.1 | S7 | 3.0 |
| 2 | Table 1 | P4 | M1 | 0.1 | S7 | 3.0 |
| 3 | Table 1 | P7 | M1 | 0.1 | S7 | 3.0 |
| 4 | Table 1 | P9 | M1 | 0.1 | S7 | 3.0 |
| 5 | Table 1 | P10 | M1 | 0.1 | S7 | 3.0 |

TABLE 8

| | Comparative Example 1 | | | | | |
|---|---|---|---|---|---|---|
| Layer- | Charge | | Intermediate layer | | Surface layer | |
| forming condition No. | injection inhibition layer | Photoconductive layer | Sample condition No. | Layer thickness (μm) | Sample condition No. | Layer thickness (μm) |
| 6 | Table 1 | P1 | M1 | 0.1 | S7 | 3.0 |
| 7 | Table 1 | P11 | M1 | 0.1 | S7 | 3.0 |

TABLE 9

| | Example 2 | | | | | |
|---|---|---|---|---|---|---|
| Layer- | Charge | | Intermediate layer | | Surface layer | |
| forming condition No. | injection inhibition layer | Photoconductive layer | Sample condition No. | Layer thickness (μm) | Sample condition No. | Layer thickness (μm) |
| 8 | Table 1 | P1 | M1 | 0.1 | S6 | 3.0 |
| 9 | Table 1 | P4 | M1 | 0.1 | S8 | 3.0 |
| 10 | Table 1 | P6 | M1 | 0.1 | S9 | 3.0 |
| 11 | Table 1 | P7 | M1 | 0.1 | S10 | 3.0 |

TABLE 10

| | Example 3 | | | | | |
|---|---|---|---|---|---|---|
| Layer- | Charge | | Intermediate layer | | Surface layer | |
| forming condition No. | injection inhibition layer | Photoconductive layer | Sample condition No. | Layer thickness (μm) | Sample condition No. | Layer thickness (μm) |
| 12 | Table 1 | P11 | M1 | 0.1 | S6 | 3.0 |
| 13 | Table 1 | P9 | M1 | 0.1 | S8 | 3.0 |
| 14 | Table 1 | P8 | M1 | 0.1 | S9 | 3.0 |

TABLE 11

| | Example 4 | | | | | |
|---|---|---|---|---|---|---|
| Layer- | Charge | | Intermediate layer | | Surface layer | |
| forming condition No. | injection inhibition layer | Photoconductive layer | Sample condition No. | Layer thickness (μm) | Sample condition No. | Layer thickness (μm) |
| 15 | Table 1 | P8 | M1 | 0.1 | S1 | 3.0 |
| 16 | Table 1 | P8 | M1 | 0.1 | S2 | 3.0 |
| 17 | Table 1 | P8 | M1 | 0.1 | S3 | 3.0 |

TABLE 12

| | Comparative Example 2 | | | | | |
|---|---|---|---|---|---|---|
| Layer- | Charge | | Intermediate layer | | Surface layer | |
| forming condition No. | injection inhibition layer | Photoconductive layer | Sample condition No. | Layer thickness (μm) | Sample condition No. | Layer thickness (μm) |
| 18 | Table 1 | P8 | M1 | 0.1 | S4 | 3.0 |
| 19 | Table 1 | P8 | M1 | 0.1 | S5 | 3.0 |

TABLE 13

| | Example 5 | | | | | |
|---|---|---|---|---|---|---|
| Layer- | Charge | | Intermediate layer | | Surface layer | |
| forming condition No. | injection inhibition layer | Photoconductive layer | Sample condition No. | Layer thickness (μm) | Sample condition No. | Layer thickness (μm) |
| 20 | Table 1 | P3 | M1 | 0.1 | S6 | 3.0 |
| 21 | Table 1 | P5 | M1 | 0.1 | S8 | 3.0 |

TABLE 14

| Layer-forming condition No. | Charge injection inhibition layer | Photoconductive layer | Intermediate layer Sample condition No. | Intermediate layer Layer thickness (μm) | Surface layer Sample condition No. | Surface layer Layer thickness (μm) |
|---|---|---|---|---|---|---|
| | Example 6 | | | | | |
| 22 | Table 1 | P9 | M1 | 0.1 | S6 | 3.0 |

TABLE 15

| Layer-forming condition No. | Charge injection inhibition layer | Photoconductive layer | Intermediate layer Sample condition No. | Intermediate layer Layer thickness (μm) | Surface layer Sample condition No. | Surface layer Layer thickness (μm) |
|---|---|---|---|---|---|---|
| | Example 7 | | | | | |
| 23 | Table 1 | P12 | M1 | 0.1 | S6 | 3.0 |
| 24 | Table 1 | P13 | M1 | 0.1 | S6 | 3.0 |
| 25 | Table 1 | P14 | M1 | 0.1 | S6 | 3.0 |
| 26 | Table 1 | P15 | M1 | 0.5 | S6 | 3.0 |
| 27 | Table 1 | P3 | M1 | 1.0 | S6 | 3.0 |
| 28 | Table 1 | P3 | M2 | 0.1 | S6 | 3.0 |
| 29 | Table 1 | P3 | M3 | 0.1 | S6 | 3.0 |
| 30 | Table 1 | P3 | M4 | 0.1 | S6 | 3.0 |
| 31 | Table 1 | P3 | M5 | 0.1 | S6 | 3.0 |
| 32 | Table 1 | P3 | M6 | 0.1 | S6 | 3.0 |
| 33 | Table 1 | P3 | M1 | 0.1 | S6 | 0.2 |
| 34 | Table 1 | P3 | M1 | 0.1 | S11 | 3.0 |
| 35 | Table 1 | P3 | M1 | 0.1 | S12 | 3.0 |
| 36 | Table 1 | P3 | M1 | 0.1 | S13 | 3.0 |

One electrophotographic photosensitive member for each layer-forming condition out of electrophotographic photosensitive members which had been produced in Examples 1 to 7 and Comparative Examples 1 to 2 was used for the evaluation for the layer exfoliation in an evaluation condition which will be described below. The other one electrophotographic photosensitive member for each layer-forming condition was used for the evaluation for the high-humidity deletion and abrasion resistance carried out in an evaluation condition which will be described below. Those results are shown in Tables 16 to 27. In Example 7 in the above description, the electrophotographic photosensitive members were produced in which the $D_S$ and the H/(Si+H) in the photoconductive layer were controlled to the same values as in the layer-forming condition No. 20, and the $D_P$, a boron amount in the photoconductive layer, the $C_M$, the $H_M$, the layer thicknesses of the intermediate layer, the $C_S$, the $H_S$ and the layer thickness of the surface layer were changed, and each electrophotographic photosensitive member was subjected to the evaluations. The difference of the effect due to the difference of the $D_P$ was confirmed on the electrophotographic photosensitive members for layer-forming conditions No. 23 and 24, and the difference of the effect due to the difference of the boron amount contained in the photoconductive layer was confirmed on the electrophotographic photosensitive members for layer-forming conditions No. 25 and 26.

The difference of the effect due to the difference of the layer thickness of the intermediate layer was confirmed on the electrophotographic photosensitive members for layer-forming conditions No. 20 and 27, the difference of the effect due to the difference of the $C_M$ was confirmed on the electrophotographic photosensitive members for layer-forming conditions No. 28 and 29, and the difference of the effect due to the difference of the $H_M$ was confirmed on the electrophotographic photosensitive members for layer-forming conditions No. 30 and 31. In the electrophotographic photosensitive member for the layer-forming condition No. 32, the $C_M$, the $H_M$ and the $D_M$ were continuously changed. Furthermore, the difference of the effect due to the difference of the layer thickness of the surface layer was confirmed on the electrophotographic photosensitive members for layer-forming conditions No. 20 and 33, the difference of the effect due to the difference of the $C_S$ was confirmed on the electrophotographic photosensitive members for layer-forming conditions No. 34 and 35, and the difference of the effect due to the difference of the $H_S$ was confirmed on the electrophotographic photosensitive members for layer-forming conditions No. 35 and 36. Those results are shown in Table 22.

In addition, in a similar way, the electrophotographic photosensitive members were produced in which the $D_S$ and the H/(Si+H) in the photoconductive layer were controlled to the same values as in the layer-forming condition No. 8, and the $D_P$, a boron amount in the photoconductive layer, the $C_M$, the $H_M$, the layer thicknesses of the intermediate layer, the $C_S$, the $H_S$ and the layer thickness of the surface layer were changed, and each electrophotographic photosensitive member was subjected to the evaluations. The layer-forming conditions of each electrophotographic photosensitive member were determined to be No. 37 to 49, and those evaluation results are shown in Table 23. The electrophotographic photosensitive members were also produced in a similar way, for the cases in which the $D_S$ and the H/(Si+H) in the photoconductive layer were controlled to the same values as in the layer-forming condition No. 11, as in the layer-forming condition No. 12 and as in the layer-forming condition No. 14, and were subjected to the evaluations. The layer-forming conditions of the electrophotographic photosensitive members which were produced by setting the $D_S$ and the H/(Si+H) in the photoconductive layer at the same values as in the layer-forming condition No. 11 were determined to be No. 50 to 62, and those evaluation results are shown in Table 24. The layer-forming conditions of the electrophotographic photosensitive members which were produced by setting the $D_S$ and the H/(Si+H) in the photoconductive layer at the same values as in the layer-forming condition No. 12 were determined to be No. 63 to 75, and those evaluation results are shown in Table 25. The layer-forming conditions of the electrophotographic photosensitive members which were produced by setting the $D_S$ and the H/(Si+H) in the photoconductive layer at the same values as in the layer-forming condition No. 14 were determined to be No. 76 to 88, and those evaluation results are shown in Table 26.

(Evaluation for Layer Exfoliation)

A crosshatch pattern in which 100 squares were drawn at a space of 5 mm was formed on the surface of an electrophotographic photosensitive member by forming streaks with the width of approximately 0.3 mm to 0.5 mm in an area of 50 mm square with the use of a craft knife. At this time, the streaks were formed so as to reach a substrate. The crosshatch patterns were drawn on 12 portions randomly in the circumferential direction and the axial direction of the electrophotographic photosensitive member, and the electrophotographic photosensitive member was subjected to the evaluation for the layer exfoliation. The electrophotographic photosensitive member for the evaluation for the layer exfoliation was left in an environment kept at the temperature of 20° C. and a relative humidity of 50% for 1 hour, then was cooled to −50° C., and was left in the environment for 12 hours. After having been left for 12 hours, the electrophotographic photosensitive member for the evaluation for the layer exfoliation was moved into an environment kept at a temperature of 30° C. and a relative humidity of 80%, and was left there for 2 hours. The above described cycle were repeated 5 times. Then, the identical electrophotographic photosensitive member for the evaluation for the layer exfoliation was subsequently put into tap water at a temperature of 25° C., and was left there for 5 days.

The electrophotographic photosensitive member for the evaluation for the layer exfoliation, which had been treated in the above described way, was visually observed, and the number of the squares in which the layer exfoliation occurred even in one part was visually confirmed. After that, the layer thickness in the region in which the layer exfoliation had occurred was measured with the FIB and the TEM, in a similar way to the above described "layer thickness measurement", and the position was specified in which the layer exfoliation had occurred in the layer thickness direction of the electrophotographic photosensitive member. The number of the layer exfoliation in the vicinity of the interface between the intermediate layer and the photoconductive layer, and the number of the layer exfoliation caused by the fracture of the photoconductive layer were determined from the visually confirmed number of the squares in which the layer exfoliation had occurred and the position at which the layer exfoliation had occurred, both of which had been obtained by the above described measurement, and were used for the evaluation for the layer exfoliation.

In the evaluation for the layer exfoliation, when the squares in which the layer exfoliation that occurred in the vicinity of the interface between the intermediate layer and the photoconductive layer or the layer exfoliation that occurred due to the fracture of the photoconductive layer were less than 5 pieces, the layer exfoliation was evaluated as A, when the squares were less than 10 pieces, the layer exfoliation was evaluated as B, when the squares were less than 30 pieces, the layer exfoliation was evaluated as C, and the squares were 30 pieces or more, the layer exfoliation was evaluated as D. It is considered that in the above evaluation, if the evaluation is B or higher, a risk of the layer exfoliation is largely reduced, in a state in which the electrophotographic photosensitive member is used, including a transportation state, and if the evaluation is further A, the risk of the layer exfoliation does not almost occur.

(Evaluation of High-humidity Deletion)

Figure 4:
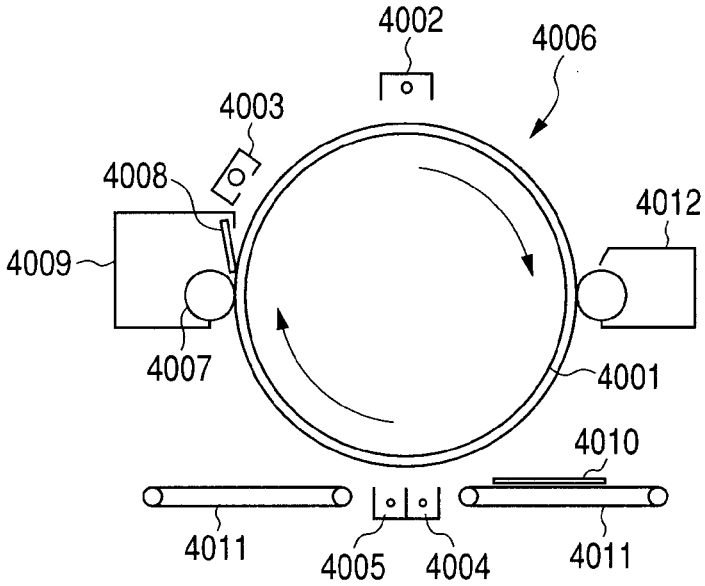
FIG. 4 is a schematic sectional view of an electrophotographic apparatus used in examples.
Figure 5:
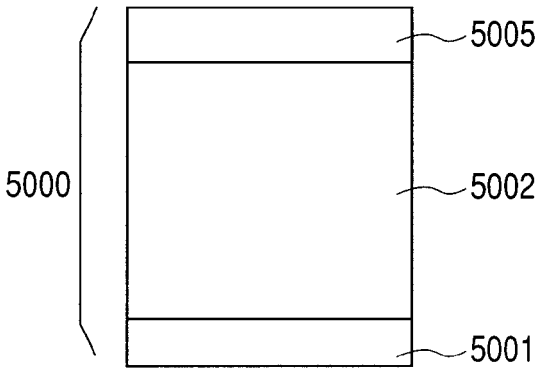
FIG. 5 is a view illustrating one example of a layer structure of a conventional electrophotographic photosensitive member.

An electrophotographic apparatus having the structure illustrated in FIG. 4 was prepared as an electrophotographic apparatus to be used in the evaluation for the high-humidity deletion. More specifically, the employed one was the digital electrophotographic apparatus "iR-5065" (trade name) made by Canon Inc. The produced electrophotographic photosensitive member was set in the above described electrophotographic apparatus, and an image of an A3 letter chart (4 pt and printing rate of 4%) was output in a high-humidity environment of a relative humidity of 75% and a temperature of 25° C., prior to a continuous paper-feeding test. At this time, the output was carried out on conditions that a heater for the photosensitive member was turned ON. After the image had been output prior to the continuous paper-feeding test, the continuous paper-feeding test was carried out. The continuous paper-feeding test was carried out on conditions that the heater for the photosensitive member was always turned OFF through out the periods in which the electrophotographic apparatus was operated and the continuous paper-feeding test was carried out, and in which the electrophotographic apparatus was stopped.

Specifically, the continuous paper-feeding test of 25,000 sheets of paper per day was carried out for ten days up to 250,000 sheets with the use of the A4 test pattern of the printing rate of 1%. After the continuous paper-feeding test had been finished, the apparatus is left for 15 hours in the environment of a temperature of 25° C. and a relative humidity of 75%. After 15 hours, the photosensitive member was set up in such a state the heater for the photosensitive member was turned OFF, and the image of the A3 letter chart (4 pt and printing rate of 4%) was output. The images which had been output before the continuous paper-feeding test and output after the continuous paper-feeding test were converted into an electronic form of a PDF file on the condition of two values of a monochromatic 300 dpi, with the use of "iRC-5870" (trade name) which is a digital electrophotographic apparatus made by Canon Inc. The black ratio in a region (251.3 mm×273 mm) of the image converted into the electronic form corresponding to one rotation of the electrophotographic photosensitive member was measured with the use of an image editing software "Adobe Photoshop" (trade name) made by Adobe Systems Incorporated. Subsequently, the ratio of the black ratio of the image which had been output after the continuous paper-feeding test with respect to that of the image which had been output before the continuous paper-feeding test was obtained, and a high-humidity deletion was evaluated.

When the high-humidity deletion occurred, the letters are blurred or form a white patch without being printed in the whole image, so the black ratio in the output image decreases compared to a normal image output before the continuous paper-feeding test. Accordingly, the closer to 100% is the ratio of the black ratio of the image which has been output after the continuous paper-feeding test with respect to that of a normal image output before the continuous paper-feeding test, the more adequate becomes the high-humidity deletion.

In the evaluation for the high-humidity deletion, when the black ratio of the image which was output after the continuous paper-feeding test with respect to the image output before the continuous paper-feeding test was 95% or more and 105% or less, the high-humidity deletion was evaluated as A, when the black ratio was 90% or more and less than 95%, the high-humidity deletion was evaluated as B, when the black ratio was 85% or more and less than 90%, the high-humidity deletion was evaluated as C, when the black ratio was 80% or more and less than 85%, the high-humidity deletion was evaluated as D, when the black ratio was 70% or more and less than 80%, the high-humidity deletion was evaluated as E, and when the black ratio was less than 70%, the high-humidity deletion was evaluated as F. In addition, when the high-humidity deletion was evaluated as D or higher, it was determined that the effect of the present invention was obtained.

(Evaluation for Abrasion Resistance)

Abrasion resistance was evaluated by a method of measuring the layer thickness of a surface layer of an electrophotographic photosensitive member right after having been produced, at the total 18 points of 9 points in a longitudinal direction (0 mm, ±50 mm, ±90 mm, ±130 mm and ±150 mm with respect to the center in the longitudinal direction of the electrophotographic photosensitive member) in an arbitrary point in a circumferential direction of the electrophotographic photosensitive member and 9 points in a longitudinal direction of the position at which the above described arbitrary point was rotated by 180 degrees in the circumferential direction, and calculating the layer thickness based on the average value of 18 points. The layer thickness was measured by vertically irradiating the surface of an electrophotographic photosensitive member with a light having a spot diameter of 2 mm, and measuring a spectrum of a reflected light with the use of a spectrometer (MCPD-2000 product made by Otsuka Electronics Co., Ltd.). The layer thickness of the surface layer was calculated based on the obtained reflection waveform. At this time, the wavelength range was set at 500 nm to 750 nm, the refractive index of the photoconductive layer was assumed to be 3.30, and as the refractive index of the surface layer, a value obtained by the above described measurement of a spectroscopic ellipsometry conducted when the Si+C atom density was measured was used.

After the layer thickness had been measured, the produced electrophotographic photosensitive member was set in "iR-5065" (trade name) which is a digital electrophotographic apparatus made by Canon Inc., similarly to the case of the evaluation for the high-humidity deletion and a continuous paper-feeding test was carried out in the high-humidity environment of the relative humidity of 75% and the temperature of 25° C., in the similar condition to the evaluation 1 for the high-humidity deletion. After the continuous paper-feeding test of 250,000 sheets had been finished, the electrophotographic photosensitive member was taken out from the electrophotographic apparatus, the layer thickness was measured at the same positions as those right after the production, and the layer thickness of the surface layer after the continuous paper-feeding test was calculated in a similar way to that right after the production. Then, a difference was determined from the average layer thicknesses of the surface layer which had been obtained right after the production and after the continuous paper-feeding test, and an abraded amount due to the 250,000 sheets was calculated. Then, a ratio of the difference of the average layer thicknesses of the surface layers which had been obtained right after the production and after the continuous paper-feeding test of each electrophotographic photosensitive member with respect to the difference of the average layer thicknesses of the surface layers in the electrophotographic photosensitive member for a layer-forming condition No. 88 was determined, and was subjected to relative evaluation. In the evaluation of the abrasion resistance, when the ratio of the difference of the average layer thicknesses of the surface layers of the electrophotographic photosensitive members which had been produced for each layer-forming condition with respect to the difference of the average layer thicknesses of the surface layers in the electrophotographic photosensitive member for the layer-forming condition No. 88 is 60% or less, the abrasion resistance was evaluated as A, when the ratio is more than 60% and 70% or less, the abrasion resistance was evaluated as B, when the ratio is more than 70% and 80% or less, the abrasion resistance was evaluated as C, when the ratio is more than 80% and 90% or less, the abrasion resistance was evaluated as D, when the ratio is more than 90% and less than 100%, the abrasion resistance was evaluated as E, and when the ratio is 100% or more, the abrasion resistance was evaluated as F. When the abrasion resistance was evaluated as D or higher, it was determined that the effect of the present invention was obtained.

The above evaluation results are shown in Tables 16 to 26 together with the analysis results of each layer. In addition, the values obtained by substituting the values of the $D_S$ for the terms in right-hand sides of the above described expression (1), the above described expression (2) and above described expression (3) were determined, and were shown in Tables 16 to 26. In the Table, the layer exfoliation in the vicinity of the interface between the photoconductive layer and the intermediate layer is described as interface, and the layer exfoliation caused by the fracture of the photoconductive layer is described as fracture. In addition, the values obtained by substituting the value of the $D_S$ for the right-hand sides of the above described expression (1), the above described expression (2) and above described expression (3) are described in columns of Expression (1), Expression (2) and Expression (3), respectively. In addition, in the Tables after Table 16, "DP" means "$D_P$", "HP1" means "$H_{P1}$", "HP2" means "$H_{P2}$", "HP" means "$H_{Pmax}$", "CM" means "$C_M$", "HM" means "$H_M$", "DM" means "$D_M$", "CS" means "$C_S$", "DS" means "$D_S$", "HS" means "$H_S$", "Expression (1)" means "right-hand side of Expression (1)", "Expression (2)" means "right-hand side of Expression (2)", and "Expression (3)" means "right-hand side of Expression (3)".

TABLE 16

| | Layer-forming condition No. | Photoconductive layer | | | | | Intermediate layer | | | Layer thickness | Surface layer | | | Layer thickness |
|---|---|---|---|---|---|---|---|---|---|---|---|---|---|---|
| | | DP | HP1 | HP2 | HP | B (ppm) | CM | HM | DM | | CS | DS | HS | |
| Comparative Example 1 | 6 | 4.69 | 0.08 | 0.08 | 0.08 | 0.5 | 0.49 | 0.35 | 6.55 | 0.1 | 0.74 | 6.81 | 0.31 | 3.0 |

TABLE 16-continued

| | | | | | | | | | | | | | | |
|---|---|---|---|---|---|---|---|---|---|---|---|---|---|---|
| Example 1 | 1 | 4.68 | 0.10 | 0.10 | 0.10 | 0.5 | 0.49 | 0.35 | 6.55 | 0.1 | 0.74 | 6.81 | 0.31 | 3.0 |
| | 2 | 4.64 | 0.13 | 0.13 | 0.13 | 0.5 | 0.49 | 0.35 | 6.55 | 0.1 | 0.74 | 6.81 | 0.31 | 3.0 |
| | 3 | 4.45 | 0.24 | 0.24 | 0.24 | 0.5 | 0.49 | 0.35 | 6.55 | 0.1 | 0.74 | 6.81 | 0.31 | 3.0 |
| | 4 | 4.22 | 0.31 | 0.31 | 0.31 | 0.5 | 0.49 | 0.35 | 6.55 | 0.1 | 0.74 | 6.81 | 0.31 | 3.0 |
| | 5 | 4.28 | 0.33 | 0.33 | 0.33 | 0.5 | 0.49 | 0.35 | 6.55 | 0.1 | 0.74 | 6.81 | 0.31 | 3.0 |
| Comparative Example 1 | 7 | 4.22 | 0.34 | 0.34 | 0.34 | 0.5 | 0.49 | 0.35 | 6.55 | 0.1 | 0.74 | 6.81 | 0.31 | 3.0 |

| | Layer-forming condition No. | Expression (1) | Expression (2) | Expression (3) | Layer exfoliation Interface | Layer exfoliation Fracture | High-humidity deletion | Abrasion resistance |
|---|---|---|---|---|---|---|---|---|
| Comparative Example 1 | 6 | 0.10 | 0.33 | 0.13 | C | A | A | A |
| Example 1 | 1 | 0.10 | 0.33 | 0.13 | B | A | A | A |
| | 2 | 0.10 | 0.33 | 0.13 | A | A | A | A |
| | 3 | 0.10 | 0.33 | 0.13 | A | A | A | A |
| | 4 | 0.10 | 0.33 | 0.13 | A | A | A | A |
| | 5 | 0.10 | 0.33 | 0.13 | A | B | A | A |
| Comparative Example 1 | 7 | 0.10 | 0.33 | 0.13 | A | C | A | A |

From the result in Table 16, it could be confirmed that when the $H_{P2}$ satisfied the above described Expression (1), the effect of reducing the layer exfoliation in the vicinity of the interface between the photoconductive layer and the intermediate layer was obtained. Furthermore, it could be confirmed that when the $H_{P2}$ satisfied the above described Expression (3), a higher effect of reducing the layer exfoliation in the vicinity of the interface between the photoconductive layer and the intermediate layer was obtained. It could be also confirmed that by controlling the $H_{Pmax}$ to the upper limit of the above described Expression (2) or less, a high effect of reducing the layer exfoliation caused by the fracture of the photoconductive layer was obtained. Furthermore, it could be confirmed that by controlling the $H_{Pmax}$ to 0.31 or less, a higher effect of reducing the layer exfoliation caused by the fracture of the photoconductive layer was obtained.

From the result in Table 17, it could be confirmed that when the $H_{P2}$ satisfied the above described Expression (1), the equal effect of reducing the layer exfoliation in the vicinity of the interface between the photoconductive layer and the intermediate layer was obtained regardless of the $D_P$, the boron amount in the photoconductive layer, the $C_M$, the $H_M$, the layer thicknesses of the intermediate layer, the $C_S$, the $H_S$ and the layer thickness of the surface layer. From the results in Tables 16 and 17, it could be confirmed that by controlling the $H_{P2}$ to a range of satisfying the above described Expression (1), a high effect of reducing the layer exfoliation in the vicinity of the interface between the photoconductive layer and the intermediate layer was obtained.

TABLE 17

| | Layer-forming condition No. | Photoconductive layer DP | HP1 | HP2 | HP | B (ppm) | Intermediate layer CM | HM | DM | Layer thickness | Surface layer CS | DS | HS | Layer thickness |
|---|---|---|---|---|---|---|---|---|---|---|---|---|---|---|
| Example 2 | 8 | 4.69 | 0.08 | 0.08 | 0.08 | 0.5 | 0.49 | 0.35 | 6.55 | 0.1 | 0.74 | 6.60 | 0.31 | 3.0 |
| Example 1 | 1 | 4.68 | 0.10 | 0.10 | 0.10 | 0.5 | 0.49 | 0.35 | 6.55 | 0.1 | 0.74 | 6.81 | 0.31 | 3.0 |
| Example 2 | 9 | 4.64 | 0.13 | 0.13 | 0.13 | 0.5 | 0.49 | 0.35 | 6.55 | 0.1 | 0.74 | 7.25 | 0.33 | 3.0 |
| | 10 | 4.52 | 0.21 | 0.21 | 0.21 | 0.5 | 0.49 | 0.35 | 6.55 | 0.1 | 0.75 | 8.43 | 0.32 | 3.0 |
| | 11 | 4.45 | 0.24 | 0.24 | 0.24 | 0.5 | 0.49 | 0.35 | 6.55 | 0.1 | 0.75 | 8.91 | 0.32 | 3.0 |

| | Layer-forming condition No. | Expression (1) | Expression (2) | Expression (3) | Layer exfoliation Interface | Layer exfoliation Fracture | High-humidity deletion | Abrasion resistance |
|---|---|---|---|---|---|---|---|---|
| Example 2 | 8 | 0.08 | 0.34 | 0.12 | B | A | B | B |
| Example 1 | 1 | 0.10 | 0.33 | 0.13 | B | A | A | A |
| Example 2 | 9 | 0.13 | 0.31 | 0.17 | B | A | A | A |
| | 10 | 0.21 | 0.26 | 0.26 | B | A | A | A |
| | 11 | 0.24 | 0.24 | 0.30 | B | A | A | A |

TABLE 18

| | Layer-forming condition No. | Photoconductive layer DP | HP1 | HP2 | HP | B (ppm) | Intermediate layer CM | HM | DM | Layer thickness | Surface layer CS | DS | HS | Layer thickness |
|---|---|---|---|---|---|---|---|---|---|---|---|---|---|---|
| Example 3 | 12 | 4.22 | 0.34 | 0.34 | 0.34 | 0.5 | 0.49 | 0.35 | 6.55 | 0.1 | 0.74 | 6.60 | 0.31 | 3.0 |
| Example 1 | 5 | 4.28 | 0.33 | 0.33 | 0.33 | 0.5 | 0.49 | 0.35 | 6.55 | 0.1 | 0.74 | 6.81 | 0.31 | 3.0 |
| Example 3 | 13 | 4.22 | 0.31 | 0.31 | 0.31 | 0.5 | 0.49 | 0.35 | 6.55 | 0.1 | 0.74 | 7.25 | 0.33 | 3.0 |
| | 14 | 4.43 | 0.26 | 0.26 | 0.26 | 0.5 | 0.49 | 0.35 | 6.55 | 0.1 | 0.75 | 8.43 | 0.32 | 3.0 |
| Example 2 | 11 | 4.45 | 0.24 | 0.24 | 0.24 | 0.5 | 0.49 | 0.35 | 6.55 | 0.1 | 0.75 | 8.91 | 0.32 | 3.0 |

| | Layer-forming condition No. | Expression (1) | Expression (2) | Expression (3) | Layer exfoliation Interface | Fracture | High-humidity deletion | Abrasion resistance |
|---|---|---|---|---|---|---|---|---|
| Example 3 | 12 | 0.08 | 0.34 | 0.12 | A | B | B | B |
| Example 1 | 5 | 0.10 | 0.33 | 0.13 | A | B | A | A |
| Example 3 | 13 | 0.13 | 0.31 | 0.17 | A | A | A | A |
| | 14 | 0.21 | 0.26 | 0.26 | A | A | A | A |
| Example 2 | 11 | 0.24 | 0.24 | 0.30 | B | A | A | A |

From the result in Table 18, it could be confirmed that when the $H_{Pmax}$ satisfied the above described Expression (2), a high effect of reducing the layer exfoliation caused by the fracture of the photoconductive layer was obtained. Furthermore, it could be confirmed that by controlling the $H_{Pmax}$ to 0.31 or less, a higher effect of reducing the layer exfoliation caused by the fracture of the photoconductive layer was obtained.

Thus, the adequate high-humidity deletion was obtained even when the electrophotographic apparatus having no heater for the photosensitive member was used, and it could be thereby confirmed that an electrophotographic photosensitive member having adequate energy-saving properties as well was obtained by controlling the Si+C atom density in the surface layer to the above described range. From the above results in

TABLE 19

| | Layer-forming condition No. | Photoconductive layer DP | HP1 | HP2 | HP | B (ppm) | Intermediate layer CM | HM | DM | Layer thickness | Surface layer CS | DS | HS | Layer thickness |
|---|---|---|---|---|---|---|---|---|---|---|---|---|---|---|
| Comparative Example 2 | 19 | 4.43 | 0.26 | 0.26 | 0.26 | 0.5 | 0.49 | 0.35 | 6.55 | 0.1 | 0.70 | 6.35 | 0.39 | 3.0 |
| | 18 | 4.43 | 0.26 | 0.26 | 0.26 | 0.5 | 0.49 | 0.35 | 6.55 | 0.1 | 0.74 | 6.48 | 0.45 | 3.0 |
| Example 4 | 15 | 4.43 | 0.26 | 0.26 | 0.26 | 0.5 | 0.49 | 0.35 | 6.55 | 0.1 | 0.75 | 6.60 | 0.43 | 3.0 |
| | 16 | 4.43 | 0.26 | 0.26 | 0.26 | 0.5 | 0.49 | 0.35 | 6.55 | 0.1 | 0.73 | 6.81 | 0.41 | 3.0 |
| | 17 | 4.43 | 0.26 | 0.26 | 0.26 | 0.5 | 0.49 | 0.35 | 6.55 | 0.1 | 0.72 | 6.90 | 0.41 | 3.0 |

| | Layer-forming condition No. | Expression (1) | Expression (2) | Expression (3) | Layer exfoliation Interface | Fracture | High-humidity deletion | Abrasion resistance |
|---|---|---|---|---|---|---|---|---|
| Comparative Example 2 | 19 | 0.06 | 0.35 | 0.10 | A | A | F | F |
| | 18 | 0.07 | 0.34 | 0.11 | A | A | E | E |
| Example 4 | 15 | 0.08 | 0.34 | 0.12 | A | A | B | B |
| | 16 | 0.10 | 0.33 | 0.13 | A | A | A | A |
| | 17 | 0.10 | 0.32 | 0.14 | A | A | A | A |

From the result in Table 19, it could be confirmed that by controlling the $D_S$ to 6.60 or more when the Si+C atom density in the surface layer was represented by $D_S \times 10^{22}$ atoms/$cm^3$, the high-humidity deletion resistance and the abrasion resistance were enhanced. It was also confirmed that by controlling the $D_S$ to 6.81 or more, the high-humidity deletion resistance and the abrasion resistance were further enhanced.

Tables 16 to 19, it could be confirmed that when the $D_S$ was controlled to 6.60 or more, and the $H_{P2}$ and the $D_S$ satisfied the above described Expression (1) and above described expression (2), an electrophotographic photosensitive member could be produced which has superior high-humidity deletion resistance, abrasion resistance and further resistance to the layer exfoliation due to a sudden environmental change.

TABLE 20

| | Layer-forming condition No. | Photoconductive layer DP | HP1 | HP2 | HP | B (ppm) | Intermediate layer CM | HM | DM | Layer thickness | Surface layer CS | DS | HS | Layer thickness |
|---|---|---|---|---|---|---|---|---|---|---|---|---|---|---|
| Example 5 | 20 | 4.67 | 0.12 | 0.12 | 0.12 | 0.5 | 0.49 | 0.35 | 6.55 | 0.1 | 0.74 | 6.60 | 0.31 | 3.0 |
| Example 1 | 2 | 4.64 | 0.13 | 0.13 | 0.13 | 0.5 | 0.49 | 0.35 | 6.55 | 0.1 | 0.74 | 6.81 | 0.31 | 3.0 |
| Example 5 | 21 | 4.58 | 0.17 | 0.17 | 0.17 | 0.5 | 0.49 | 0.35 | 6.55 | 0.1 | 0.74 | 7.25 | 0.33 | 3.0 |
| Example 3 | 14 | 4.43 | 0.26 | 0.26 | 0.26 | 0.5 | 0.49 | 0.35 | 6.55 | 0.1 | 0.75 | 8.43 | 0.32 | 3.0 |

| | Layer-forming condition No. | Expression (1) | Expression (2) | Expression (3) | Layer exfoliation Interface | Fracture | High-humidity deletion | Abrasion resistance |
|---|---|---|---|---|---|---|---|---|
| Example 5 | 20 | 0.08 | 0.34 | 0.12 | A | A | B | B |
| Example 1 | 2 | 0.10 | 0.33 | 0.13 | A | A | A | A |
| Example 5 | 21 | 0.13 | 0.31 | 0.17 | A | A | A | A |
| Example 3 | 14 | 0.21 | 0.26 | 0.26 | A | A | A | A |

From the result in Table 20, it could be confirmed that when the $H_{P2}$ satisfied the above described expression (3), the equal effect of reducing the layer exfoliation in the vicinity of the interface between the photoconductive layer and the intermediate layer was obtained. From the results in Tables 16, 17 and 20, it could be also confirmed that by controlling the $H_{P2}$ to such a range as to satisfy the above described Expression (3), a higher effect of reducing the layer exfoliation in the vicinity of the interface between the photoconductive layer and the intermediate layer was obtained.

From the result in Table 21, it could be confirmed that by controlling the $H_{Pmax}$ to 0.31 or less, the equal effect of reducing the layer exfoliation caused by the fracture of the photoconductive layer was obtained. From the results in Tables 16, 18 and 21, it could be also confirmed that by controlling the $H_{Pmax}$ to 0.31 or less, a higher effect for reducing the layer exfoliation caused by the fracture of the photoconductive layer was obtained.

TABLE 21

| | Layer-forming condition No. | Photoconductive layer DP | HP1 | HP2 | HP | B (ppm) | Intermediate layer CM | HM | DM | Layer thickness | Surface layer CS | DS | HS | Layer thickness |
|---|---|---|---|---|---|---|---|---|---|---|---|---|---|---|
| Example 6 | 22 | 4.22 | 0.31 | 0.31 | 0.31 | 0.5 | 0.49 | 0.35 | 6.55 | 0.1 | 0.74 | 6.60 | 0.31 | 3.0 |
| Example 1 | 4 | 4.22 | 0.31 | 0.31 | 0.31 | 0.5 | 0.49 | 0.35 | 6.55 | 0.1 | 0.74 | 6.81 | 0.31 | 3.0 |
| Example 3 | 13 | 4.22 | 0.31 | 0.31 | 0.31 | 0.5 | 0.49 | 0.35 | 6.55 | 0.1 | 0.74 | 7.25 | 0.33 | 3.0 |

| | Layer-forming condition No. | Expression (1) | Expression (2) | Expression (3) | Layer exfoliation Interface | Fracture | High-humidity deletion | Abrasion resistance |
|---|---|---|---|---|---|---|---|---|
| Example 6 | 22 | 0.08 | 0.34 | 0.12 | A | A | B | B |
| Example 1 | 4 | 0.10 | 0.33 | 0.13 | A | A | A | A |
| Example 3 | 13 | 0.13 | 0.31 | 0.17 | A | A | A | A |

TABLE 22

| | Layer-forming condition No. | Photoconductive layer DP | HP1 | HP2 | HP | B (ppm) | Intermediate layer CM | HM | DM | Layer thickness | Surface layer CS | DS | HS | Layer thickness |
|---|---|---|---|---|---|---|---|---|---|---|---|---|---|---|
| Example 5 | 20 | 4.67 | 0.12 | 0.12 | 0.12 | 0.5 | 0.49 | 0.35 | 6.55 | 0.1 | 0.74 | 6.60 | 0.31 | 3.0 |
| Example 7 | 23 | 4.20 | 0.12 | 0.12 | 0.12 | 0.5 | 0.49 | 0.35 | 6.55 | 0.1 | 0.74 | 6.60 | 0.31 | 3.0 |
| | 24 | 4.80 | 0.12 | 0.12 | 0.12 | 0.5 | 0.49 | 0.35 | 6.55 | 0.1 | 0.74 | 6.60 | 0.31 | 3.0 |
| | 25 | 4.67 | 0.12 | 0.21 | 0.21 | 0.0 | 0.49 | 0.35 | 6.55 | 0.1 | 0.74 | 6.60 | 0.31 | 3.0 |
| | 26 | 4.67 | 0.12 | 0.21 | 0.21 | 1.0 | 0.49 | 0.35 | 6.55 | 0.1 | 0.74 | 6.60 | 0.31 | 3.0 |
| | 27 | 4.67 | 0.12 | 0.12 | 0.12 | 0.5 | 0.49 | 0.35 | 6.55 | 1.0 | 0.74 | 6.60 | 0.31 | 3.0 |
| | 28 | 4.67 | 0.12 | 0.12 | 0.12 | 0.5 | 0.25 | 0.31 | 5.96 | 0.1 | 0.74 | 6.60 | 0.31 | 3.0 |
| | 29 | 4.67 | 0.12 | 0.12 | 0.12 | 0.5 | 0.68 | 0.31 | 5.96 | 0.1 | 0.74 | 6.60 | 0.31 | 3.0 |
| | 30 | 4.67 | 0.12 | 0.12 | 0.12 | 0.5 | 0.53 | 0.20 | 6.42 | 0.1 | 0.74 | 6.60 | 0.31 | 3.0 |
| | 31 | 4.67 | 0.12 | 0.12 | 0.12 | 0.5 | 0.53 | 0.45 | 6.42 | 0.1 | 0.74 | 6.60 | 0.31 | 3.0 |
| | 32 | 4.67 | 0.12 | 0.12 | 0.12 | 0.5 | 0.32 | 0.21 | 5.57 | 0.5 | 0.74 | 6.60 | 0.31 | 3.0 |
| | 33 | 4.67 | 0.12 | 0.12 | 0.12 | 0.5 | 0.49 | 0.35 | 6.55 | 0.1 | 0.74 | 6.60 | 0.31 | 0.2 |
| | 34 | 4.67 | 0.12 | 0.12 | 0.12 | 0.5 | 0.49 | 0.35 | 6.55 | 0.1 | 0.61 | 6.60 | 0.45 | 3.0 |
| | 35 | 4.67 | 0.12 | 0.12 | 0.12 | 0.5 | 0.49 | 0.35 | 6.55 | 0.1 | 0.75 | 6.60 | 0.45 | 3.0 |
| | 36 | 4.67 | 0.12 | 0.12 | 0.12 | 0.5 | 0.49 | 0.35 | 6.55 | 0.1 | 0.75 | 6.60 | 0.20 | 3.0 |

| | Layer-forming condition No. | Expression (1) | Expression (2) | Expression (3) | Layer exfoliation Interface | Fracture | High-humidity deletion | Abrasion resistance |
|---|---|---|---|---|---|---|---|---|
| Example 5 | 20 | 0.08 | 0.34 | 0.12 | A | A | B | B |
| Example 7 | 23 | 0.08 | 0.34 | 0.12 | A | A | B | B |
| | 24 | 0.08 | 0.34 | 0.12 | A | A | B | B |
| | 25 | 0.08 | 0.34 | 0.12 | A | A | B | B |
| | 26 | 0.08 | 0.34 | 0.12 | A | A | B | B |
| | 27 | 0.08 | 0.34 | 0.12 | A | A | B | B |
| | 28 | 0.08 | 0.34 | 0.12 | A | A | B | B |
| | 29 | 0.08 | 0.34 | 0.12 | A | A | B | B |
| | 30 | 0.08 | 0.34 | 0.12 | A | A | B | B |
| | 31 | 0.08 | 0.34 | 0.12 | A | A | B | B |
| | 32 | 0.08 | 0.34 | 0.12 | A | A | B | B |
| | 33 | 0.08 | 0.34 | 0.12 | A | A | B | B |
| | 34 | 0.08 | 0.34 | 0.12 | A | A | B | B |
| | 35 | 0.08 | 0.34 | 0.12 | A | A | B | B |
| | 36 | 0.08 | 0.34 | 0.12 | A | A | B | B |

Table 22 shows the result obtained by changing the $D_P$ and the boron amount in the photoconductive layer, the layer thickness of the intermediate layer, the $C_M$ and the $H_M$, the layer thicknesses of the surface layer, and the $C_S$ and the $H_S$, with reference to those in the layer-forming condition No. 20. From this result, it could be confirmed that when the following conditions were satisfied, the equal effect of the high-humidity deletion resistance, the abrasion resistance and the resistance to the layer exfoliation in the vicinity of the interface between the photoconductive layer and the intermediate layer was obtained regardless of the $D_P$, the boron amount in the photoconductive layer, the $C_M$, the $H_M$, the layer thicknesses of the intermediate layer, the $C_S$, the $H_S$ and the layer thicknesses of the surface layer. The following conditions are as follows. In the condition that the $D_S$ is 6.60, and that the $D_S$ and the $H_{P2}$ satisfy the above described Expression (3), the $D_P$ is 4.20 or more and 4.80 or less. The boron amount in the photoconductive layer is 0 ppm or more and 1 ppm or less, the layer thickness of the intermediate layer is 0.1 μm or more and 1.0 μm or less, the $C_M$ is 0.25 or more and $0.9 \times C_S$ or less, and the $H_M$ is 0.20 or more and 0.45 or less. The layer thickness of the surface layer is 0.2 μm or more and 3.0 μm or less, the $C_S$ is 0.61 or more and 0.75 or less, and the $H_S$ is 0.20 or more and 0.45 or less.

From the result of the layer-forming condition No. 32, it could be also confirmed that even when the $C_M$, the $H_M$ and the $D_M$ of the intermediate layer were continuously changed, if the following conditions were satisfied, the equal effect of reducing the layer exfoliation in the vicinity of the interface between the photoconductive layer and the intermediate layer to that in the layer-forming condition No. 20 was obtained. The following conditions are as follows. The average value of the $C_M$ is 0.25 or more and $0.9 \times C_S$ or less, the average value of the $H_M$ is 0.20 or more and 0.45 or less, and the average value of the $D_M$ is less than 6.60.

TABLE 23

| Layer-forming condition No. | Photoconductive layer DP | HP1 | HP2 | HP | B (ppm) | Intermediate layer CM | HM | DM | Layer thickness | Surface layer CS | DS | HS | Layer thickness |
|---|---|---|---|---|---|---|---|---|---|---|---|---|---|
| 8 | 4.69 | 0.08 | 0.08 | 0.08 | 0.5 | 0.49 | 0.35 | 6.55 | 0.1 | 0.75 | 6.60 | 0.30 | 3.0 |
| 37 | 4.20 | 0.08 | 0.08 | 0.08 | 0.5 | 0.49 | 0.35 | 6.55 | 0.1 | 0.75 | 6.60 | 0.30 | 3.0 |
| 38 | 4.80 | 0.08 | 0.08 | 0.08 | 0.5 | 0.49 | 0.35 | 6.55 | 0.1 | 0.75 | 6.60 | 0.30 | 3.0 |
| 39 | 4.69 | 0.08 | 0.08 | 0.08 | 0.0 | 0.49 | 0.35 | 6.55 | 0.1 | 0.75 | 6.60 | 0.30 | 3.0 |
| 40 | 4.69 | 0.08 | 0.08 | 0.08 | 0.10 | 0.49 | 0.35 | 6.55 | 0.1 | 0.75 | 6.60 | 0.30 | 3.0 |
| 41 | 4.69 | 0.08 | 0.08 | 0.08 | 0.5 | 0.49 | 0.35 | 6.55 | 1.0 | 0.75 | 6.60 | 0.30 | 3.0 |
| 42 | 4.69 | 0.08 | 0.08 | 0.08 | 0.5 | 0.25 | 0.31 | 5.96 | 0.1 | 0.75 | 6.60 | 0.30 | 3.0 |
| 43 | 4.69 | 0.08 | 0.08 | 0.08 | 0.5 | 0.68 | 0.31 | 5.96 | 0.1 | 0.75 | 6.60 | 0.30 | 3.0 |
| 44 | 4.69 | 0.08 | 0.08 | 0.08 | 0.5 | 0.53 | 0.20 | 6.42 | 0.1 | 0.75 | 6.60 | 0.30 | 3.0 |
| 45 | 4.69 | 0.08 | 0.08 | 0.08 | 0.5 | 0.53 | 0.45 | 6.42 | 0.1 | 0.75 | 6.60 | 0.30 | 3.0 |
| 46 | 4.69 | 0.08 | 0.08 | 0.08 | 0.5 | 0.49 | 0.35 | 6.55 | 0.1 | 0.75 | 6.60 | 0.30 | 0.2 |
| 47 | 4.69 | 0.08 | 0.08 | 0.08 | 0.5 | 0.49 | 0.35 | 6.55 | 0.1 | 0.61 | 6.60 | 0.45 | 3.0 |
| 48 | 4.69 | 0.08 | 0.08 | 0.08 | 0.5 | 0.49 | 0.35 | 6.55 | 0.1 | 0.75 | 6.60 | 0.45 | 3.0 |
| 49 | 4.69 | 0.08 | 0.08 | 0.08 | 0.5 | 0.49 | 0.35 | 6.55 | 0.1 | 0.75 | 6.60 | 0.20 | 3.0 |

| Layer-forming condition No. | Expression (1) | Expression (2) | Expression (3) | Layer exfoliation Interface | Fracture | High-humidity deletion | Abrasion resistance |
|---|---|---|---|---|---|---|---|
| 8 | 0.08 | 0.34 | 0.12 | B | A | B | B |
| 37 | 0.08 | 0.34 | 0.12 | B | A | B | B |
| 38 | 0.08 | 0.34 | 0.12 | B | A | B | B |
| 39 | 0.08 | 0.34 | 0.12 | B | A | B | B |
| 40 | 0.08 | 0.34 | 0.12 | B | A | B | B |
| 41 | 0.08 | 0.34 | 0.12 | B | A | B | B |
| 42 | 0.08 | 0.34 | 0.12 | B | A | B | B |
| 43 | 0.08 | 0.34 | 0.12 | B | A | B | B |
| 44 | 0.08 | 0.34 | 0.12 | B | A | B | B |
| 45 | 0.08 | 0.34 | 0.12 | B | A | B | B |
| 46 | 0.08 | 0.34 | 0.12 | B | A | B | B |
| 47 | 0.08 | 0.34 | 0.12 | B | A | B | B |
| 48 | 0.08 | 0.34 | 0.12 | B | A | B | B |
| 49 | 0.08 | 0.34 | 0.12 | B | A | B | B |

Table 23 shows the result obtained by changing the $D_P$ and the boron amount in the photoconductive layer, the layer thickness of the intermediate layer, the $C_M$ and the $H_M$, the layer thicknesses of the surface layer, and the $C_S$ and the $H_S$, with reference to those in the layer-forming condition No. 8. From this result, it could be confirmed that when the following conditions were satisfied, the equal effect of the high-humidity deletion resistance, the abrasion resistance and the resistance to the layer exfoliation in the vicinity of the interface between the photoconductive layer and the intermediate layer was obtained regardless of the $D_P$, the boron amount in the photoconductive layer, the $C_M$, the $H_M$, the layer thicknesses of the intermediate layer, the $C_S$, the $H_S$ and the layer thicknesses of the surface layer. The following conditions are as follows. In the condition that the $D_S$ is 6.60, and that the $D_S$ and the $H_{P2}$ satisfy the above described Expression (1), the $D_P$ is 4.20 or more and 4.80 or less, and the boron amount in the photoconductive layer is 0 ppm or more and 1 ppm or less. The layer thickness of the intermediate layer is 0.1 μm or more and 1.0 μm or less, the $C_M$ is 0.25 or more and $0.9 \times C_S$ or less, and the $H_M$ is 0.20 or more and 0.45 or less. The layer thickness of the surface layer is 0.2 μm or more and 3.0 μm or less, the $C_S$ is 0.61 or more and 0.75 or less, and the $H_S$ is 0.20 or more and 0.45 or less.

TABLE 24

| Layer-forming condition No. | Photoconductive layer DP | HP1 | HP2 | HP | B (ppm) | Intermediate layer CM | HM | DM | Layer thickness | Surface layer CS | DS | HS | Layer thickness |
|---|---|---|---|---|---|---|---|---|---|---|---|---|---|
| 11 | 4.45 | 0.24 | 0.24 | 0.24 | 0.5 | 0.49 | 0.35 | 6.55 | 0.1 | 0.75 | 8.91 | 0.32 | 3.0 |
| 50 | 4.20 | 0.24 | 0.24 | 0.24 | 0.5 | 0.49 | 0.35 | 6.55 | 0.1 | 0.75 | 8.91 | 0.32 | 3.0 |
| 51 | 4.80 | 0.24 | 0.24 | 0.24 | 0.5 | 0.49 | 0.35 | 6.55 | 0.1 | 0.75 | 8.91 | 0.32 | 3.0 |
| 52 | 4.45 | 0.24 | 0.24 | 0.24 | 0.0 | 0.49 | 0.35 | 6.55 | 0.1 | 0.75 | 8.91 | 0.32 | 3.0 |
| 53 | 4.45 | 0.24 | 0.24 | 0.24 | 1.0 | 0.49 | 0.35 | 6.55 | 0.1 | 0.75 | 8.91 | 0.32 | 3.0 |
| 54 | 4.45 | 0.24 | 0.24 | 0.24 | 0.5 | 0.49 | 0.35 | 6.55 | 1.0 | 0.75 | 8.91 | 0.32 | 3.0 |
| 55 | 4.45 | 0.24 | 0.24 | 0.24 | 0.5 | 0.25 | 0.31 | 5.96 | 0.1 | 0.75 | 8.91 | 0.32 | 3.0 |
| 56 | 4.45 | 0.24 | 0.24 | 0.24 | 0.5 | 0.68 | 0.31 | 5.96 | 0.1 | 0.75 | 8.91 | 0.32 | 3.0 |
| 57 | 4.45 | 0.24 | 0.24 | 0.24 | 0.5 | 0.53 | 0.20 | 6.42 | 0.1 | 0.75 | 8.91 | 0.32 | 3.0 |
| 58 | 4.45 | 0.24 | 0.24 | 0.24 | 0.5 | 0.53 | 0.45 | 6.42 | 0.1 | 0.75 | 8.91 | 0.32 | 3.0 |
| 59 | 4.45 | 0.24 | 0.24 | 0.24 | 0.5 | 0.49 | 0.35 | 6.55 | 0.1 | 0.75 | 8.91 | 0.32 | 0.2 |
| 60 | 4.45 | 0.24 | 0.24 | 0.24 | 0.5 | 0.49 | 0.35 | 6.55 | 0.1 | 0.61 | 8.91 | 0.45 | 3.0 |

TABLE 24-continued

| | | | | | | | | | | | | | |
|---|---|---|---|---|---|---|---|---|---|---|---|---|---|
| 61 | 4.45 | 0.24 | 0.24 | 0.24 | 0.5 | 0.49 | 0.35 | 6.55 | 0.1 | 0.75 | 8.91 | 0.45 | 3.0 |
| 62 | 4.45 | 0.24 | 0.24 | 0.24 | 0.5 | 0.49 | 0.35 | 6.55 | 0.1 | 0.75 | 8.91 | 0.20 | 3.0 |

| Layer-forming condition No. | Expression (1) | Expression (2) | Expression (3) | Layer exfoliation Interface | Layer exfoliation Fracture | High-humidity deletion | Abrasion resistance |
|---|---|---|---|---|---|---|---|
| 11 | 0.24 | 0.24 | 0.30 | B | A | A | A |
| 50 | 0.24 | 0.24 | 0.30 | B | A | A | A |
| 51 | 0.24 | 0.24 | 0.30 | B | A | A | A |
| 52 | 0.24 | 0.24 | 0.30 | B | A | A | A |
| 53 | 0.24 | 0.24 | 0.30 | B | A | A | A |
| 54 | 0.24 | 0.24 | 0.30 | B | A | A | A |
| 55 | 0.24 | 0.24 | 0.30 | B | A | A | A |
| 56 | 0.24 | 0.24 | 0.30 | B | A | A | A |
| 57 | 0.24 | 0.24 | 0.30 | B | A | A | A |
| 58 | 0.24 | 0.24 | 0.30 | B | A | A | A |
| 59 | 0.24 | 0.24 | 0.30 | B | A | A | A |
| 60 | 0.24 | 0.24 | 0.30 | B | A | A | A |
| 61 | 0.24 | 0.24 | 0.30 | B | A | A | A |
| 62 | 0.24 | 0.24 | 0.30 | B | A | A | A |

Table 24 shows the result obtained by changing the $D_P$ and the boron amount in the photoconductive layer, the layer thickness of the intermediate layer, the $C_M$ and the $H_M$, the layer thicknesses of the surface layer, and the $C_S$ and the $H_S$, with reference to those in the layer-forming condition No. 11. From this result, it could be confirmed that when the following conditions were satisfied, the following effect was obtained. The following conditions are as follows. In the condition that the $D_S$ and the $H_{P2}$ satisfy the above described Expression (1) and the above described Expression (2), the $D_P$ is 4.20 or more and 4.80 or less and the boron amount in the photoconductive layer is 0 ppm or more and 1 ppm or less. The layer thickness of the intermediate layer is 0.1 μm or more and 1.0 μm or less, the $C_M$ is 0.25 or more and $0.9 \times C_S$ or less, and the $H_M$ is 0.20 or more and 0.45 or less. The layer thickness of the surface layer is 0.2 μm or more and 3.0 μm or less, the $C_S$ is 0.61 or more and 0.75 or less, and the $H_S$ is 0.20 or more and 0.45 or less. The following effect is as follows. The equal effect of reducing both the layer exfoliation in the vicinity of the interface between the photoconductive layer and the intermediate layer and the layer exfoliation due to the fracture of the photoconductive layer is obtained regardless of the $D_P$, the boron amount in the photoconductive layer, the $C_M$, the $H_M$, the layer thicknesses of the intermediate layer, the $C_S$, the $H_S$ and the layer thickness of the surface layer.

TABLE 25

| Layer-forming condition No. | Photoconductive layer DP | HP1 | HP2 | HP | B (ppm) | Intermediate layer CM | HM | DM | Layer thickness | Surface layer CS | DS | HS | Layer thickness |
|---|---|---|---|---|---|---|---|---|---|---|---|---|---|
| 12 | 4.22 | 0.34 | 0.34 | 0.34 | 0.5 | 0.49 | 0.35 | 6.55 | 0.1 | 0.75 | 6.60 | 0.30 | 3.0 |
| 63 | 4.20 | 0.34 | 0.34 | 0.34 | 0.5 | 0.49 | 0.35 | 6.55 | 0.1 | 0.75 | 6.60 | 0.30 | 3.0 |
| 64 | 4.80 | 0.34 | 0.34 | 0.34 | 0.5 | 0.49 | 0.35 | 6.55 | 0.1 | 0.75 | 6.60 | 0.30 | 3.0 |
| 65 | 4.22 | 0.34 | 0.34 | 0.34 | 0.0 | 0.49 | 0.35 | 6.55 | 0.1 | 0.75 | 6.60 | 0.30 | 3.0 |
| 66 | 4.22 | 0.34 | 0.34 | 0.34 | 1.0 | 0.49 | 0.35 | 6.55 | 0.1 | 0.75 | 6.60 | 0.30 | 3.0 |
| 67 | 4.22 | 0.34 | 0.34 | 0.34 | 0.5 | 0.49 | 0.35 | 6.55 | 1.0 | 0.75 | 6.60 | 0.30 | 3.0 |
| 68 | 4.22 | 0.34 | 0.34 | 0.34 | 0.5 | 0.25 | 0.31 | 5.96 | 0.1 | 0.75 | 6.60 | 0.30 | 3.0 |
| 69 | 4.22 | 0.34 | 0.34 | 0.34 | 0.5 | 0.68 | 0.31 | 5.96 | 0.1 | 0.75 | 6.60 | 0.30 | 3.0 |
| 70 | 4.22 | 0.34 | 0.34 | 0.34 | 0.5 | 0.53 | 0.20 | 6.42 | 0.1 | 0.75 | 6.60 | 0.30 | 3.0 |
| 71 | 4.22 | 0.34 | 0.34 | 0.34 | 0.5 | 0.53 | 0.45 | 6.42 | 0.1 | 0.75 | 6.60 | 0.30 | 3.0 |
| 72 | 4.22 | 0.34 | 0.34 | 0.34 | 0.5 | 0.49 | 0.35 | 6.55 | 0.1 | 0.75 | 6.60 | 0.30 | 0.2 |
| 73 | 4.22 | 0.34 | 0.34 | 0.34 | 0.5 | 0.49 | 0.35 | 6.55 | 0.1 | 0.61 | 6.60 | 0.45 | 3.0 |
| 74 | 4.22 | 0.34 | 0.34 | 0.34 | 0.5 | 0.49 | 0.35 | 6.55 | 0.1 | 0.75 | 6.60 | 0.45 | 3.0 |
| 75 | 4.22 | 0.34 | 0.34 | 0.34 | 0.5 | 0.49 | 0.35 | 6.55 | 0.1 | 0.75 | 6.60 | 0.20 | 3.0 |

| Layer-forming condition No. | Expression (1) | Expression (2) | Expression (3) | Layer exfoliation Interface | Layer exfoliation Fracture | High-humidity deletion | Abrasion resistance |
|---|---|---|---|---|---|---|---|
| 12 | 0.08 | 0.34 | 0.12 | A | B | B | B |
| 63 | 0.08 | 0.34 | 0.12 | A | B | B | B |
| 64 | 0.08 | 0.34 | 0.12 | A | B | B | B |
| 65 | 0.08 | 0.34 | 0.12 | A | B | B | B |
| 66 | 0.08 | 0.34 | 0.12 | A | B | B | B |
| 67 | 0.08 | 0.34 | 0.12 | A | B | B | B |
| 68 | 0.08 | 0.34 | 0.12 | A | B | B | B |
| 69 | 0.08 | 0.34 | 0.12 | A | B | B | B |

TABLE 25-continued

| | | | | | | | |
|---|---|---|---|---|---|---|---|
| 70 | 0.08 | 0.34 | 0.12 | A | B | B | B |
| 71 | 0.08 | 0.34 | 0.12 | A | B | B | B |
| 72 | 0.08 | 0.34 | 0.12 | A | B | B | B |
| 73 | 0.08 | 0.34 | 0.12 | A | B | B | B |
| 74 | 0.08 | 0.34 | 0.12 | A | B | B | B |
| 75 | 0.08 | 0.34 | 0.12 | A | B | B | B |

Table 25 shows the result obtained by changing the $D_P$ and the boron amount in the photoconductive layer, the layer thickness of the intermediate layer, the $C_M$ and the $H_M$, the layer thicknesses of the surface layer, and the $C_S$ and the $H_S$, with reference to those in the layer-forming condition No. 12. From this result, it could be confirmed that when the following conditions were satisfied, the following effect was obtained. The following conditions are as follows. In the condition that the $D_S$ is 6.60, and that the $D_S$ and the $H_{P2}$ satisfy the above described Expression (2), the $D_P$ is 4.20 or more and 4.80 or less, and the boron amount in the photoconductive layer is 0 ppm or more and 1 ppm or less. The layer thickness of the intermediate layer is 0.1 μm or more and 1.0 μm or less, the $C_M$ is 0.25 or more and $0.9 \times C_S$ or less, and the $H_M$ is 0.20 or more and 0.45 or less. The layer thickness of the surface layer is 0.2 μm or more and 3.0 μm or less, the $C_S$ is 0.61 or more and 0.75 or less, and the $H_S$ is 0.20 or more and 0.45 or less. The following effects are as follows. The equal effects of the high-humidity deletion resistance, the abrasion resistance and reducing both the layer exfoliation in the vicinity of the interface between the photoconductive layer and the intermediate layer and the layer exfoliation due to the fracture of the photoconductive layer are obtained regardless of the $D_P$, the boron amount in the photoconductive layer, the $C_M$, the $H_M$, the layer thicknesses of the intermediate layer, the $C_S$, the $H_S$ and the layer thickness of the surface layer.

TABLE 26

| Layer-forming condition No. | Photoconductive layer DP | HP1 | HP2 | HP | B (ppm) | Intermediate layer CM | HM | DM | Layer thickness | Surface layer CS | DS | HS | Layer thickness |
|---|---|---|---|---|---|---|---|---|---|---|---|---|---|
| 14 | 4.43 | 0.26 | 0.26 | 0.26 | 0.5 | 0.49 | 0.35 | 6.55 | 0.1 | 0.75 | 8.43 | 0.32 | 3.0 |
| 76 | 4.20 | 0.26 | 0.26 | 0.26 | 0.5 | 0.49 | 0.35 | 6.55 | 0.1 | 0.75 | 8.43 | 0.32 | 3.0 |
| 77 | 4.80 | 0.26 | 0.26 | 0.26 | 0.5 | 0.49 | 0.35 | 6.55 | 0.1 | 0.75 | 8.43 | 0.32 | 3.0 |
| 78 | 4.43 | 0.26 | 0.26 | 0.26 | 0.0 | 0.49 | 0.35 | 6.55 | 0.1 | 0.75 | 8.43 | 0.32 | 3.0 |
| 79 | 4.43 | 0.26 | 0.26 | 0.26 | 1.0 | 0.49 | 0.35 | 6.55 | 0.1 | 0.75 | 8.43 | 0.32 | 3.0 |
| 80 | 4.43 | 0.26 | 0.26 | 0.26 | 0.5 | 0.49 | 0.35 | 6.55 | 1.0 | 0.75 | 8.43 | 0.32 | 3.0 |
| 81 | 4.43 | 0.26 | 0.26 | 0.26 | 0.5 | 0.25 | 0.31 | 5.96 | 0.1 | 0.75 | 8.43 | 0.32 | 3.0 |
| 82 | 4.43 | 0.26 | 0.26 | 0.26 | 0.5 | 0.68 | 0.31 | 5.96 | 0.1 | 0.75 | 8.43 | 0.32 | 3.0 |
| 83 | 4.43 | 0.26 | 0.26 | 0.26 | 0.5 | 0.53 | 0.20 | 6.42 | 0.1 | 0.75 | 8.43 | 0.32 | 3.0 |
| 84 | 4.43 | 0.26 | 0.26 | 0.26 | 0.5 | 0.53 | 0.45 | 6.42 | 0.1 | 0.75 | 8.43 | 0.32 | 3.0 |
| 85 | 4.43 | 0.26 | 0.26 | 0.26 | 0.5 | 0.49 | 0.35 | 6.55 | 0.1 | 0.75 | 8.43 | 0.32 | 0.2 |
| 86 | 4.43 | 0.26 | 0.26 | 0.26 | 0.5 | 0.49 | 0.35 | 6.55 | 0.1 | 0.61 | 8.43 | 0.45 | 3.0 |
| 87 | 4.43 | 0.26 | 0.26 | 0.26 | 0.5 | 0.49 | 0.35 | 6.55 | 0.1 | 0.75 | 8.43 | 0.45 | 3.0 |
| 88 | 4.43 | 0.26 | 0.26 | 0.26 | 0.5 | 0.49 | 0.35 | 6.55 | 0.1 | 0.75 | 8.43 | 0.20 | 3.0 |

| Layer-forming condition No. | Expression (1) | Expression (2) | Expression (3) | Layer exfoliation Interface | Fracture | High-humidity deletion | Abrasion resistance |
|---|---|---|---|---|---|---|---|
| 14 | 0.21 | 0.26 | 0.26 | A | A | A | A |
| 76 | 0.21 | 0.26 | 0.26 | A | A | A | A |
| 77 | 0.21 | 0.26 | 0.26 | A | A | A | A |
| 78 | 0.21 | 0.26 | 0.26 | A | A | A | A |
| 79 | 0.21 | 0.26 | 0.26 | A | A | A | A |
| 80 | 0.21 | 0.26 | 0.26 | A | A | A | A |
| 81 | 0.21 | 0.26 | 0.26 | A | A | A | A |
| 82 | 0.21 | 0.26 | 0.26 | A | A | A | A |
| 83 | 0.21 | 0.26 | 0.26 | A | A | A | A |
| 84 | 0.21 | 0.26 | 0.26 | A | A | A | A |
| 85 | 0.21 | 0.26 | 0.26 | A | A | A | A |
| 86 | 0.21 | 0.26 | 0.26 | A | A | A | A |
| 87 | 0.21 | 0.26 | 0.26 | A | A | A | A |
| 88 | 0.21 | 0.26 | 0.26 | A | A | A | A |

Table 26 shows the result obtained by changing the $D_P$ and the boron amount in the photoconductive layer, the layer thickness of the intermediate layer, the $C_M$ and the $H_M$, the layer thicknesses of the surface layer, and the $C_S$ and the $H_S$, with reference to those in the layer-forming condition No. 14. From this result, it could be confirmed that when the following conditions were satisfied, the following effect was obtained. The following conditions are as follows. In the condition that the $D_S$ and the $H_{P2}$ satisfy the above described Expression (2) and the above described Expression (3), the $D_P$ is 4.20 or more and 4.80 or less and the boron amount in the photoconductive layer is 0 ppm or more and 1 ppm or less. The layer thickness of the intermediate layer is 0.1 μm or more and 1.0 μm or less, the $C_M$ is 0.25 or more and $0.9 \times C_S$ or less, and the $H_M$ is 0.20 or more and 0.45 or less. The layer thickness of the surface layer is 0.2 μm or more and 3.0 μm or less, the $C_S$ is 0.61 or more and 0.75 or less, and the $H_S$ is 0.20 or more and 0.45 or less. The following effect is as follows. The equal effect of reducing both the layer exfoliation in the vicinity of the interface between the photoconductive layer and the intermediate layer and the layer exfoliation due to the fracture of the photoconductive layer is obtained regardless of the $D_P$, the boron amount in the photoconductive layer, the $C_M$, the $H_M$, the layer thicknesses of the intermediate layer, the $C_S$, the $H_S$ and the layer thickness of the surface layer.

Examples 8 to 12

Positively chargeable a-Si photosensitive members were produced on a cylindrical substrate, on conditions of the following Tables 28 to 33, in a similar way to those in Experimental Example 1. At this time, the adhesive layer and the charge injection inhibition layer were formed on conditions shown in the following Table 27. In addition, the produced number of electrophotographic photosensitive members was two cylinders for each layer-forming condition (film-forming condition).

TABLE 27

| | Layer-forming condition No. of adhesive layer | Layer-forming condition No. of charge injection inhibition layer | | |
|---|---|---|---|---|
| | N1 | U1 | U2 | U3 |
| $SiH_4$ [mL/min (normal)] | 350 | 350 | 350 | 350 |
| $H_2$ [mL/min (normal)] | 750 | 750 | 750 | 750 |
| B [ppm] (with respect to Si) | 1500 | 1500 | 1500 | 1500 |
| NO [mL/min (normal)] | — | — | 10 | — |
| $CH_4$ [mL/min (normal)] | — | — | — | 500 |
| $N_2$ [mL/min (normal)] | 750 | — | — | — |
| High-frequency electric power (W) | 400 | 400 | 400 | 400 |
| Internal pressure (Pa) | 40 | 40 | 40 | 40 |
| Substrate temperature (° C.) | 260 | 260 | 260 | 260 |

TABLE 28

| | Example 8 | | | | | | |
|---|---|---|---|---|---|---|---|
| Layer-forming condition No. | Charge injection inhibition layer | Photoconductive layer Sample condition No. | Photoconductive layer Layer thickness (μm) | Intermediate layer Sample condition No. | Intermediate layer Layer thickness (μm) | Surface layer Sample condition No. | Surface layer Layer thickness (μm) |
| 88 | U2 | P8 | 30 | M1 | 0.8 | S19 | 3.0 |
| 89 | U2 | P8 | 40 | M1 | 0.8 | S19 | 3.0 |
| 90 | U2 | P8 | 50 | M1 | 0.8 | S19 | 3.0 |

TABLE 29

| | Example 8 | | | | | | |
|---|---|---|---|---|---|---|---|
| Layer-forming condition No. | Charge injection inhibition layer | Photoconductive layer Sample condition No. | Photoconductive layer Layer thickness (μm) | Intermediate layer Sample condition No. | Intermediate layer Layer thickness (μm) | Surface layer Sample condition No. | Surface layer Layer thickness (μm) |
| 91 | U2 | P8 | 40 | M7 | 0.5 | S19 | 3.0 |
| 92 | U2 | P8 | 40 | M8 | 0.5 | S19 | 3.0 |
| 93 | U2 | P8 | 40 | M9 | 0.5 | S19 | 3.0 |

TABLE 30

| | Example 10 | | | | | | |
|---|---|---|---|---|---|---|---|
| Layer-forming condition No. | Charge injection inhibition layer | Photoconductive layer Sample condition No. | Photoconductive layer Layer thickness (μm) | Intermediate layer Sample condition No. | Intermediate layer Layer thickness (μm) | Surface layer Sample condition No. | Surface layer Layer thickness (μm) |
| 94 | U2 | P8 | 40 | M1 | 0.8 | S5 | 3.0 |
| 95 | U2 | P8 | 40 | M1 | 0.8 | S14 | 3.0 |
| 96 | U2 | P8 | 40 | M1 | 0.8 | S15 | 3.0 |
| 97 | U2 | P8 | 40 | M1 | 0.8 | S16 | 3.0 |
| 98 | U2 | P8 | 40 | M1 | 0.8 | S17 | 3.0 |
| 99 | U2 | P8 | 40 | M1 | 0.8 | S18 | 3.0 |
| 100 | U2 | P8 | 40 | M1 | 0.8 | S19 | 3.0 |
| 101 | U2 | P8 | 40 | M1 | 0.8 | S20 | 3.0 |

TABLE 31

| Layer-forming condition No. | Adhesive layer | Charge injection inhibition layer | Photoconductive layer Sample condition No. | Photoconductive layer Layer thickness (μm) | Intermediate layer Sample condition No. | Intermediate layer Layer thickness (μm) | Surface layer Sample condition No. | Surface layer Layer thickness (μm) |
|---|---|---|---|---|---|---|---|---|
| | Example 11 | | | | | | | |
| 102 | — | U1 | P8 | 40 | M1 | 0.8 | S19 | 3.0 |
| 103 | — | U2 | P8 | 40 | M1 | 0.8 | S19 | 3.0 |
| 104 | — | U3 | P8 | 40 | M1 | 0.8 | S19 | 3.0 |
| 105 | N1 | — | P8 | 40 | M1 | 0.8 | S19 | 3.0 |
| 106 | N1 | U2 | P8 | 40 | M1 | 0.8 | S19 | 3.0 |

TABLE 32

| Layer-forming condition No. | Charge injection inhibition layer | Photoconductive layer Sample condition No. | Photoconductive layer Layer thickness (μm) | Intermediate layer Sample condition No. | Intermediate layer Layer thickness (μm) | Surface layer Sample condition No. | Surface layer Layer thickness (μm) |
|---|---|---|---|---|---|---|---|
| | Example 12 | | | | | | |
| 107 | U2 | P9 | 40 | M1 | 0.8 | S19 | 3.0 |

TABLE 33

| Layer-forming condition No. | Charge injection inhibition layer | Photoconductive layer: Substrate side from middle of layer thickness Sample condition No. | Photoconductive layer: Substrate side from middle of layer thickness Layer thickness (μm) | Photoconductive layer: Intermediate layer side from middle of layer thickness Sample condition No. | Photoconductive layer: Intermediate layer side from middle of layer thickness Layer thickness (μm) | Intermediate layer Sample condition No. | Intermediate layer Layer thickness (μm) | Surface layer Sample condition No. | Surface layer Layer thickness (μm) |
|---|---|---|---|---|---|---|---|---|---|
| | Example 12 | | | | | | | | |
| 108 | U2 | P9→P6 | 20 | P6→P3 | 20 | M1 | 0.8 | S19 | 3.0 |
| 109 | U2 | P9 | 20 | P6 | 20 | M1 | 0.8 | S19 | 3.0 |
| 110 | U2 | P6 | 20 | P9 | 20 | M1 | 0.8 | S19 | 3.0 |
| 111 | U2 | P9 | 20 | P9 + P4 | 15 + 5 | M1 | 0.5 | S19 | 3.0 |

In addition, the photoconductive layer for the layer-forming condition No. 108 was formed by linearly changing the layer-forming condition from that in a sample condition No. P9 to that in a sample condition No. P6, while the layer thickness of the photoconductive layer changes to 20 μm. Furthermore, the photoconductive layer was formed by linearly changing the layer-forming condition from that in a sample condition No. P6 to that in a sample condition No. P3, while the layer thickness of the photoconductive layer changes from 20 μm to 40 μm. In addition, the photoconductive layer for the layer-forming condition No. 111 was formed on the layer-forming condition of the sample condition No. P9 until the layer thickness of the photoconductive layer reached 35 μm, and then was formed on the layer-forming condition of a sample condition No. P4 for the layer thickness 5 μm of the photoconductive layer.

One electrophotographic photosensitive member for each layer-forming condition out of electrophotographic photosensitive members which had been produced in Examples 8 to 12 was used for evaluation for a pressure scar on the evaluation condition which will be described below, and then was subjected to evaluation for the layer exfoliation, in a similar way to that in Example 1. The other of the electrophotographic photosensitive members for each layer-forming condition was used for evaluation for charging characteristics, sensitivity, ghost and image defects on the evaluation condition which will be described below, and then was subjected to evaluation for the high-humidity deletion and the abrasion resistance, in a similar way to that in Example 1. Those results are shown in Tables 34 to 39.

(Evaluation for Sensitivity)

A remodeled machine of "iR-5065" (trade name) was used for the evaluation for the sensitivity, which was a digital electrophotographic apparatus made by Canon Inc. in which a high-voltage power source was connected to each of a wire and a grid of a main charger. A produced electrophotographic photosensitive member was set in the above described electrophotographic apparatus. After that, a grid potential was set at 820 V in a state of not irradiating the electrophotographic photosensitive member with an image-exposing light, and the surface potential of the electrophotographic photosensitive member at the position of a developing apparatus at the center in the longitudinal direction of the electrophotographic photosensitive member was set so as to become 400 V while adjusting an electric current to be supplied to the wire of the main charger. Next, the average potential at the position of the developing apparatus was controlled to 100 V by continuously irradiating the electrophotographic photosensitive member with the image-exposing light and adjusting the irradiation energy, in a state of having charged the electrophotographic photosensitive member in the previously set charging condition. The sensitivity was evaluated with the use of the irradiation energy shown at this time.

An image exposing source in the electrophotographic apparatus which was used for the evaluation for the sensitivity was a semiconductor laser having the oscillation wavelength of 658 nm. The evaluation result was shown by a relative comparison in which the irradiation energy in the case of having set the electrophotographic photosensitive member of the layer-forming condition No. 94 was regarded as 1.00. In the evaluation of the sensitivity, when the ratio of the irradiation energy with respect to the irradiation energy of the electrophotographic photosensitive member for the layer-forming condition No. 94 was less than 1.10, the sensitivity was evaluated as A, when the ratio was 1.10 or more and less than 1.15, the sensitivity was evaluated as B, and when the ratio was 1.15 or more, the sensitivity was evaluated as C.

(Evaluation for Pressure Scar)

A diamond needle having a curvature radius of 0.4 mm, to which a fixed load was applied, was brought into contact with the surface of an electrophotographic photosensitive member with the use of a surface property test instrument (made by HEIDON: HEIDON-14). In this state, the diamond needle was moved on the electrophotographic photosensitive member in the generatrix direction (longitudinal direction) at a constant speed of 50 mm/minute. The movement distance could be arbitrarily set, but here was set at 10 mm. This operation was repeated while the load to be applied to the diamond needle was increased from 50 g by every 5 g and a portion at which the needle on the electrophotographic photosensitive member comes in contact was changed. The surface of the electrophotographic photosensitive member on which the surface property test was thus conducted was observed with a microscope, and was confirmed that there was no scratch thereon. After that, the electrophotographic photosensitive member was set in a digital electrophotographic apparatus "iR-5065" (trade name) made by Canon Inc., and an image having the reflection density of 0.5 was output with the use of a document in which a halftone was printed.

The image output through the above procedure was visually observed, and the minimum load at which the pressure scar was observed on the image was compared to the minimum load in the electrophotographic photosensitive member for the layer-forming condition No. 89. Accordingly, as the ratio of the minimum load to that in the layer-forming condition No. 89 is larger, the pressure scar is evaluated to be more adequate. In the evaluation of the pressure scar, when the ratio of the minimum load of the electrophotographic photosensitive member which had been produced on each layer-forming condition, with respect to the minimum load of that in the layer-forming condition No. 89 was 0.60 or more, the pressure scar was evaluated as A, and when the ratio was less than 0.60, the pressure scar was evaluated as B.

(Evaluation for Chargeability)

A remodeled machine of "iR-5065" (trade name) which was a digital electrophotographic apparatus made by Canon Inc. was used for the evaluation for chargeability. An external power source was connected to the wire of the main charger and a pre-exposure LED having a wavelength of 630 nm in this electrophotographic apparatus. In addition, the main charger was used from which a wire for a grid had been removed. This electrophotographic apparatus was installed in the environment of the temperature of 25° C. and the relative humidity of 50%, and a heater for a photosensitive member was turned ON. The light amount to be output from the pre-exposure LED was adjusted to a predetermined value with the external power source connected to the pre-exposure LED.

The produced electrophotographic photosensitive member was set in the above described electrophotographic apparatus, and then a potential sensor was set at a position of the developing apparatus in a place corresponding to a middle position in the longitudinal direction of the electrophotographic photosensitive member. Next, the pre-exposure was turned on in the above described condition, and the surface potential at the position of the developing apparatus was measured when +750 μA was applied to the wire of the main charger in a state of not irradiating the photosensitive member with an image-exposing light. The chargeability was evaluated with the use of this surface potential. The evaluation result was shown by a relative comparison in which the surface potential shown when the electrophotographic photosensitive member of the layer-forming condition No. 88 was set in the electrophotographic apparatus was regarded as 1.00. When the chargeability of the electrophotographic photosensitive member is low, the surface potential is lowered, if an electric current to be applied to the wire of the main charger is fixed. For this reason, as the surface potential is higher, the chargeability is more adequate. Accordingly, in this evaluation, as the numerical value is larger, the chargeability is more adequate. In the evaluation of the chargeability, when the ratio of the surface potential with respect to the surface potential of the electrophotographic photosensitive member for the layer-forming condition No. 88 was 1.30 or more, the chargeability was evaluated as A, when the ratio was 1.15 or more and less than 1.30, the chargeability was evaluated as B, and the ratio was less than 1.15, the chargeability was evaluated as C.

(Evaluation of Ghost)

The ghost was evaluated with the use of the same remodeled machine as was used for the evaluation for the chargeability. In this electrophotographic apparatus, a not-shown external power source is connected to the wire and the grid of the main charger, and the pre-exposure LED having the wavelength of 630 nm. Firstly, the light amount to be output from the pre-exposure LED was adjusted to a predetermined light amount with the use of the external power source connected to the pre-exposure LED. Subsequently, the produced electrophotographic photosensitive member was set in the above described electrophotographic apparatus, and then a potential sensor was set at the position of the developing apparatus in a place corresponding to the middle position in the longitudinal direction of the electrophotographic photosensitive member. Subsequently, the pre-exposure was turned on, on the above described condition, the image exposing source was turned OFF, the grid potential was set at 820 V, and the surface potential of the electrophotographic photosensitive member at the position of the developing apparatus was set so as to become +400 V while adjusting an electric current to be supplied to the wire of the main charger. Subsequently, the electric potential at the position of the developing apparatus was controlled to 100 V by irradiating the electrophotographic photosensitive member with an image-exposing light emitted from the image exposing source and adjusting the irradiation energy. After that, the potential sensor was taken out, and the developing apparatus was arranged there.

Figure 6:
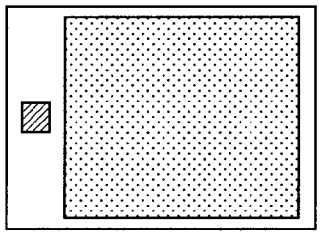
FIG. 6 is a test chart used for a ghost evaluation in examples.

The ghost was evaluated with the use of a test chart that had a black quadrangle with a reflection density of 1.4 in an area of 40 mm square, of which the center was located in a left end side of the image as illustrated in FIG. 6 and in the position of 40 mm from the left end at the middle position of the short side of an A3 chart, and has a halftone (HT) with a reflection density of 0.4 from the position of 80 mm from the left end to the position of 5 mm from the right end formed therein. The test chart was used. The test chart was mounted on a document table while the left end side of the test chart was set at the head of the document, and the reflection density in the HT section of the test chart in the output image was set so as to become 0.4 while adjusting a developing bias. An electrophotographic image of A3 was output in the state, and the reflection density of the output image was measured.

In the above description, the test chart was output on the conditions that the electrophotographic apparatus was arranged in the environment of the temperature of 22° C. and the relative humidity of 50%, a heater for the photosensitive member was turned ON, and the surface of the electrophotographic photosensitive member was kept at approximately 40° C. The measurement positions were 5 points in total of a reference position and comparison positions (4 points of ±30 mm in the short side direction and ±30 mm in the long side direction of the image in A3 paper with respect to the reference position), while the reference position was set at the middle position in the short side of the image in A3 paper and a position of 291 mm from the left end of the image in A3 paper (a position distant from the center of the above described black quadrangle by one perimeter around the electrophotographic photosensitive member). Next, an average value G of the reflection densities was determined which had been measured in the 4 comparison positions. The reflection density was measured with the use of a spectrodensitometer (made by X-Rite, Incorporated: 504 spectral densitometry).

The ghost was evaluated by determining an absolute value (|F−G|) which is a difference between the reflection density F in the above described reference position and the average value G of the reflection densities in the above described comparison positions, and using this difference. The evaluation result was shown by a relative comparison in which the difference (|F−G|) between the reflection density F in the above described reference position and the average value G of the reflection densities in the above described comparison positions obtained when the electrophotographic photosensitive member for the layer-forming condition No. 115 was set was regarded as 1.00. When the ghost has occurred, the reflection density F in the above described reference position becomes higher than the average value G of the reflection densities in the above described comparison positions. Accordingly, in this evaluation, as the numerical value is smaller, the ghost is evaluated to be more adequate. In the evaluation of the ghost, when a value of the above described (|F−G|) was less than 0.8 with respect to the electrophotographic photosensitive member for the layer-forming condition No. 115, the ghost was evaluated as A, and when the value was 0.8 or more and less than 1.0, the ghost was evaluated as B.

(Evaluation for Image Defect)

The image defects were evaluated by measuring the number of an abnormal growth portions which were formed in an electrophotographic photosensitive member and caused the image defects. The number of the abnormal growth portions having a long diameter of 10 μm or more was measured by scanning the whole surface of the produced electrophotographic photosensitive member with the use of a line sensor CCD (TL-7400CL made by Takenaka System Co., Ltd.). The ratios of "the number of the abnormal growth portions which were formed in the electrophotographic photosensitive member that was produced for each layer-forming condition" to "the number of the abnormal growth portions which were formed in the electrophotographic photosensitive member for the layer-forming condition No. 102" were determined and compared. In the evaluation of the image defects, when the ratio of the number of the abnormal growth portions to the number of the abnormal growth portions of the electrophotographic photosensitive member for the layer-forming condition No. 102 was less than 0.10, the image defect was evaluated as A, when the ratio was 0.10 or more and less than 0.50, the image defect was evaluated as B, and the ratio was 0.50 or more, the image defect was evaluated as C. The above described evaluation results are shown in Tables 34 to 39 together with the analysis results of each layer.

TABLE 34

| | Layer-forming condition No. | Photoconductive layer DP | HP1 | HP2 | HP | B (ppm) | Layer thickness | Intermediate layer CM | HM | DM | Layer thickness | Surface layer CS | HS | DS | Layer thickness | Expression (1) | Expression (2) |
|---|---|---|---|---|---|---|---|---|---|---|---|---|---|---|---|---|---|
| Example 8 | 88 | 4.43 | 0.26 | 0.26 | 0.26 | 0.5 | 30 | 0.49 | 0.35 | 6.55 | 0.8 | 0.75 | 0.36 | 7.16 | 3.0 | 0.12 | 0.31 |
| | 89 | 4.43 | 0.26 | 0.26 | 0.26 | 0.5 | 40 | 0.49 | 0.35 | 6.55 | 0.8 | 0.75 | 0.36 | 7.16 | 3.0 | 0.12 | 0.31 |
| | 90 | 4.43 | 0.26 | 0.26 | 0.26 | 0.5 | 50 | 0.49 | 0.35 | 6.55 | 0.8 | 0.75 | 0.36 | 7.16 | 3.0 | 0.12 | 0.31 |

| | Layer-forming condition No. | Expression (3) | Layer exfoliation Interface | Fracture | High-humidity deletion | Abrasion resistance | Chargeability | Sensitivity | Pressure scar | Ghost | Image defect |
|---|---|---|---|---|---|---|---|---|---|---|---|
| Example 8 | 88 | 0.16 | A | A | A | A | C | A | A | B | B |
| | 89 | 0.16 | A | A | A | A | A | A | A | B | B |
| | 90 | 0.16 | A | A | A | A | A | A | A | B | B |

From the result of Table 34, it could be confirmed that when the $D_S$ was 6.60 or more, and the $D_S$, the $H_{P2}$ and the $H_{Pmax}$ satisfied the above described expression (1) and the above described expression (2), and further the whole layer thickness of the photoconductive layer was controlled to 40 μm or more, superior charging characteristics were obtained.

TABLE 35

| | Layer-forming condition No. | Photoconductive layer DP | HP1 | HP2 | HP | B (ppm) | Intermediate layer CM | HM | DM | Layer thickness | Surface layer CS | HS | DS | Layer thickness | Expression (1) | Expression (2) |
|---|---|---|---|---|---|---|---|---|---|---|---|---|---|---|---|---|
| Example 9 | 91 | 4.43 | 0.26 | 0.26 | 0.26 | 0.5 | 0.65 | 0.39 | 5.31 | 0.8 | 0.75 | 0.36 | 7.16 | 3.0 | 0.12 | 0.31 |
| | 92 | 4.43 | 0.26 | 0.26 | 0.26 | 0.5 | 0.64 | 0.39 | 5.50 | 0.8 | 0.75 | 0.36 | 7.16 | 3.0 | 0.12 | 0.31 |
| | 93 | 4.43 | 0.26 | 0.26 | 0.26 | 0.5 | 0.64 | 0.4 | 5.95 | 0.8 | 0.75 | 0.36 | 7.16 | 3.0 | 0.12 | 0.31 |

| | Layer-forming condition No. | Expression (3) | Layer exfoliation Interface | Fracture | High-humidity deletion | Abrasion resistance | Chargeability | Sensitivity | Pressure scar | Ghost | Image defect |
|---|---|---|---|---|---|---|---|---|---|---|---|
| Example 9 | 91 | 0.16 | A | A | A | A | A | A | B | B | B |
| | 92 | 0.16 | A | A | A | A | A | A | A | B | B |
| | 93 | 0.16 | A | A | A | A | A | A | A | B | B |

From the result of Table 35, it could be confirmed that when the $D_S$ was 6.60 or more, and the $D_S$, the $H_{P2}$ and the $H_{Pmax}$ satisfied the above described expression (1) and the above described expression (2), and the $D_M$ of the Si+C atom density in the intermediate layer was controlled to 5.50 or more, a pressure scar became adequate.

From the result of Table 36, it could be confirmed that when the $D_S$ was 6.60 or more and the $D_S$, the $H_{P2}$ and the $H_{Pmax}$ satisfied the above described expression (1) and the above described expression (2), and the $H_S$ in the surface layer was controlled in a range of 0.30 or more and 0.45 or less, light absorption was reduced and adequate sensitivity was obtained.

TABLE 36

| | Layer-forming condition No. | Photoconductive layer DP | HP1 | HP2 | HP | B (ppm) | Intermediate layer CM | HM | DM | Layer thickness | Surface layer CS | HS | DS | Layer thickness | Expression (1) | Expression (2) |
|---|---|---|---|---|---|---|---|---|---|---|---|---|---|---|---|---|
| Example 10 | 94 | 4.43 | 0.26 | 0.26 | 0.26 | 0.5 | 0.49 | 0.35 | 6.55 | 0.8 | 0.70 | 0.39 | 6.35 | 3.0 | 0.06 | 0.35 |
| | 95 | 4.43 | 0.26 | 0.26 | 0.26 | 0.5 | 0.49 | 0.35 | 6.55 | 0.8 | 0.71 | 0.29 | 7.56 | 3.0 | 0.15 | 0.30 |
| | 96 | 4.43 | 0.26 | 0.26 | 0.26 | 0.5 | 0.49 | 0.35 | 6.55 | 0.8 | 0.67 | 0.30 | 7.73 | 3.0 | 0.16 | 0.29 |
| | 97 | 4.43 | 0.26 | 0.26 | 0.26 | 0.5 | 0.49 | 0.35 | 6.55 | 0.8 | 0.65 | 0.31 | 7.67 | 3.0 | 0.16 | 0.29 |
| | 98 | 4.43 | 0.26 | 0.26 | 0.26 | 0.5 | 0.49 | 0.35 | 6.55 | 0.8 | 0.70 | 0.33 | 7.43 | 3.0 | 0.14 | 0.30 |
| | 99 | 4.43 | 0.26 | 0.26 | 0.26 | 0.5 | 0.49 | 0.35 | 6.55 | 0.8 | 0.71 | 0.42 | 6.77 | 3.0 | 0.09 | 0.33 |
| | 100 | 4.43 | 0.26 | 0.26 | 0.26 | 0.5 | 0.49 | 0.35 | 6.55 | 0.8 | 0.70 | 0.44 | 6.65 | 3.0 | 0.09 | 0.33 |
| | 101 | 4.43 | 0.26 | 0.26 | 0.26 | 0.5 | 0.49 | 0.35 | 6.55 | 0.8 | 0.68 | 0.45 | 6.68 | 3.0 | 0.09 | 0.33 |

| | Layer-forming condition No. | Expression (3) | Layer exfoliation Interface | Fracture | High-humidity deletion | Abrasion resistance | Chargeability | Sensitivity | Pressure scar | Ghost | Image defect |
|---|---|---|---|---|---|---|---|---|---|---|---|
| Example 10 | 94 | 0.10 | A | A | F | F | A | A | A | B | B |
| | 95 | 0.19 | A | A | A | A | A | B | A | B | B |
| | 96 | 0.21 | A | A | A | A | A | A | A | B | B |
| | 97 | 0.20 | A | A | A | A | A | A | A | B | B |
| | 98 | 0.18 | A | A | A | A | A | A | A | B | B |
| | 99 | 0.13 | A | A | C | C | A | A | A | B | B |
| | 100 | 0.12 | A | A | C | C | A | A | A | B | B |
| | 101 | 0.12 | A | A | C | C | A | A | A | B | B |

TABLE 37

| | Photoconductive layer | | | | | Intermediate layer | | | | Surface layer | | | | | |
|---|---|---|---|---|---|---|---|---|---|---|---|---|---|---|---|
| | DP | HP1 | HP2 | HP | B (ppm) | CM | HM | DM | Layer thickness | CS | HS | DS | Layer thickness | Expression (1) | Expression (2) |
| Example 11 | 4.43 | 0.26 | 0.26 | 0.26 | 0.5 | 0.49 | 0.35 | 6.55 | 0.8 | 0.75 | 0.36 | 7.16 | 3.0 | 0.12 | 0.31 |

| | Expression (3) | Layer exfoliation: Interface | Layer exfoliation: Fracture | High-humidity deletion | Abrasion resistance | Chargeability | Sensitivity | Pressure scar | Ghost |
|---|---|---|---|---|---|---|---|---|---|
| Example 11 | 0.16 | A | A | A | A | A | A | A | B |

TABLE 38

| | Layer-forming condition No. | Adhesive layer | Charge injection inhibition layer | Image defect |
|---|---|---|---|---|
| Example 11 | 102 | — | Si, H | C |
| | 103 | — | Si, H, N, O | B |
| | 104 | — | Si, C, H | B |
| | 105 | Si, N, H | — | B |
| | 106 | Si, N, H | Si, H, N, O | A |

As for the layer-forming conditions No. 102 to 106 which were produced in Example 11, the layer-forming conditions of the photoconductive layer, the intermediate layer, and the surface layer are the same. The $D_P$, the $H_{P1}$, the $H_{P2}$, the $H_{Pmax}$, the $C_M$, the $H_M$, the $D_M$, the $C_S$, the $H_S$ and the $D_S$ of these electrophotographic photosensitive members became the same value, and the results were shown all together in Table 38. On these layer-forming conditions No. 102 to 106, the layer exfoliation, the high-humidity deletion, the abrasion resistance, the chargeability, the sensitivity, the pressure scar and the ghost were evaluated, and equal results were confirmed. From Table 38, it could be confirmed that the image defects were reduced by forming the charge injection inhibition layer containing at least one kind of atom among C, N and O between the substrate and the photoconductive layer. It could be also confirmed that the image defects were reduced by forming an adhesive layer formed from hydrogenated amorphous SiN between the substrate and the photoconductive layer. Furthermore, it could be confirmed that the image defects were further reduced by sequentially forming the adhesive layer formed from hydrogenated amorphous SiN, and the charge injection inhibition layer containing at least one kind of atom among C, N and O, between the substrate and the photoconductive layer.

TABLE 39

| | Layer-forming condition No. | Photoconductive layer: First photoconductive region DP | First photoconductive region HP1 | First photoconductive region B (ppm) | Second photoconductive region DP | Second photoconductive region HP2 | Second photoconductive region B (ppm) | HP | Surface layer CS | Surface layer HS | Surface layer DS | Layer thickness | Expression (1) | Expression (2) |
|---|---|---|---|---|---|---|---|---|---|---|---|---|---|---|
| Example 12 | 107 | 4.22 | 0.31 | 0.5 | 4.28 | 0.31 | 0.5 | 0.31 | 0.75 | 0.36 | 7.16 | 3.0 | 0.12 | 0.31 |
| | 108 | 4.37 | 0.26 | 0.5 | 4.60 | 0.17 | 0.5 | 0.31 | 0.75 | 0.36 | 7.16 | 3.0 | 0.12 | 0.31 |
| | 109 | 4.22 | 0.31 | 0.5 | 4.52 | 0.21 | 0.5 | 0.31 | 0.75 | 0.36 | 7.16 | 3.0 | 0.12 | 0.31 |
| | 110 | 4.52 | 0.21 | 0.5 | 4.22 | 0.31 | 0.5 | 0.31 | 0.75 | 0.36 | 7.16 | 3.0 | 0.12 | 0.31 |
| | 111 | 4.22 | 0.31 | 0.5 | 4.33 | 0.27 | 0.5 | 0.31 | 0.75 | 0.36 | 7.16 | 3.0 | 0.12 | 0.31 |

| | Layer-forming condition No. | Expression (3) | Layer exfoliation: Interface | Layer exfoliation: Fracture | High-humidity deletion | Abrasion resistance | Chargeability | Sensitivity | Pressure scar | Ghost | Image defect |
|---|---|---|---|---|---|---|---|---|---|---|---|
| Example 12 | 107 | 0.16 | A | A | A | A | A | A | A | B | B |
| | 108 | 0.16 | A | A | A | A | A | A | A | A | B |
| | 109 | 0.16 | A | A | A | A | A | A | A | A | B |
| | 110 | 0.16 | A | A | A | A | A | A | A | B | B |
| | 111 | 0.16 | A | A | A | A | A | A | A | A | B |

As for the layer-forming conditions No. 107 to 111 which had been produced in Example 12, the forming conditions of the intermediate layer were the same, and the $C_M$ of the electrophotographic photosensitive members was 0.49, the $H_M$ was 0.35, the $D_M$ was 6.55 and the layer thickness of the intermediate layer was 0.8 μm. On the layer-forming condition No. 108, the distribution of the H atom density in the layer thickness direction in the photoconductive layer was confirmed with a secondary ion mass spectrometry (made by ULVAC-PHI, Inc: Model 6650). As a result, it was confirmed that the H atom density continuously decreased from the substrate side of the photoconductive layer toward the intermediate layer side. Furthermore, the electrophotographic photosensitive members for the layer-forming condition No. 108 were ground from the top surface, and 7 types of samples were produced which had the layer thicknesses of the photoconductive layers of 0.5 μm, 7 μm, 14 μm, 20 μm, 26 μm, 33 μm and 40 μm. Then, the H/(Si+H) in the layer thicknesses of the above described photoconductive layers were measured, in a similar way to that in the above described measurement of the H/(Si+C+H). Then, the Si atom densities were calculated from the H atom densities and the H/Si+H in the layer thicknesses of the above described photoconductive layers. As a result, it could be confirmed that the same a-Si layer as in the sample condition No. P9 was formed in the photoconductive layer on the closest side to the substrate in the layer-forming condition No. 108, the same a-Si layer as in the sample condition No. 6 was formed in the layer thickness of 20 μm of the photoconductive layer, and the same a-Si layer as in the sample condition No. P3 was formed in the photoconductive layer on the closest side to the intermediate layer. It could be also confirmed that the Si atom density and the H/(Si+H) linearly changed in the region between the substrate side of the photoconductive layer and 20 μm therefrom and in the region between 20 μm and 40 μm therefrom. The $D_P$ and the $H_{P1}$ in the first photoconductive region, and the $D_P$, the $H_{P2}$ and the $H_{Pmax}$ in the second photoconductive region, which were calculated from these results, are shown in Table 39.

The distribution of the H atom density in the layer thickness direction in the photoconductive layer for the layer-forming conditions 109 and 110 was confirmed in a similar way to that in the layer-forming condition No. 108. As a result, it could be confirmed that the distribution of the H atom density in the layer thickness direction in the photoconductive layer was constant in the region between the substrate side of the photoconductive layer and 20 μm therefrom and in the region between 20 μm and 40 μm therefrom. Furthermore, the H/(Si+H) at 10 μm and 30 μm of the layer thicknesses of the photoconductive layer were measured, and the Si atom densities were calculated from the H atom densities and the H/(Si+H) at 10 μm and 30 μm of the layer thicknesses of the photoconductive layer, in a similar way to that in the layer-forming condition No. 108. As a result, it could be confirmed that the same a-Si layer as that in the sample condition No. P9 was formed in the region between the substrate side of the photoconductive layer for the layer-forming condition No. 109 and 20 μm therefrom, and in the region between 20 μm and 40 μm from the substrate side of the photoconductive layer for the layer-forming condition No. 110. It could be also confirmed that the same a-Si layer as in the sample condition No. P6 was formed in the region between 20 μm and 40 μm from the substrate side of the photoconductive layer for the layer-forming condition No. 109, and in the region between the substrate side of the photoconductive layer for the layer-forming condition No. 110 and 20 μm therefrom. The $D_P$ and the $H_{P1}$ in the first photoconductive region, and the $D_P$, the $H_{P2}$ and the $H_{Pmax}$ in the second photoconductive region, which were calculated from these results, are shown in Table 39.

Furthermore, the distribution of the H atom density in the layer thickness direction in the photoconductive layer for the layer-forming condition 111 was confirmed, in a similar way to that for the layer-forming condition No. 108. As a result, it could be confirmed that the distribution of the H atom density in the layer thickness direction in the photoconductive layer was constant between the substrate of the photoconductive layer and 35 μm therefrom, and between 35 μm and 40 μm therefrom. Furthermore, the H/(Si+H) at 10 μm and 37 μm of the layer thickness of the photoconductive layer were measured, and the Si atom density was calculated from the H atom density and the H/(Si+H) at 10 μm and 30 μm of the layer thickness of the photoconductive layer, in a similar way to that in the layer-forming condition No. 109. As a result, it could be confirmed that the same a-Si layer as in the sample condition No. P9 was formed in the region between the substrate side of the photoconductive layer in the layer-forming condition No. 111 and 35 μm therefrom, and the same a-Si layer as in the sample condition No. P4 was formed in the region between 35 μm and 40 μm from the substrate side. The $D_P$ and the $H_{P1}$ in the first photoconductive region, and the $D_P$, the $H_{P2}$ and the $H_{Pmax}$ in the second photoconductive region, which were calculated from these results, are shown in Table 39.

From the result of Table 39, it could be confirmed that even when the Si atom density and the H/(Si+H) in the photoconductive layer changed, the layer exfoliation can be reduced as long as the following conditions were satisfied. The following conditions are as follows. When the average value of the H/(Si+H) in the intermediate layer side from the middle position of the photoconductive layer in the layer thickness direction is represented by $H_{P2}$, the $H_{P2}$ satisfies the above described expression (1) and the $H_{Pmax}$ satisfies the above described expression (2). From the result of Table 39, it could be also confirmed that the ghost became adequate while maintaining charging characteristics by controlling the $H_{P2}$ in the intermediate layer side from the middle position of the photoconductive layer in the layer thickness direction so as to be smaller than the $H_{P1}$ in the substrate side from the middle position of the photoconductive layer in the layer thickness direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-262397, filed Nov. 17, 2009, and No. 2010-248722, filed Nov. 5, 2010, which are hereby incorporated by reference herein in their entirety.

What is claimed is:

1. An electrophotographic photosensitive member comprising a substrate, a photoconductive layer formed from hydrogenated amorphous silicon on the substrate, an intermediate layer formed from hydrogenated amorphous silicon carbide on the photoconductive layer, and a surface layer formed from hydrogenated amorphous silicon carbide on the intermediate layer, wherein when the ratio (C/(Si+C)) of the number of carbon atoms (C) in the surface layer with respect to the sum of the number of silicon atoms (Si) and the number of carbon atoms (C) in the surface layer is represented by $C_S$, the $C_S$ is 0.61 or more and 0.75 or less, when the ratio (H/(Si+C+H)) of the number of hydrogen atoms (H) in the surface layer with respect to the sum of the number of silicon atoms (Si), the number of carbon atoms (C), and the number of hydrogen atoms (H) in the surface layer is represented by $H_S$, the $H_S$ is 0.20 or more and 0.45 or less, and the layer thickness of the surface layer is 0.2 μm or more and 3.0 μm or less;

when the ratio (C/(Si+C)) of the number of carbon atoms (C) in the intermediate layer with respect to the sum of the number of silicon atoms (Si) and the number of carbon atoms (C) in the intermediate layer is represented by $C_M$, the $C_M$ is 0.25 or more and $0.9 \times C_S$ or less, when the ratio (H/(Si+C+H)) of the number of hydrogen atoms (H) in the intermediate layer with respect to the sum of the number of silicon atoms (Si), the number of carbon atoms (C), and the number of hydrogen atoms (H) in the intermediate layer is represented by $H_M$, the $H_M$ is 0.20 or more and 0.45 or less, and the layer thickness of the intermediate layer is 0.1 μm or more and 1.0 μm or less;

when the sum of the atom density of silicon atoms and the atom density of carbon atoms in the surface layer is represented by $D_S \times 10^{22}$ atoms/cm$^3$, the $D_S$ is 6.60 or more, when the sum of the atom density of silicon atoms and the atom density of carbon atoms in the intermediate layer is represented by $D_M \times 10^{22}$ atoms/cm$^3$, the $D_M$ is less than 6.60, and when the atom density of silicon atoms in the photoconductive layer is represented by $D_P \times 10^{22}$ atoms/cm$^3$, the $D_P$ is 4.20 or more and 4.80 or less; and when the maximal value of the ratio (H/(Si+H)) of the number of hydrogen atoms (H) in a distribution of hydrogen quantity in the photoconductive layer in a layer thickness direction with respect to the sum of the number of silicon atoms (Si) and the number of hydrogen atoms (H) in the distribution is represented by $H_{Pmax}$, the $D_S$ and the $H_{Pmax}$ satisfy the following Expression (2):

$$H_{Pmax} \leqq -0.04 \times D_S + 0.60 \quad \text{Expression (2)}$$

when the ratio (H/(Si+H)) of the number of hydrogen atoms (H) in the intermediate layer side from the middle position of the photoconductive layer in the layer thickness direction with respect to the sum of the number of silicon atoms (Si) and the number of hydrogen atoms (H) in the intermediate layer side is represented by $Hp_2$, the $D_S$ and the $H_{P2}$ satisfy the following Expression (1)

$$H_{P2} \geqq 0.07 \times D_S - 0.38 \quad \text{Expression (1), and}$$

the layer thickness of the photoconductive layer is 40 μm or more.

2. The electrophotographic photosensitive member according to claim 1, wherein the $H_{Pmax}$ is 0.31 or less.

3. The electrophotographic photosensitive member according to claim 1, wherein the $D_S$ and the $H_{P2}$ satisfy the following expression (3)

$$H_{P2} \geqq 0.08 \times D_S - 0.41 \quad \text{Expression (3).}$$

4. The electrophotographic photosensitive member according to claim 1, wherein the $D_S$ is 6.81 or more.

5. The electrophotographic photosensitive member according to claim 1, wherein when the ratio of the number of hydrogen atoms (H) in the substrate side from the middle position of the photoconductive layer in the layer thickness direction with respect to the sum of the number of silicon atoms (Si) and the number of hydrogen atoms (H) in the substrate side is represented by $H_{P1}$, the $H_{P2}$ is smaller than the $H_{P1}$.

6. The electrophotographic photosensitive member according to claim 1, further comprising a charge injection inhibition layer formed from hydrogenated amorphous silicon between the substrate and the photoconductive layer, wherein the charge injection inhibition layer contains at least one kind of atom among carbon atom, nitrogen atom, and oxygen atom.

7. The electrophotographic photosensitive member according to claim 1, further comprising an adhesive layer formed from hydrogenated amorphous silicon nitride on the substrate.

8. An electrophotographic apparatus comprising the electrophotographic photosensitive member according to claim 1, a main charger, an image exposing source, and a developing apparatus.

* * * * *